US008297001B2

(12) United States Patent
Nakamura et al.

(10) Patent No.: US 8,297,001 B2
(45) Date of Patent: Oct. 30, 2012

(54) WALL ASSEMBLY, WALL ASSEMBLY WITH DISPLAY SCREEN, AND ARCHITECTURE

(75) Inventors: Hiroyuki Nakamura, Yaita (JP); Makoto Uchibe, Yaita (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 877 days.

(21) Appl. No.: 12/070,926

(22) Filed: Feb. 22, 2008

(65) Prior Publication Data

US 2008/0309833 A1 Dec. 18, 2008

Related U.S. Application Data

(60) Provisional application No. 60/903,327, filed on Feb. 23, 2007.

(30) Foreign Application Priority Data

Jan. 16, 2008 (JP) ..... 2008-007313
Jan. 16, 2008 (JP) ..... 2008-007316
Jan. 16, 2008 (JP) ..... 2008-007346

(51) Int. Cl.
*E04F 19/00* (2006.01)

(52) U.S. Cl. ..... 52/27; 52/220.1

(58) Field of Classification Search ..... 52/27, 221, 52/220.1; 348/832

See application file for complete search history.

(56) References Cited

U.S. PATENT DOCUMENTS 4,296,280 A * 10/1981 Richie ..... 381/99
5,148,283 A * 9/1992 Taddeo ..... 348/832
2001/0043290 A1 11/2001 Yamamoto

FOREIGN PATENT DOCUMENTS

| | | |
|---|---|---|
| JP | 02-074107 | 3/1990 |
| JP | 06-088440 | 3/1994 |
| JP | 10-207385 | 8/1998 |
| JP | 11-099277 | 4/1999 |
| JP | 11-200533 | 7/1999 |
| JP | 11-238987 | 8/1999 |
| JP | 11-275727 | 10/1999 |
| JP | 2000-010501 | 1/2000 |
| JP | 2001-207571 | 8/2001 |
| JP | 2001-345562 | 12/2001 |
| JP | 2002-030750 | 1/2002 |

(Continued)

*Primary Examiner* — Basil Katcheves
(74) *Attorney, Agent, or Firm* — Day Pitney LLP

(57) ABSTRACT

A wall assembly of AV-device integrated type comprises: two columnar members; a holding member bridged between the columnar members so as to hold an AV device; and a front base board and a rear base board for covering a part between the columnar members. The holding member has: a plate member whose horizontal side portions are connected to the columnar members; a rectangular opening which is formed in the plate member and into which the AV device is to be fitted; and clamping members provided in an upper side portion and a lower side portion of the opening so as to clamp the AV device from up and down directions.

5 Claims, 43 Drawing Sheets

FOREIGN PATENT DOCUMENTS

| | | | |
|---|---|---|---|
| JP | 2003-075858 | | 3/2003 |
| JP | 3423529 | | 4/2003 |
| JP | 2004-081537 | | 3/2004 |
| JP | 2005-017413 | | 1/2005 |
| JP | 2005-036609 | | 2/2005 |
| JP | 2005-084270 | A | 3/2005 |
| JP | 2005-308862 | | 11/2005 |
| JP | 2006-041917 | | 2/2006 |
| JP | 2006-058587 | | 3/2006 |
| JP | 2006-058679 | | 3/2006 |
| JP | 2006-235914 | | 9/2006 |
| JP | 2006-302588 | A | 11/2006 |
| JP | 2007-002486 | | 1/2007 |
| JP | 2007-140096 | | 6/2007 |

* cited by examiner

WALL ASSEMBLY, WALL ASSEMBLY WITH DISPLAY SCREEN, AND ARCHITECTURE

CROSS-REFERENCE TO RELATED APPLICATIONS

This Nonprovisional application claims priority under 35 U.S.C. §119(e) on U.S. Provisional Application No. 60/903,327 filed on Feb. 23, 2007, and under 35 U.S.C. §119(a) on Patent Application No. 2008-7313 filed in Japan on Jan. 16, 2008, Patent Application No. 2008-7316 filed in Japan on Jan. 16, 2008, and Patent Application No. 2008-7346 filed in Japan on Jan. 16, 2008, the entire contents of which are hereby incorporated by reference.

BACKGROUND OF THE INVENTION

The present invention relates to: a wall assembly into which an AV (audiovisual) device is embedded; a wall assembly with display screen in which an image display function is built in a wall assembly that can be employed as a wall of an architecture, an indoor partition, or the like; and an architecture that employs this wall assembly or this wall assembly with display, screen.

In recent years, occasions become more frequent that high-image quality digital broadcasting is watched through a thin display device having a large screen. Nevertheless, although thickness reduction is achieved in display devices, when a display device having a large screen is installed in a room of an ordinary home, a problem arises that the display device occupies a large space and hence the room space becomes limited, a problem arises that operation noises from the device body are annoying in the room, and a problem arises that heat flow irradiated from the device body circulates in the room. As a method of resolving this problem, a flat television set is employed and attached onto a wall surface (e.g., Japanese Patent Application Laid-Open No. 2005-36609 (Patent Document 1) and Japanese Patent Application Laid-Open No. H10-207385 (Patent Document 2)).

In general, in a room where a television receiver (a television set, hereinafter) and AV devices (audio visual devices) such as a speaker are to be installed, a wardrobe, a closet, and other furniture are also installed. Further, in the walls of the room, a window and a door are provided. Thus, the resident of the room cannot arbitrarily install the television set, the AV devices, and the like. Furthermore, in AV devices, there are many types such as a speaker and a reproduction device. This causes a problem that when a large number of AV devices are installed, the room space becomes limited while cable wiring for connecting these devices degrades the esthetic appearance of the room.

Then, in Japanese Patent Application Laid-Open No. 2004-81537 (Patent Document 3), a home theater system is described that is constructed from: a cabinet for accommodating AV devices; and a ceiling provided with a cable wiring function. According to Patent Document 3, a dwelling space provided with an audio system having three-dimensional broadening realized by a large screen and stereophonic sound can be constructed without degradation in the esthetic appearance of the room.

In the prior art, thin display devices have spread widely that employ an image display device such as a liquid crystal panel. In recent years, in these display devices, advancement is achieved in size increase of the display screen, thickness reduction of the housing, and price reduction. By virtue of this, video watching through a display device having a large screen is realized even in ordinary homes. Nevertheless, although thickness reduction has progressed in display devices, installation of a display device occupies a part of the room. Thus, a large-size display device need be installed in a rather large room. Accordingly, a solution of the above-mentioned problem is sought by installing the display device in a wall or the like of the room.

For example, in Japanese Patent No. 3423529 (Patent Document 4), a system for wall surface installation of a display device is proposed in which a recess is formed in a wall and then a flat type image forming apparatus (display device) is accommodated in the recess so that a display device can easily be installed without degradation in the esthetic appearance of the installation space. In this system, a connector section that integrates various kinds of wiring is provided in a rear face or a side face of the display device. Then, a connector section is provided at a corresponding position in the recess of the wall, so that the two connector sections can automatically be connected to each other simultaneously to the installation of the display device into the recess.

FIG. 1 is a schematic sectional view for describing the outline of a wall surface installed system of Patent Document 4. In the figure, numeral 11 indicates a wall of an architecture or a residence. In one wall surface of the wall 11, a recess 12 is formed for accommodating a display device 15. The display device 15 is provided with a thin housing having a flat rectangular parallelepiped shape. Then, a display screen (not shown) for displaying a video is provided in the front face of the housing, while a connector section 16 that integrates various kinds of wiring is provided in the rear face of the housing in a manner protruding rearward. The recess 12 in the wall 11 has a size and a shape which are approximately the same as or slightly larger than the display device 15. In the surface opposing the rear face of the display device 15 accommodated in the recess 12, a connector section 13 is provided that is to be connected to the connector section 16 of the display device 15. Further, a cable 14 is connected to the connector section 13, while the cable 14 is connected to a power supply, an antenna, or the like (not shown) through the inside of the wall 11.

In the wall surface installed system having the above-mentioned configuration, when the display device 15 is accommodated into the recess 12 in the wall 11, the connector section 16 of the display device 15 is connected to the connector section 13 in the recess 12. This allows the user to easily install the display device 15 into the wall 11. Further, since the display device 15 is accommodated in the recess 12 of the wall 11, even a large-size display device 15 is prevented from occupying a part of the room. Furthermore, since the cable 14 can be connected to a power supply or an antenna through the inside of the wall 11, an advantage is obtained that the esthetic appearance of the room is improved.

SUMMARY OF THE INVENTION

When a display device is to be attached onto a wall surface, consideration on falling caused by an earthquake and a collision with a person or an object and dropping from the wall surface becomes more necessary for a larger-sized display device. Nevertheless, Patent Documents 1 and 2 do not at all disclose a configuration for avoiding the falling and dropping of the display device.

In the cabinet in Patent Document 3, when a television set and AV devices are accommodated, the function as furniture is reduced. Further, since the size of the television set and the like themselves does not change, when the furniture accommodating the television set is arranged in the room, it may become impossible that other furniture is arranged in the room. Further, in general, a high possibility of extended installation is expected in AV devices. Thus, when a television set and AV devices are accommodated in a cabinet as in Patent Document 3, extended installation can be impossible in some cases because of the fixed storage space. Further, connection terminals for connecting a television set to AV devices are provided at the rear face side of the television set in many cases. Thus, when an AV device is to be extendedly installed in the outside of the cabinet, wiring cannot be performed between the television set accommodated in the cabinet and the AV device installed in the outside of the cabinet.

In the wall surface installed system described in Patent Document 4, it is premised that the display device 15 is attached into detached from the recess 12 in the wall 11. That is, its main purpose is to simplify the attachment and detachment of the display device 15 by means of the connector sections 13 and 16. The display device 15 can be used regardless of whether it is installed in the recess 12 of the wall 11 or not. Further, the display device 15 has a configuration that a display panel, a circuit board, and the like are accommodated in the housing. Thus, the recess 12 in the wall 11 need be formed in a sufficiently large size such as to be capable of accommodating the housing of the display device 15. Further, as shown in FIG. 1, when the connector section 13 is provided at a position that permits connection to the connector section 16 provided in the rear face of the display device 15, in the inside of the wall 11, a space for passing the cable 14 is necessary at the rear face side of the recess 12. Thus, the thickness of the display device 15 (that is, the depth of the recess 12) and the size of the space for passing the cable 14 determine the minimum required thickness of the wall 11. This causes a problem that the wall surface installed system described in Patent Document 4 cannot be employed unless the wall 11 has a rather large value in the thickness.

Further, the display device 15 generates heat in association with its operation. Then, when the display device 15 is accommodated in the recess 12 of the wall 11, a problem arises that the heat generated by the display device 15 cannot be released. This causes the possibility of a temperature rise in the display device 15 and its periphery, and hence causes the possibility of failure, lifetime degradation, or the like in the display device 15 as well as the possibility of deformation, degradation, or the like in the wall 11. When the recess 12 is formed in a size sufficiently larger than the display device 15 so that a sufficient gap is formed between the display device 15 and the wall 11, the heat generated by the display device 15 can be released to an extent. Nevertheless, this causes the necessity of further increase in the thickness of the wall 11 and the possibility of degradation in the esthetic appearance of the room (the wall 11).

The present inventors have focused attention on the fact that in place of the configuration that a display device is attached onto a wall surface, when a wall assembly itself is constructed as a display device, the problems of the arrangement place and the falling and dropping of an AV device can be resolved at once.

An object of the present invention is to provide: a wall assembly of AV device integrated type that can resolve at once the problems of the arrangement place and the falling and dropping of an AV device; and an architecture employed this wall assembly.

Another object of the present invention is to provide a wall assembly in which an AV device is embedded inside the wall while connection to external devices to be connected to the embedded AV device is achieved easily so that extended installation of external devices can be performed easily.

Yet another object of the present invention is to provide a wall assembly with display screen which can be employed as a wall of an architecture, an indoor partition, or the like and in which thickness reduction is achieved even when a display screen is provided and hence an image display function is built in.

Yet another object of the present invention is to provide a wall assembly with display screen capable of reliably releasing heat generated by an image display device; and an architecture that employs this.

The wall assembly according to the present invention has: at least two columnar members; a holding member bridged between the columnar members so as to hold an AV device; and a cover plate for covering a part between the columnar members. In the present invention, an AV device is held in the inside of a wall by a holding member bridged between at least two columnar members. Then, a cover plate constitutes a wall surface and covers a part between the columnar members. Thus, the AV device is constructed in an integrated manner as a wall assembly. This resolves at once the problems of the arrangement place and the falling and dropping of the AV device.

Here, the scope of the present invention includes also a wall assembly in which an AV device is not yet held by the holding member. Further, the columnar members are not limited to through pillars, studs, or the like in a framework construction method, and may be dedicated ones for AV device holding. Further, the scope of the columnar members includes a frame in a two-by-four construction and a panel construction. Furthermore, the wall assembly according to the present invention is not necessarily limited to that of architecture use, and may be a wall assembly like a partition used in an office, an exhibition site, or the like.

In the wall assembly according to the present invention, the cover plate has a window through which the AV device held by the holding member is exposed. Thus, the AV device is exposed to the outside of the wall. In particular, when the AV device is a display device, the display screen of the display device is exposed through the window to the outside of the wall. Thus, the user can visually recognize the display screen from the outside of the wall.

The wall assembly according to the present invention comprises a shielding member for shielding the window in a manner permitting open and close. Since, the shielding member shields the window in a manner permitting open and close, the AV device can be exposed to the outside of the wall or alternatively hidden inside the wall depending on the necessity.

In the wall assembly according to the present invention, the shielding member has a sheet shape, while a winding shaft is provided for winding up the shielding member. When the winding shaft winds up the sheet-shaped shielding member, the window is opened. Further, the winding shaft winds down the shielding member, the window is shielded.

The wall assembly according to the present invention comprises a driving section (a motor) for rotating the winding shaft. Since the motor rotates the winding shaft, the window can electrically be opened and closed.

The wall assembly according to the present invention comprises area changing means for changing an area of the window. When the area changing means changes the area of the window, the exposure area of the AV device is changed. For example, when the AV device is a display device, its display screen can be exposed in a state that the size of the window is changed in accordance with the size of the display screen.

In the wall assembly according to the present invention, a frame material for changing an area of the window is fitted in the window. When the frame material fitted in the window is removed, the area of the window is increased. Further, when the frame material is fitted into the window, the area of the window is reduced.

In the wall assembly according to the present invention, the cover plate has a plurality of material plates stacked in a normal direction. Then, a material plate at the front layer side of the cover plate is provided with a window having a smaller area than a window of a material plate at the deeper layer side thereof. When a material plate provided in the cover plate is peeled off from the outer side in a normal direction, the area of the window is increased. Further, when the peeled-off material plate is stacked again, the area of the window is reduced.

In the wall assembly according to the present invention, the cover plate is fixed to the columnar members in a manner permitting open and close or in a manner permitting attachment and detachment. When the cover plate covering a part between the columnar members is opened or removed, the part between the columnar members is exposed. Since the holding member for holding an AV device is arranged between the columnar members, the AV device and the AV device periphery are exposed also. This allows the user to perform maintenance and management of the AV device.

The wall assembly according to the present invention comprises a hinge for connecting one columnar member to the cover plate. Since the cover plate is connected to the one columnar member by the hinge, the cover plate is opened and closed like a door. Thus, with opening the cover plate like a door, the user can perform maintenance and management of the AV device.

The wall assembly according to the present invention comprises a magnet for magnetically fixing the other columnar member to the cover plate. Since the cover plate is magnetically fixed to the columnar member, this locking mechanism for the cover plate is realized by a simple configuration.

In the wall assembly according to the present invention, the holding member has: a plate member whose horizontal side portions are connected to the columnar members; a rectangular opening which is formed in the plate member and into which the AV device is to be fitted; and clamping members provided in an upper side portion and a lower side portion of the opening so as to clamp the AV device from up and down directions. The AV device is fitted into the opening formed in the plate member connected to the columnar members, and then clamped from the upper and lower sides by the clamping members provided in the upper and lower sides of the opening. Thus, even a large-size AV device can be held firmly in the inside of the wall.

In the wall assembly according to the present invention, the clamping members have a flat-plate shape formed in an integrated manner in a direction normal to the cover plate respectively from an upper side portion and a lower side portion of the opening approximately perpendicularly to the plate member, and have screw holes provided on one face side of the plate member and used for fastening the AV device. Thus, the AV device can be attached from one face side of the wall assembly.

In the wall assembly according to the present invention, the clamping members have a shallow-dish shaped part and a mounted piece formed on an outer side of a bottom face of the shallow-dish shaped part, and the mounted piece is screwed from one face side onto the plate member. Thus, an AV device can be held inside the wall regardless of the shape of the AV device. Further, the AV device can be attached from one face side of the wall assembly.

The wall assembly according to the present invention comprises a spacer member for adjusting the distance between the individual clamping members in up and down directions. Thus, an AV device can be held inside the wall regardless of the size of the AV device.

In the wall assembly according to the present invention, the plate member has clamping pieces for clamping the clamping members in a manner movable in up and down directions. The clamping members are clamped in a manner movable in up and down directions by clamping pieces provided in the plate member. Thus, when the vertical position of the clamping members is changed, an AV device can be held inside the wall regardless of the size of the AV device.

In the wall assembly according to the present invention, the holding member and the cover plate are formed in an integrated manner. Thus, the number of components is reduced in comparison with a case that the holding member and the cover plate are formed as separate components.

In the wall assembly according to the present invention, the cover plate has a remote control signal passing aperture for passing a remote control signal for operating the AV device by remote control. Thus, the AV device integrated with the wall assembly can be operated by remote control.

In the wall assembly according to the present invention, the cover plate includes at least one of a wooden board, a cement board, a gypsum board, and a steel board. Since the cover plate is composed of a common member like a wooden board, a cement board, a gypsum board, and a steel board, the wall assembly can be fabricated at a low cost.

The wall assembly according to the present invention comprises an AV device held by the holding member.

In the wall assembly according to the present invention, the holding member holds the AV device in such a manner that the front face of the AV device is located at the holding member side relative to the cover plate. Since the front face of the AV device is located at the holding member side relative to the cover plate, a situation is avoided that an object such as a user located outside the wall collides an AV device protruding to the outside of the wall surface.

In the wall assembly according to the present invention, the AV device has a cabinet provided with screw holes used for being fastened to the holding member. Thus, the AV device can be screwed more firmly to the holding member.

The architecture according to the present invention comprises any one of the wall assemblys described above.

The wall assembly according to the present invention comprises: an AV device; a front face plate having an opening and forming a wall surface; a holding part for holding the AV device on a surface of the front face plate or at the rear side of the front face plate; input means which is held by the holding part and into which at least one of a supply power, a control signal, a sound signal, and a video signal is inputted; and output means for outputting at least one of the supply power, the control signal, the sound signal, and the video signal inputted to the input means. Then, any one of the input means and the output means is connected to the AV device, while the other is held by the holding part in a manner connectable to the outside through the opening. Any one of the input means and the output means is connected to the AV device embedded in the wall assembly, while the other is connectable to the outside. Thus, even in a case that a new peripheral device (external device) is to be connected to the AV device embedded in the wall assembly for the purpose of function expansion, when the peripheral device is merely connected to the input means or the output means, the peripheral device and the AV device are easily connected to each other.

The wall assembly according to the present invention comprises a plural pieces of input means and output means. This permits an increase in the number of external devices to be connected.

In the wall assembly according to the present invention, the AV device is a display device; the display device is held in such a manner that a display screen is oriented to the front face plate side; and in the front face plate, a window is formed at least at a position overlapping with the display screen. The display device is located between the front face plate and the rear face plate, while the display screen of the display device can be recognized visually from the outside through the window of the front face plate. Thus, a display device can be embedded inside a wall assembly. This avoids the necessity of consideration on the installing space of the display device.

In the wall assembly according to the present invention, in the front face plate, a ventilation opening is provided for establishing fluid communication between a rear side and a front side of the front face plate. Thus, heat generated by the AV device can be released to the outside.

The wall assembly according to the present invention comprises a power unit for providing, to the AV device, power supplied from the outside. This simplifies wiring work of connecting the AV device to the outside.

The wall assembly according to the present invention further comprises an interface for providing to the AV device at least one of a television antenna signal and a CATV (cable television) signal supplied from the outside. Thus, a television antenna signal or a CATV signal can be inputted to the AV device.

The wall assembly according to the present invention further comprises an interface for connecting the AV device to an external LAN. Thus, the AV device can be connected to a network.

The wall assembly according to the present invention further comprises a shielding member for shielding the opening in a manner permitting open and close. Since the opening is shielded by the shielding member in a manner permitting open and close, dust and the like can be prevented from entering through the opening.

The wall assembly with display screen according to the present invention comprises: an image display device; a circuit board on which a circuit for controlling the image display device is mounted; and a wall plate in which an opening is formed. Then, the image display device is held in such a manner that a display screen is exposed through the opening.

In the present invention, in place of a configuration that a display device is held in a recess formed in a wall, an image display device such as a liquid crystal panel and an organic EL (Electro-Luminescence) panel mounted on a display device is held in an immobile manner relative to a wall plate. Then, the display screen of the image display device is exposed through the opening formed in the wall plate. The image display device may be fixed directly to and held by the wall plate, or alternatively may be held by another member. Thus, a display device can be integrated into a wall assembly in a mode of embedding the image display device. No housing is necessary for the display device (in other words, the wall plate serves as a housing). Thus, the image display device, the circuit board, the cable, and the like that constitute the display device can be arranged arbitrarily in the wall assembly. This permits simple thickness reduction in the wall assembly.

The wall assembly with display screen according to the present invention comprises a holding member for holding an image display device and a circuit board in such a manner that in such a manner that the display screen of the image display device is exposed through the opening. The wall assembly with display screen comprises a holding member for holding: the image display device; and the circuit board on which a circuit for controlling the image display device is mounted. Further, the holding member holds the image display device in such a manner that the display screen is exposed through the opening of the wall assembly. Thus, even a large-size image display device can stably be held by the holding member.

The wall assembly with display screen according to the present invention further comprises: a rear wall plate; and fixing members for fixing the wall plate and the rear wall plate in a manner separated by a predetermined gap. The holding member is arranged between the wall plate and the rear wall plate. The wall plate in which a display screen is provided (referred to as, the front wall plate, hereinafter) and the rear wall plate serving as the opposite face of this are fixed in a manner separated by a predetermined gap. Then, the holding member for holding the image display device in an immobile manner is arranged between the front wall plate and the rear wall plate, so that the wall assembly is constructed. The front wall plate and the rear wall plate serving as the wall surfaces of the wall assembly with display screen are, in some cases, fabricated from wood or synthetic resin material from the viewpoint of design property, weight reduction, and the like. This causes a possibility that a sufficient strength for holding the image display device, the circuit board, and the like is not ensured. Thus, the holding member is provided between the front wall plate and the rear wall plate, so that the strength of the holding member is made sufficient for holding the image display device, the circuit board, and the like. By virtue of this, the display panel can be held reliably regardless of the strengths of the front wall plate and the rear wall plate.

In the wall assembly with display screen according to the present invention, the holding member holds the image display device in a manner separated from the rear wall plate by a predetermined gap. Then, a ventilation opening that leads to the gap is formed in the front wall plate and/or the rear wall plate. Thus, air in the image display device periphery inside the wall assembly with display screen can be exchanged with outside air through the ventilation opening. Accordingly, heat generated by the image display device can be released to the outside.

The wall assembly with display screen according to the present invention further comprises a heat radiating member provided between the image display device and the rear wall plate and radiating heat generated by the image display device. Thus, the heat of the image display device can be released efficiently through the heat radiating member.

In the wall assembly with display screen according to the present invention, the heat radiating member has a plate shape provided with a surface larger than the display screen of the image display device, and is fixed onto the opposite face side to the display screen of the image display device. The wall surface of the front wall plate is larger than the display screen of the image display device, and hence a space larger than the image display device is present inside the wall assembly with display screen. Thus, the heat radiating member for radiating the heat generated by the image display device can be fabricated into a plate shape provided with a surface larger than the display screen of the image display device. Thus, when the heat radiating member having a plate shape larger than the display screen is fixed onto the opposite face (rear face) side to the display screen of the image display device, the heat radiation effect is improved without the necessity of increase in the thickness of the wall assembly with display screen.

In the wall assembly with display screen according to the present invention, the circuit board is arranged in alignment with the image display device in a direction along the wall surface of the front wall plate. Since a space larger than the image display device is present inside the wall assembly with display screen, the circuit board on which a control circuit for the image display device is mounted is arranged in alignment with the image display device in a direction along the wall surface of the front wall plate. Thus, in comparison with a configuration that the circuit board is arranged at the rear face side of the image display device, the interval between the front wall plate and the rear wall plate can be reduced so that thickness reduction is achieved in the wall assembly with display screen.

In the wall assembly with display screen according to the present invention, the circuit board is fixed in a manner separated from the rear wall plate by a predetermined gap. Then, a heat radiating member for radiating heat generated by the circuit board is provided between the circuit board and the rear wall plate. Thus, the heat generated by the circuit board can be released efficiently through the heat radiating member.

In the architecture according to the present invention, one or a plurality of walls are constructed from the wall assembly or the wall assembly with display screen described above.

According to the present invention, an image display device and a circuit board are held in such a manner that the display screen of the image display device is exposed through the opening of the front wall plate. This realizes a wall assembly with display screen in which a display device is embedded in an integrated manner. Further, a thin wall assembly with display screen can be realized by appropriately arranging inside the wall assembly the image display device, the circuit board, the cable, and the like which are necessary for the display function. Thus, for example, even when a satisfactory wall thickness cannot be ensured in an architecture or alternatively a thin wall assembly is required in the case of an indoor partition or the like, the wall assembly with display screen of the present invention can be employed. Further, in an architecture whose wall is constructed from the wall assembly with display screen of the present invention, only a display screen is provided in the wall. Thus, a device used for watching a video can be installed in a room without degradation of the esthetic appearance of the room and without occupation of a part of the space of the room.

Further, according to the present invention, heat generated by the equipment such as an image display device and a circuit board inside the wall assembly with display screen can be released reliably and efficiently by virtue of the gap provided between the image display device and the rear wall plate; the ventilation opening that leads to this gap; the heat radiating member provided at the rear face side of the image display device; and the like. Thus, the occurrence of malfunction, failure, and the like caused by the heat is avoided in the image display device, the circuit board, and the like. Further, the occurrence of deformation, degradation, and the like caused by the heat is avoided in the wall assembly with display screen. This achieves lifetime extension and reliability improvement in the wall assembly with display screen.

The above and further objects and features of the invention will more fully be apparent from the following detailed description with accompanying drawings.

DETAILED DESCRIPTION OF THE INVENTION

First Embodiment

Figure 1:
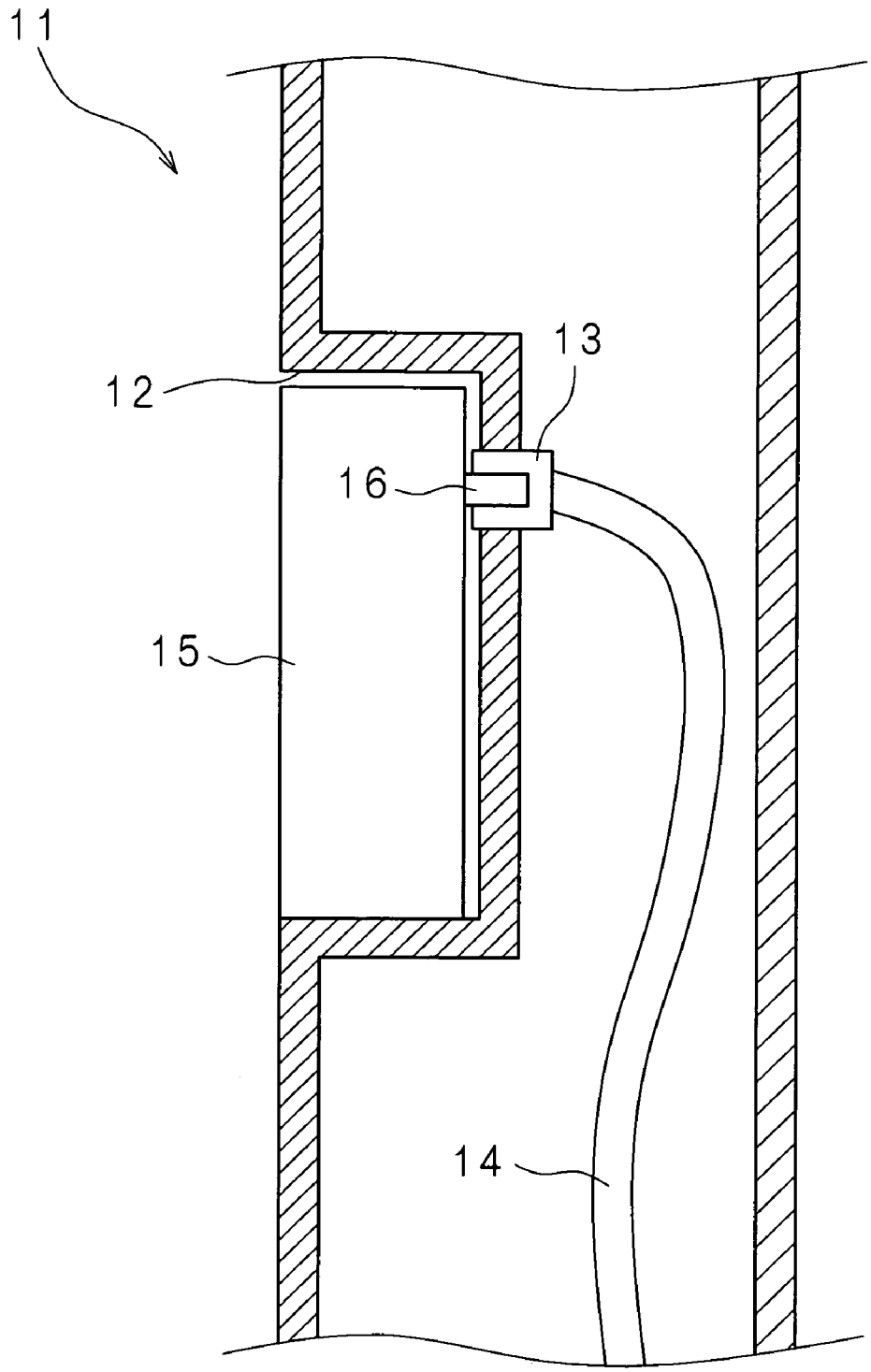
FIG. 1 PRIOR ART
FIG. 1 is a schematic sectional view for describing the outline of a wall surface installed system according to a prior art (Patent Document 4)
Figure 2:
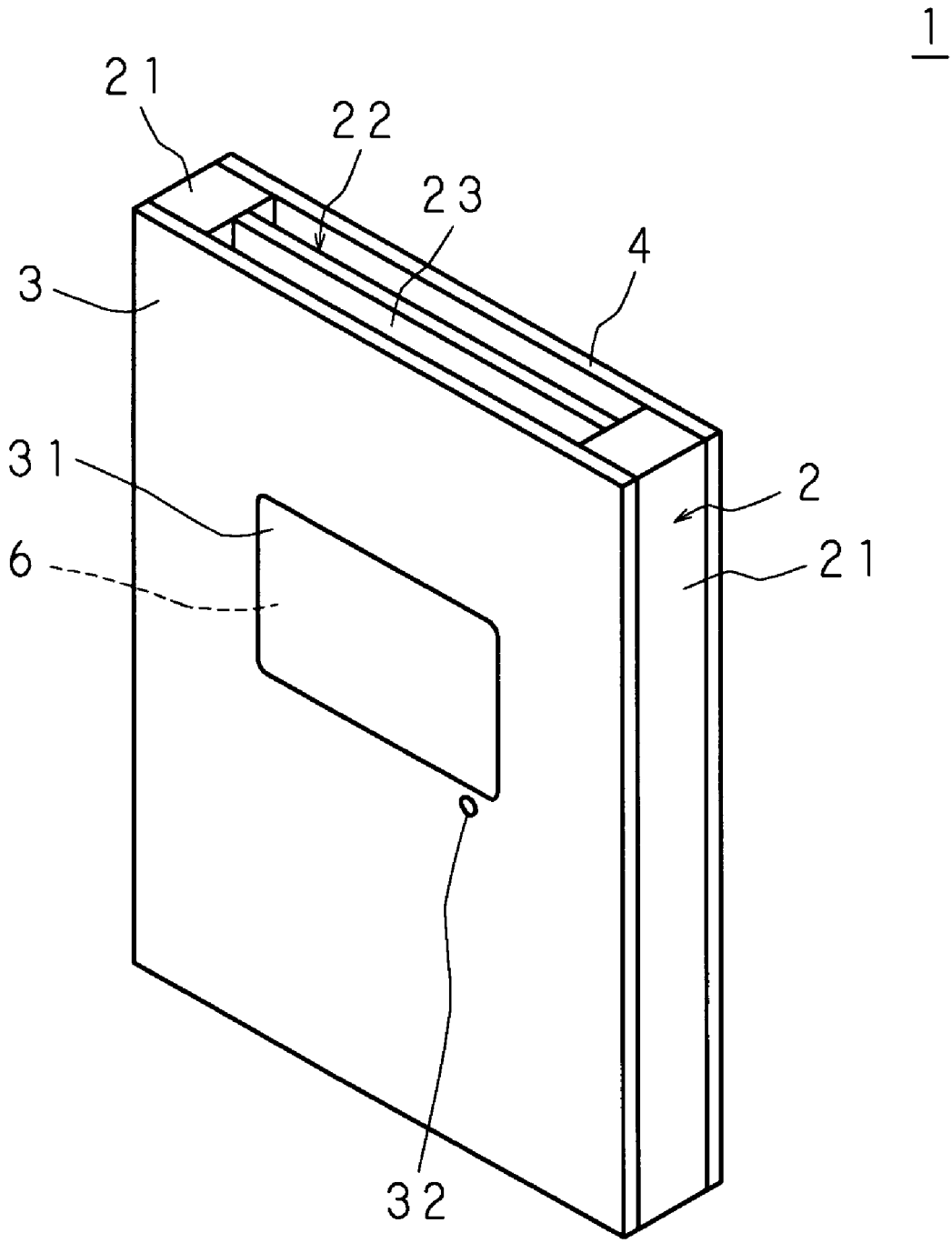
FIG. 2 is a perspective view schematically showing an architecture wall assembly according to a first embodiment.
Figure 3:
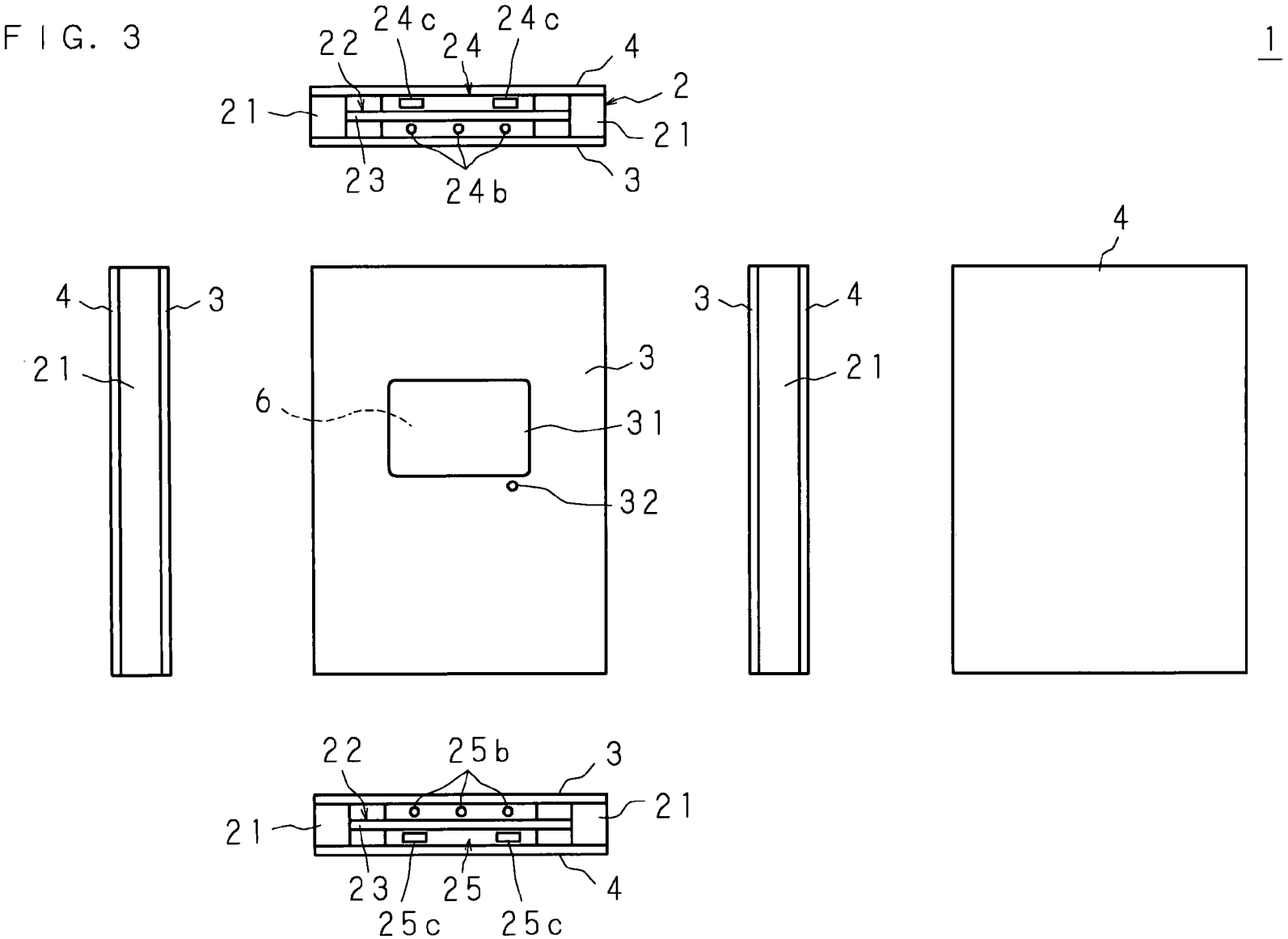
FIG. 3 is a six-side view diagram of an architecture wall assembly.
Figure 4:
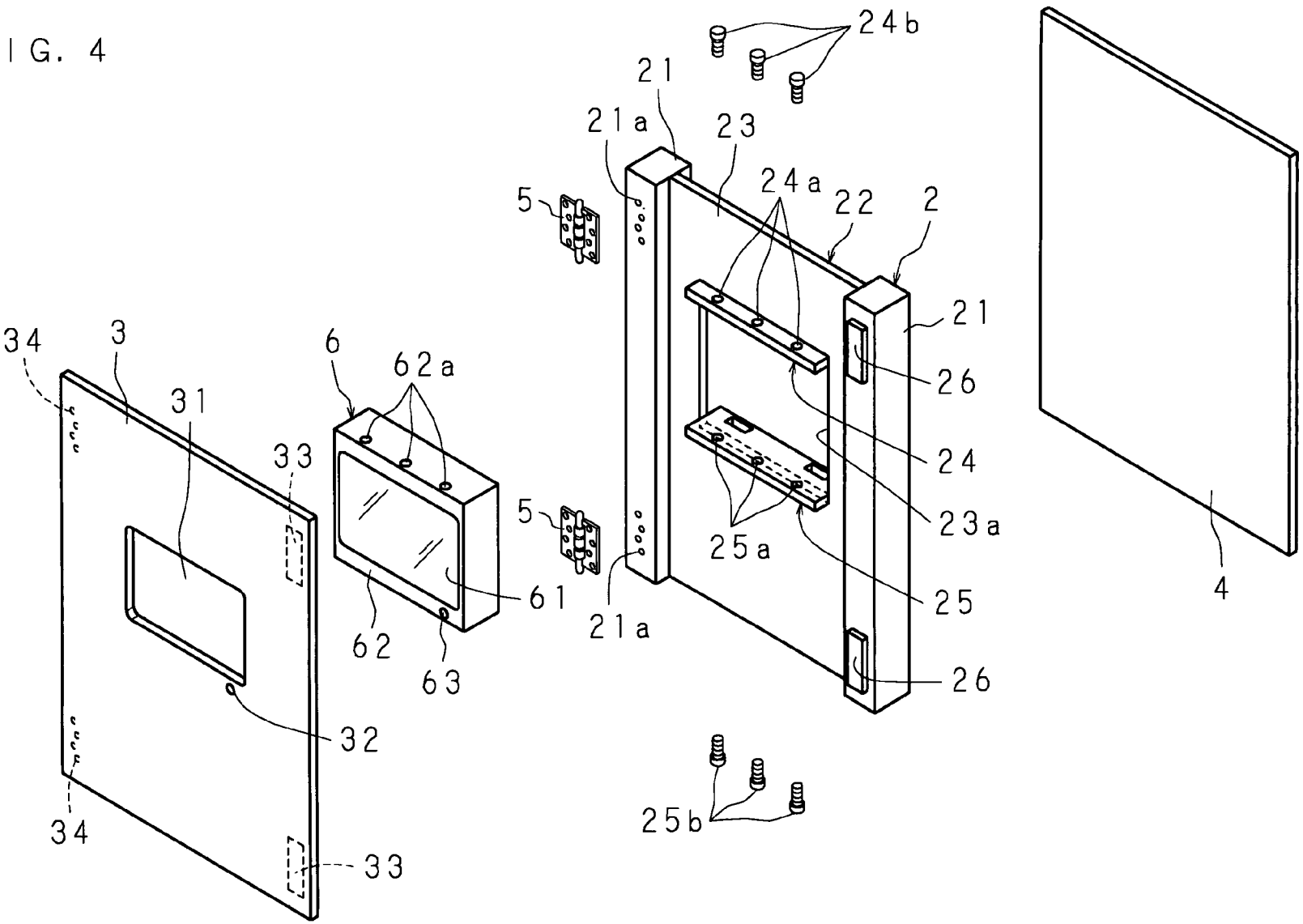
FIG. 4 is an exploded perspective view of an architecture wall assembly.

FIG. 2 is a perspective view schematically showing an architecture wall assembly 1 according to the first embodiment. FIG. 3 is a six-side view diagram of an architecture wall assembly 1. FIG. 4 is an exploded perspective view of the architecture wall assembly 1. The architecture wall assembly 1 comprises: a wall base structure 2; a front base board 3 (a cover plate) for covering the front side of the wall base structure 2 in a manner permitting open and close; a rear base board 4 (a cover plate) for covering the rear side of the wall base structure 2; and a display device 6 held in the inside of the wall. Here, the front side indicates a direction in which the display screen 61 of the display device 6 is exposed.

Figure 5:
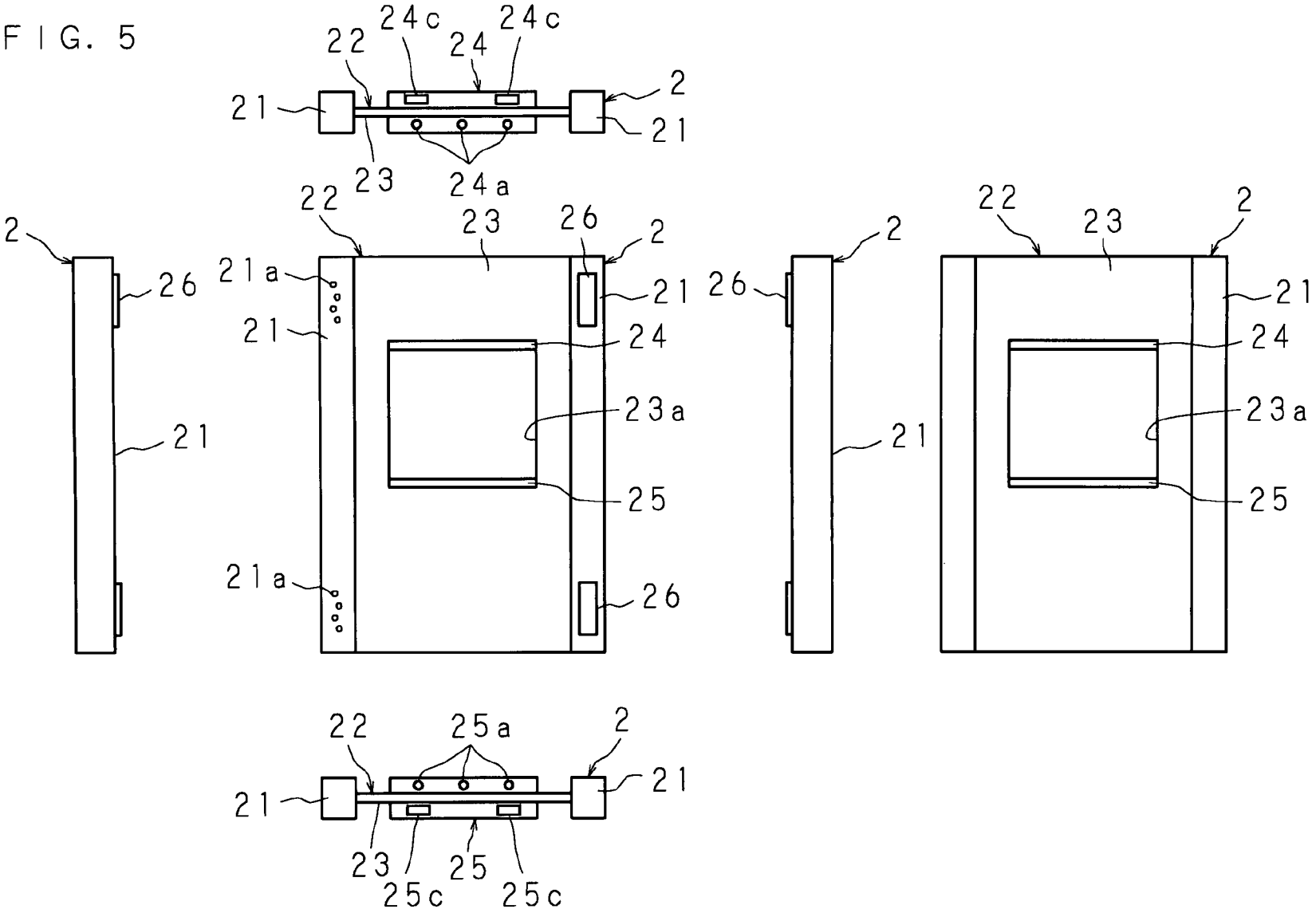
FIG. 5 is a six-side view diagram of a wall base structure.

FIG. 5 is a six-side view diagram of the wall base structure 2. The wall base structure 2 has: a pair of columnar members 21 arranged approximately in parallel to each other in a longitudinal direction; and a holding member 22 that is bridged between the columnar members 21 and that holds the display device 6 in such a manner that the display screen 61 is oriented to the front.

Each of the columnar members 21 has approximately a prism shape, and is composed of a member such as steel and wood capable of supporting a large-size display device 6. In a front upper part and a front lower part of one columnar member 21, screw holes 21*a* are formed that are used for screwing hinges 5 for connecting the front base board 3 (see FIG. 4). In a front upper part and a front lower part of the other columnar member 21, magnets 26 are embedded that are used for magnetically fixing the front base board 3 to the columnar members 21.

The holding member 22 has a plate member 23 the horizontal side portions of which are connected to the columnar members 21 and which extends to the upper and lower ends of the columnar members 21. The plate member 23 is formed from a member such as steel capable of supporting a large-size display device 6. Further, the plate member 23 has a horizontally long rectangular opening 23*a* into which the display device 6 is to be fitted and which is located in an approximately center part in the horizontal direction and in an appropriate part in the up and down directions. In the upper side portion and the lower side portion of the opening 23*a*, clamping members 24 and 25 are provided that clamp from up and down directions the display device 6 fitted in the opening 23*a*. Further, the clamping members 24 and 25 have a flat-plate shape formed in an integrated manner approximately perpendicularly to the plate member 23 in forward and backward directions from the upper side portion and the lower side portion of the opening 23*a*. Further, in each of the clamping members 24 and 25, three screw holes 24*a* and 25*a* aligned in a horizontal direction for fastening the display device 6 are provided at the front side, while air flow holes 24*c* and 25*c* for air cooling of the display device 6 are provided at the rear side.

Figure 6:
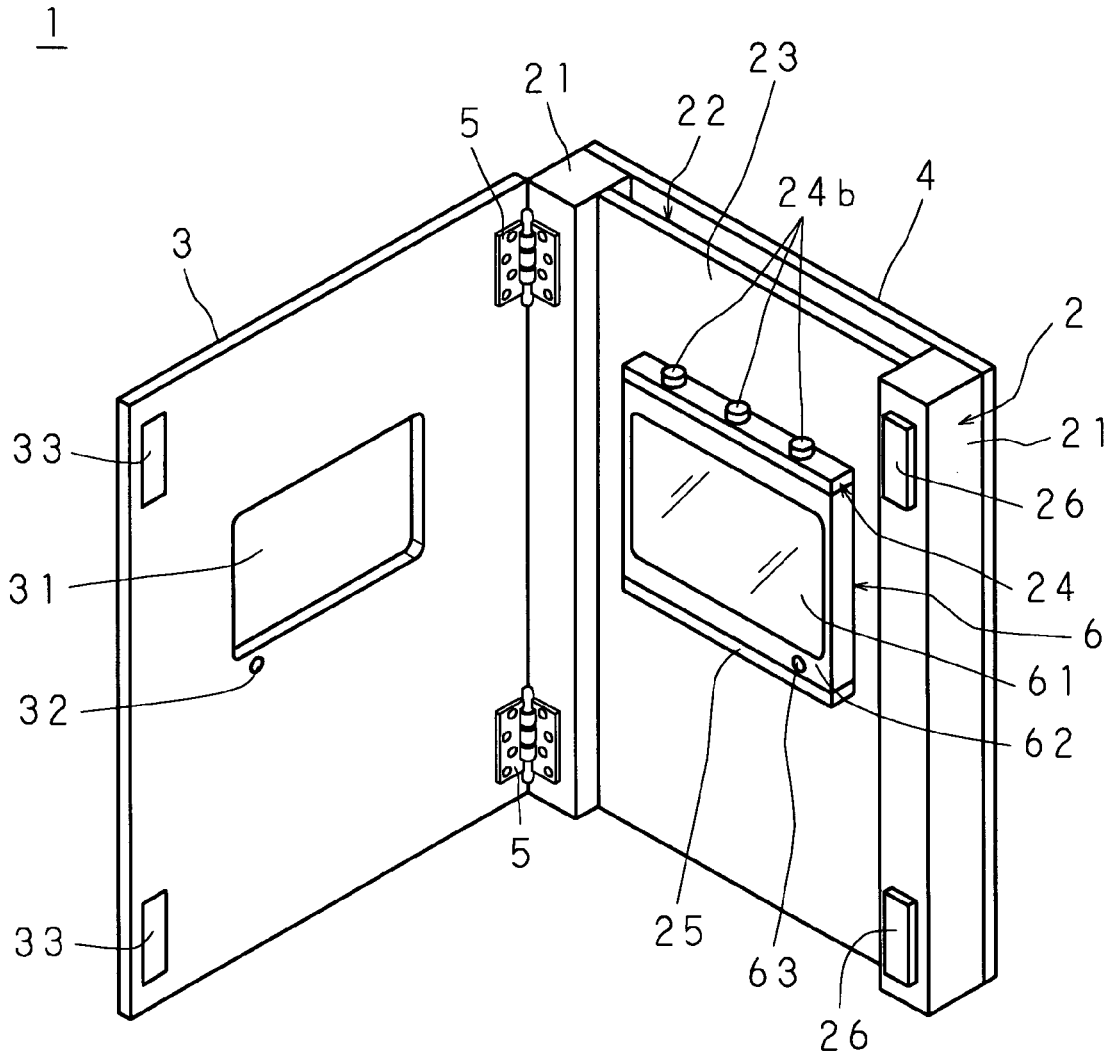
FIG. 6 is a perspective view schematically showing an architecture wall assembly in a state that a front base board is opened.

FIG. 6 is a perspective view schematically showing the architecture wall assembly 1 in a state that the front base board 3 is opened. The front base board 3 is a member that has the shape of a vertically long approximately rectangular plate and covers from the front side the columnar members 21 and the holding member 22. The front base board 3 is composed, for example, of a wooden board, a cement board, a gypsum board, or a steel board. Further, the front base board 3 has a horizontally long rectangular window 31 in front of the display device 6 held by the holding member 22. The window 31 is formed from transparent resin or the like. Further, the front base board 3 is connected to one columnar member 21 by the hinges 5 in a manner permitting open and close. Specifically, one metal piece of each hinge 5 is screwed from the rear side to screw holes 34 provided on one side of the rear side, while the other metal piece of the hinge 5 is screwed to one columnar member 21. Furthermore, in order that the front base board 3 should be fixed magnetically to the other columnar member 21, the front base board 3 has magnets 33 in the upper side portion and the lower side portion on the rear side. Furthermore, in the front base board 3, a remote control signal passing aperture 32 for passing a remote control signal such as an infrared ray for operating the display device 6 by remote control is provided in a lower part of the window 31. The remote control signal passing aperture 32 is formed of resin, silicon, or the like that passes an infrared ray. Here, the remote control signal passing aperture 32 may be a simple opening.

The rear base board 4 is a member that has a vertically long rectangular shape and covers from the rear side the columnar members 21 and the holding member 22. The rear base board 4 is composed, for example, of a wooden board, a cement board, a gypsum board, or a steel board.

The display device 6 is a liquid crystal display, a plasma display, an organic EL display, or the like. In particular, a liquid crystal display comprises: a liquid crystal display module having approximately a rectangular parallelepiped shape and having at the front side a display screen 61 for displaying a video; and a cabinet 62 for covering the periphery part and the rear face side of the liquid crystal display module. The liquid crystal display module has: a liquid crystal display panel; a back light section of area light type for illuminating the liquid crystal display panel from the rear side; and an optical sheet inserted between the back light section and the liquid crystal display panel. The cabinet 62 is constructed from: a front cabinet for covering the periphery part of the liquid crystal display module; and a rear cabinet for covering the rear face side of the liquid crystal display module. In an appropriate portion in the lower part of the front cabinet, a remote control signal receiving section 63 is provided for receiving a remote control signal. The rear cabinet has an upper face part and a lower face part that have a plate shape and are in surface contact with the clamping members 24 and 25. In the upper face part and the lower face part, three screw holes 62*a* for fastening the display device 6 to the clamping members 24 and 25 in such a manner that the display screen 61 is located rearward relative to the front base board 3 are aligned in a horizontal direction.

Figures 7A, 7B:
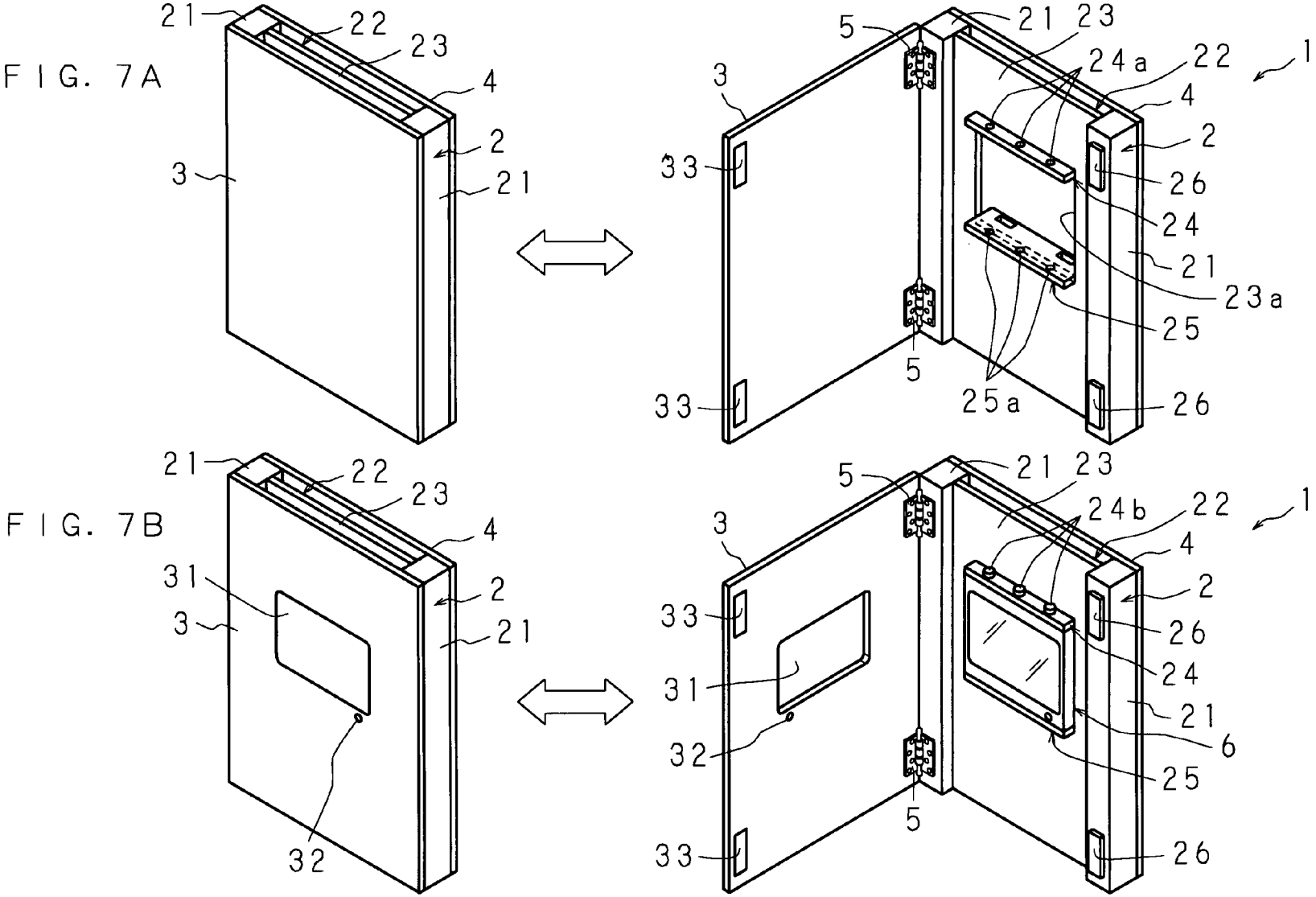
FIGS. 7A and 7B are perspective views schematically showing an architecture wall assembly before and after a display device is held inside the wall.

Next, a method of use of the architecture wall assembly 1 is described below. FIGS. 7A and 7B are perspective views schematically showing an architecture wall assembly before and after a display device 6 is held inside the wall. FIG. 7A shows the architecture wall assembly 1 before the display device 6 is held inside the wall. Thus, the window 31 is not formed in the front base board 3. FIG. 7B shows the architecture wall assembly 1 after the is display device 6 is held inside the wall. A user or a construction worker opens the front base board 3 of the architecture wall assembly 1, then clamps the display device 6 between the clamping members 24 and 25, then fastens the display device 6 between the clamping members 24 and 25 with screws 24*b* and 25*b*, and then closes the front base board 3. As a result, the display device 6 is held inside the wall.

Figure 8:
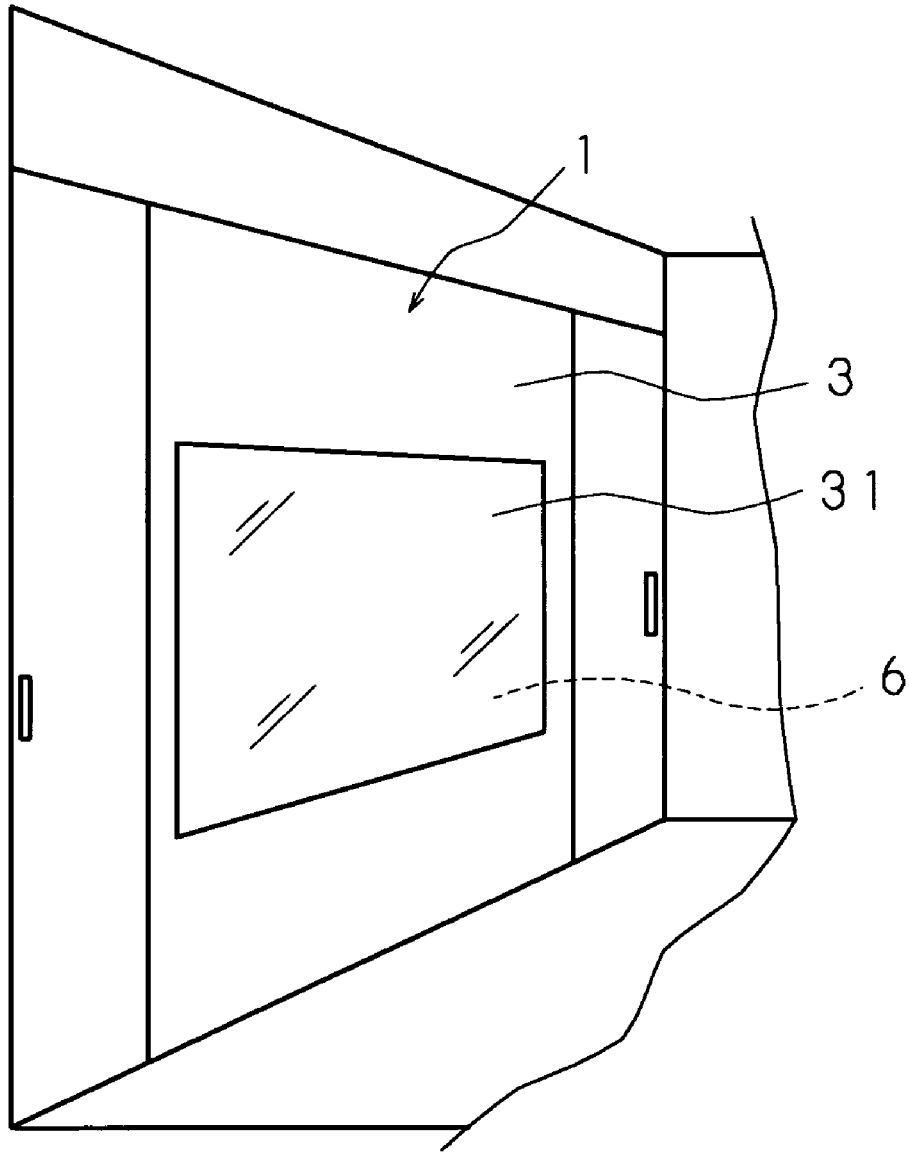
FIG. 8 is a schematic diagram showing an example of an architecture that employs an architecture wall assembly according to the first embodiment.

FIG. 8 is a schematic diagram showing an example of an architecture that employs the architecture wall assembly 1. This architecture employs the architecture wall assembly 1 as a partition wall.

In the architecture wall assembly 1 having this configuration, an architecture wall assembly 1 of display device 6 integrated type is constructed so that the problems of the arrangement place and the falling and dropping of an AV device is resolved at once. Further, the holding member 22 holds the display device 6 in a state that the display device 6 is fitted in the opening 23*a* formed in the plate member 23 bridged between the columnar members 21. Thus, the weight of the display device 6 is transferred to the basement, the beam, and the like in the lower part of the architecture wall assembly 1. Accordingly, even a large-size display device 6 can be held.

Further, the upper face and the lower face of the display device 6 are clamped by the clamping members 24 and 25 having a flat-plate shape. In addition, the display device 6 is fastened to the clamping members 24 and 25 by the screws 24*b* and 25*b*. This effectively avoids that the display device 6 falls or drops from the holding member 22. Furthermore, the holding member 22 has a plate shape extending to the upper and lower ends of the columnar members 21, while the two sides are connected to the individual columnar members 21. This effectively avoids that the holding member 22 falls together with the display device 6.

Further, the front base board 3 is connected to the columnar members 21 by the hinges 5 in a manner permitting open and close. Thus, when necessary, the user may open the front base board 3 like a door and then perform maintenance and inspection of the display device 6. Further, the display device 6 may even be changed. Furthermore, a display device 6 may even be attached afterward to an architecture wall assembly 1 in which a display device 6 is not yet attached. Further, the front base board 3 and the columnar members 21 may be fixed magnetically to each other. Thus, this locking mechanism is realized by a remarkably simple configuration.

Further, the screws that fasten the display device 6 to the holding member 22 are provided on the front side of the architecture wall assembly 1. Thus, the user can perform attachment, maintenance, inspection, or the like of the display device 6 from the front side where the front base board 3 can be opened. Further, the front base board 3 and the rear base board 4 are composed of common gypsum boards. Thus, the wall surfaces can be fabricated at a low cost.

Here, the front base board is constructed in a manner permitting open and close. In contrast, the front base board may be constructed simply in a manner permitting attachment and detachment. For example, magnets may be provided on the two sides of the rear side of the front base board, and magnets may be provided in the front faces of the two columnar members. Further, the above-mentioned description has been given for an exemplary case that the front base board or the rear base board is constructed separately from the holding member. However, the front base board or the rear base board may be formed in an integrated manner with the holding member by using synthetic resin or the like.

(Modification 1)

Figure 9:
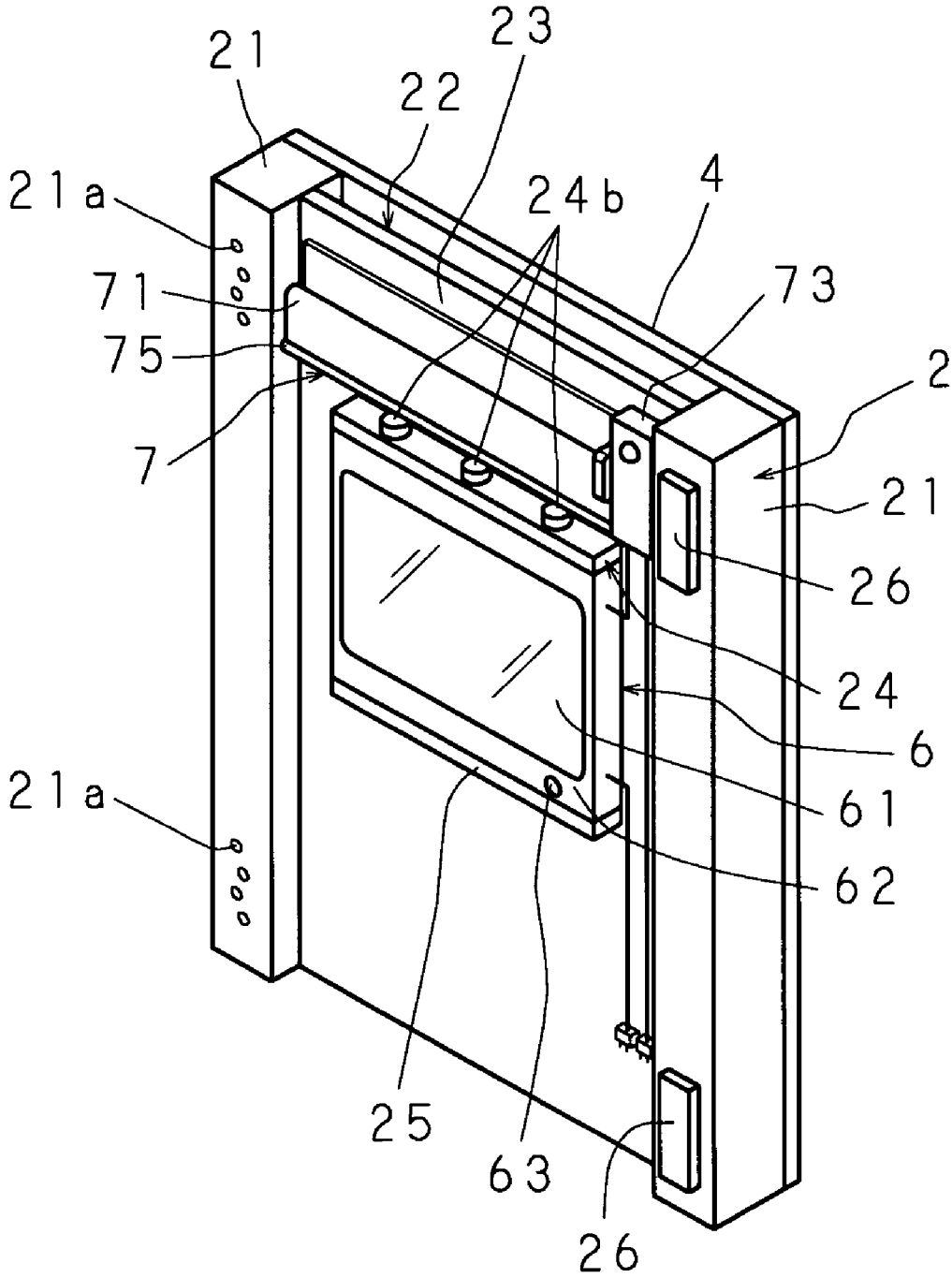
FIG. 9 is a perspective view schematically showing an architecture wall assembly according to Modification 1 in a state that a front base board is removed.
Figure 10:
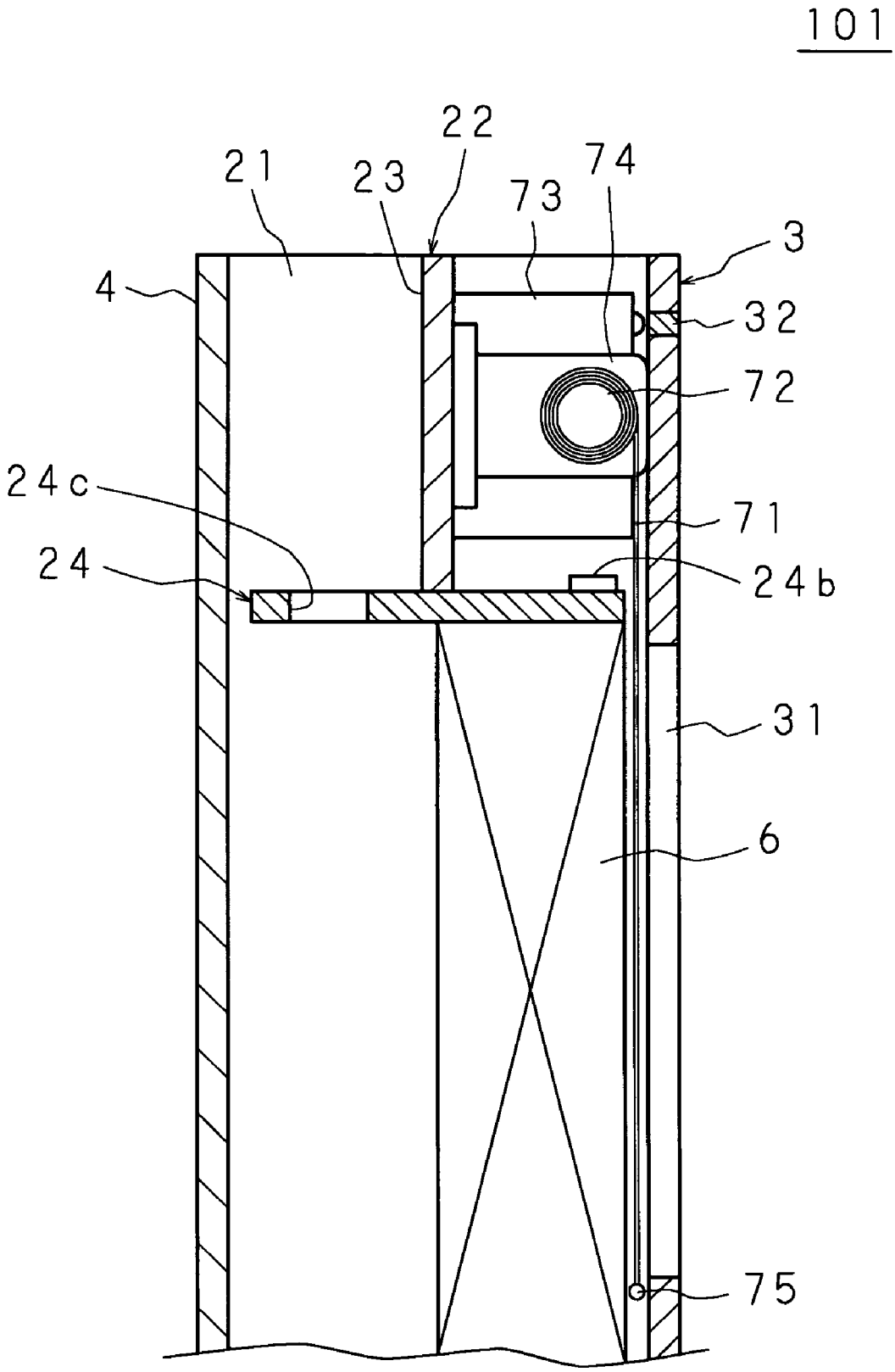
FIG. 10 is a sectional side view schematically showing the main part of an architecture wall assembly according to Modification 1.

FIG. 9 is a perspective view schematically showing an architecture wall assembly 101 according to Modification 1 in a state that a front base board 3 is removed. FIG. 10 is a sectional side view schematically showing the main part of the architecture wall assembly 101 according to Modification 1. The architecture wall assembly 101 according to Modification 1 has shield means 7 for shielding the window 31 in a manner permitting open and close.

The shield means 7 is provided on the upper front side of the plate member 23 that constitutes the holding member 22. The shield means 7 comprises: a shielding member 71 having a vertically long rectangle sheet shape and covering the display screen 61 of the display device 6; a wait bar 75 provided on one shorter side of the shielding member 71; a winding shaft 72 to which the other shorter side of the shielding member 71 is fixed and which winds up the shielding member 71; and a support 74 which protrudes forward from the two sides in the horizontal direction on the upper front side of the plate member 23 and which supports the winding shaft 72 in such a manner that its longitudinal direction is oriented in the horizontal direction. On the horizontal outer side of the support 74, a driving section 73 is provided that has a motor for rotating the winding shaft 72. The driving section 73 has at the front face side a light receiving section for receiving a remote control signal. Then, in response to a received remote control signal, the driving section 73 revolves the winding shaft 72 so as to wind up or down the shielding member 71. On the front side of the light receiving section of the front base board 3, the remote control signal passing aperture 32 is provided.

Figure 11:
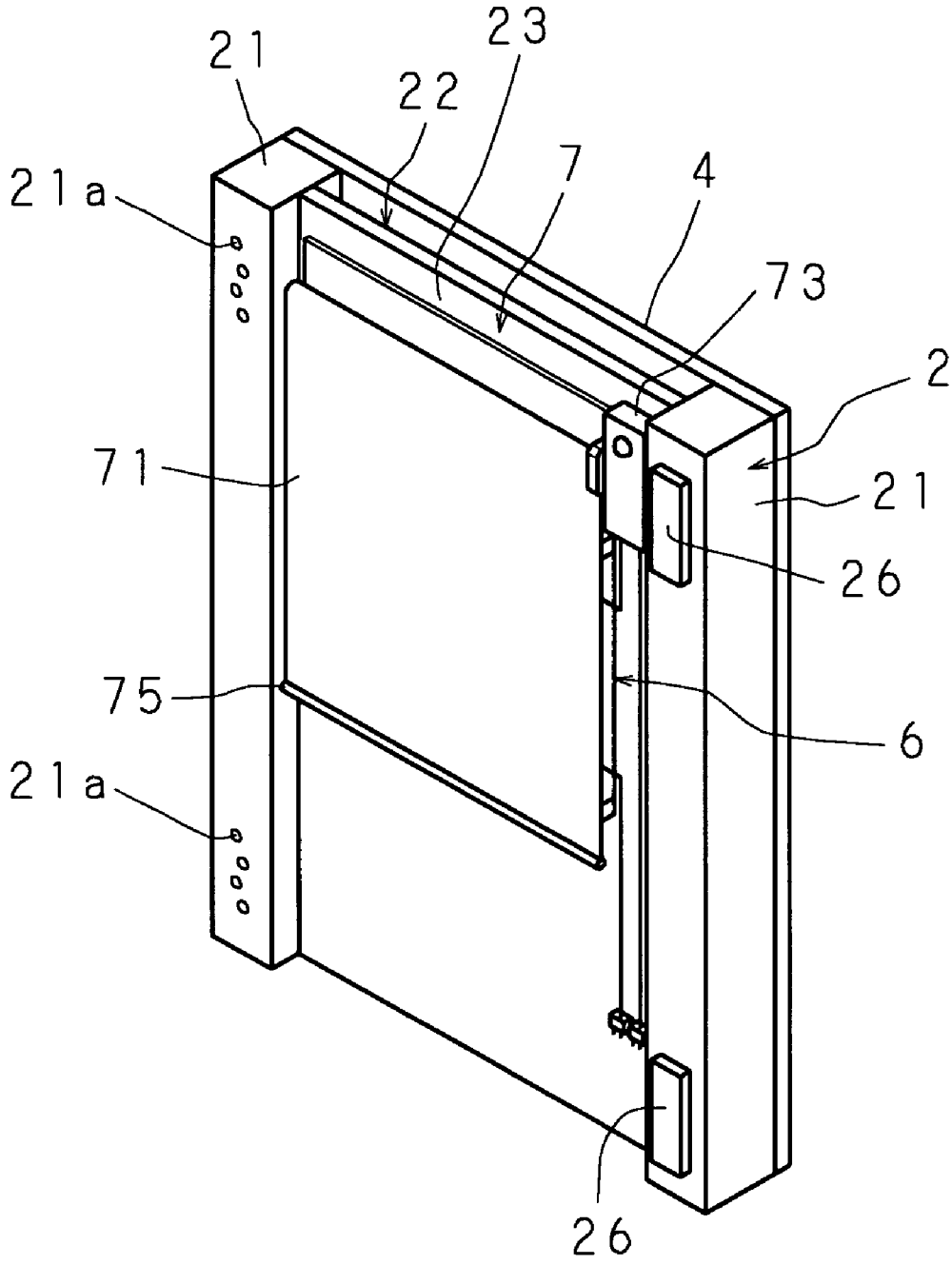
FIG. 11 is a perspective view schematically showing a state that a shielding member covers a display screen and a window.
Figure 12B:
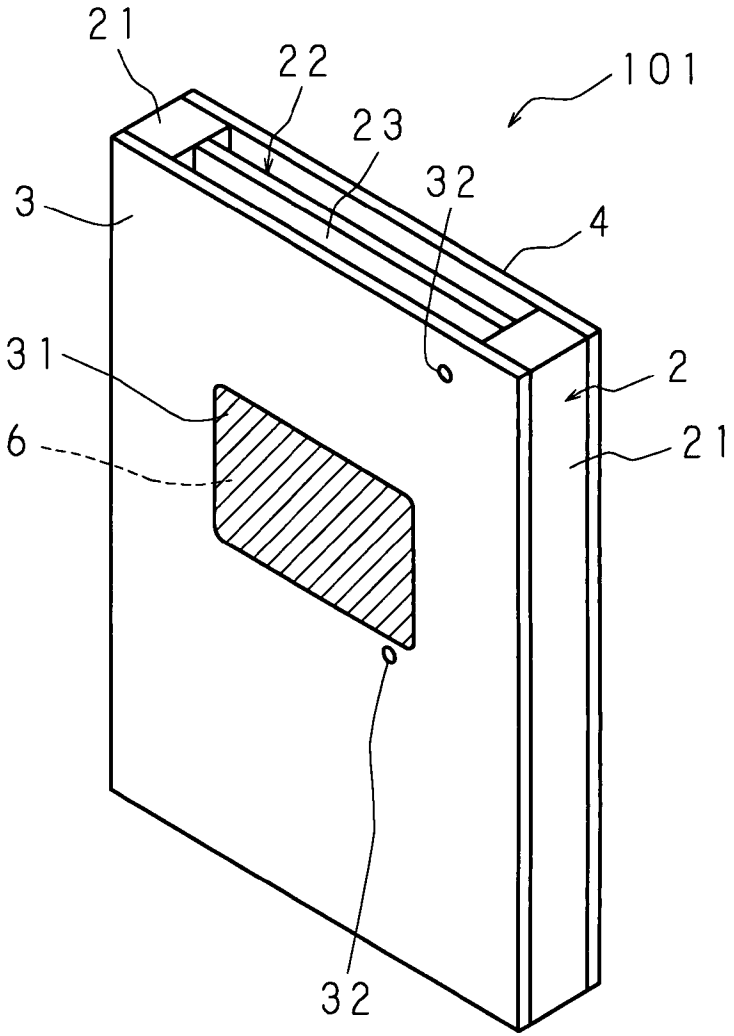
FIGS. 12A and 12B are perspective views schematically showing a state that a window is opened and closed by a shielding member.
Figure 12A:
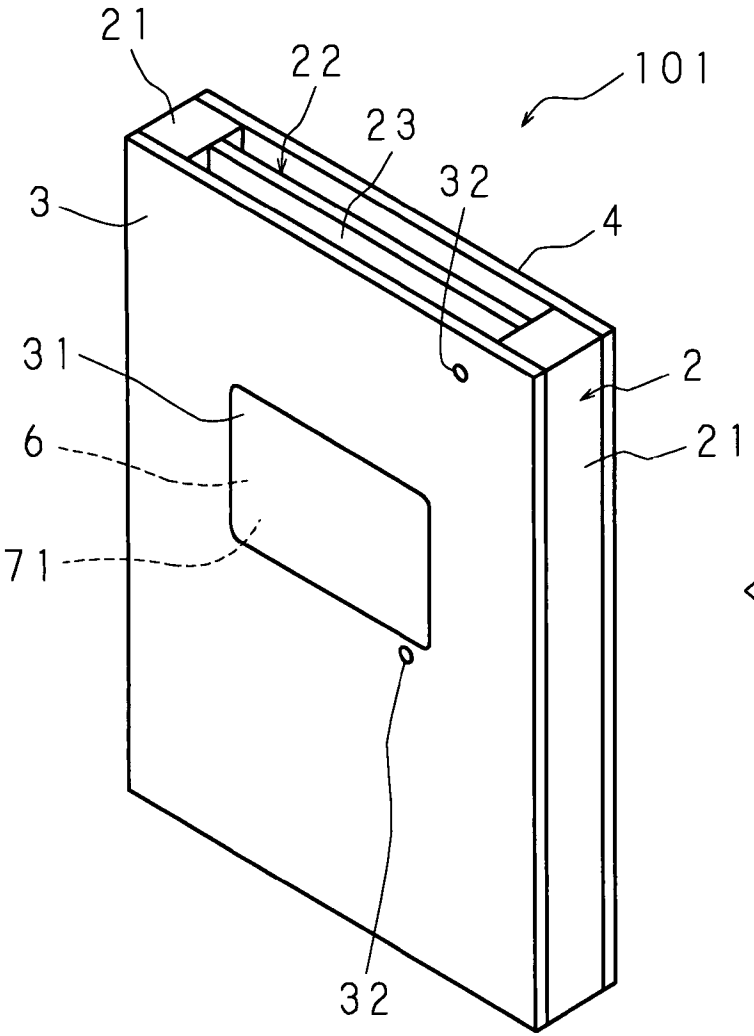

FIG. 11 is a perspective view schematically showing a state that the shielding member 71 covers the display screen 61 and the window 31. FIGS. 12A and 12B are perspective views schematically showing a state that the window 31 is opened and closed by the shielding member 71. FIG. 12A shows a state that the shielding member 71 is wound down so that the window 31 is shielded. When the window 31 is shielded, the display screen 61 of the display device 6 is also hidden. FIG. 12B shows a state that the shielding member 71 is wound up so that the window 31 is opened. When the window 31 is opened, the display screen 61 of the display device 6 is exposed so that the user can use the display device 6.

In the architecture wall assembly 101 and the architecture according to Modification 1 having this configuration, when the sheet-shaped shielding member 71 is wound up by the winding shaft 72, the window 31 is opened. Further, when the shielding member 71 is wound down by the winding shaft 72, the window 31 is shielded. Thus, the display device 6 can be exposed through or hidden behind the window 31 depending on the necessity. Further, the winding shaft 72 can be rotated electrically so that the window 31 can be opened and closed. Here, it is preferable that the shielding member 71 has approximately the same color and pattern as those of the finishing material of the front base board 3.

(Modification 2)

Figure 13:
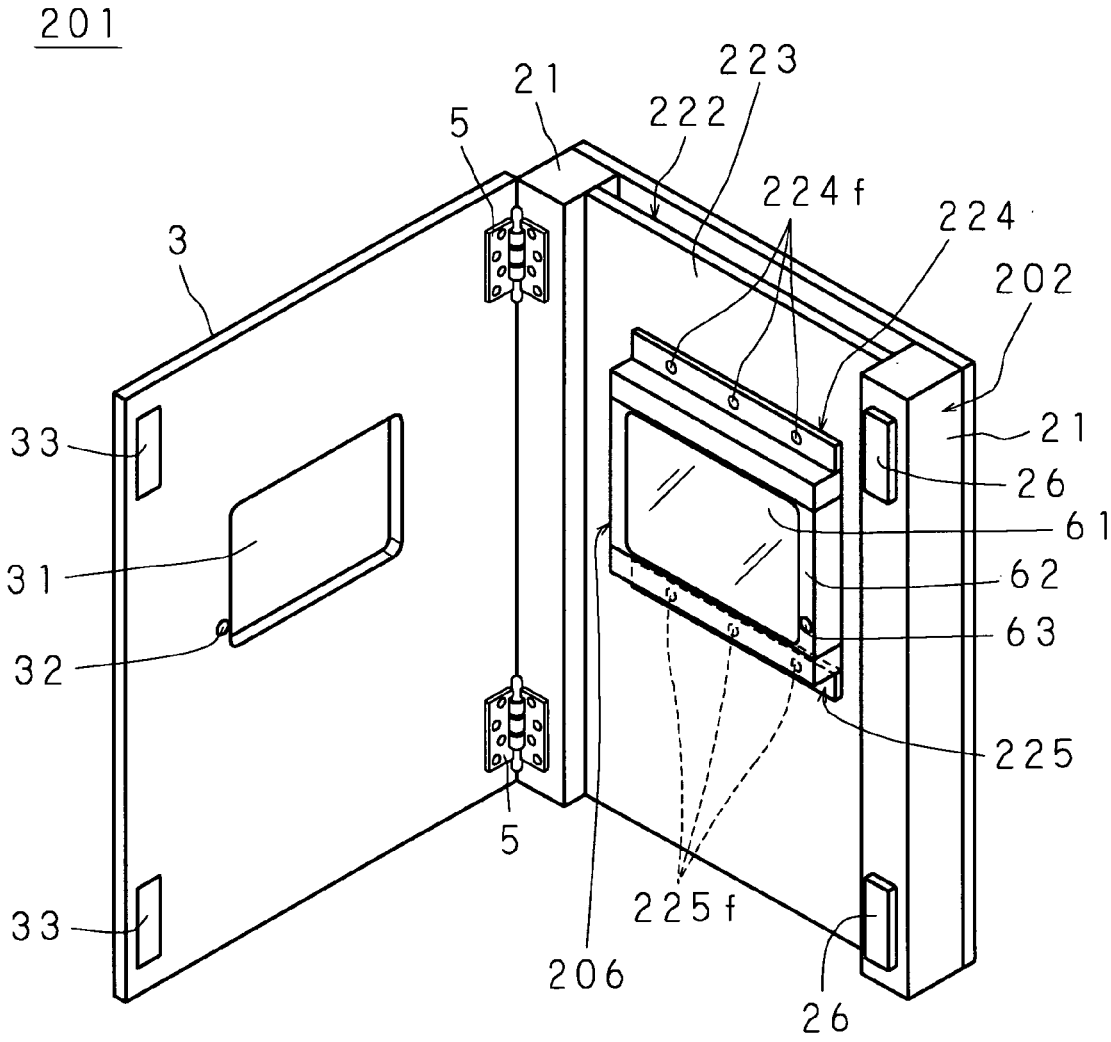
FIG. 13 is a perspective view schematically showing an architecture wall assembly according to Modification 2 in a state that a front base board is opened.
Figure 14:
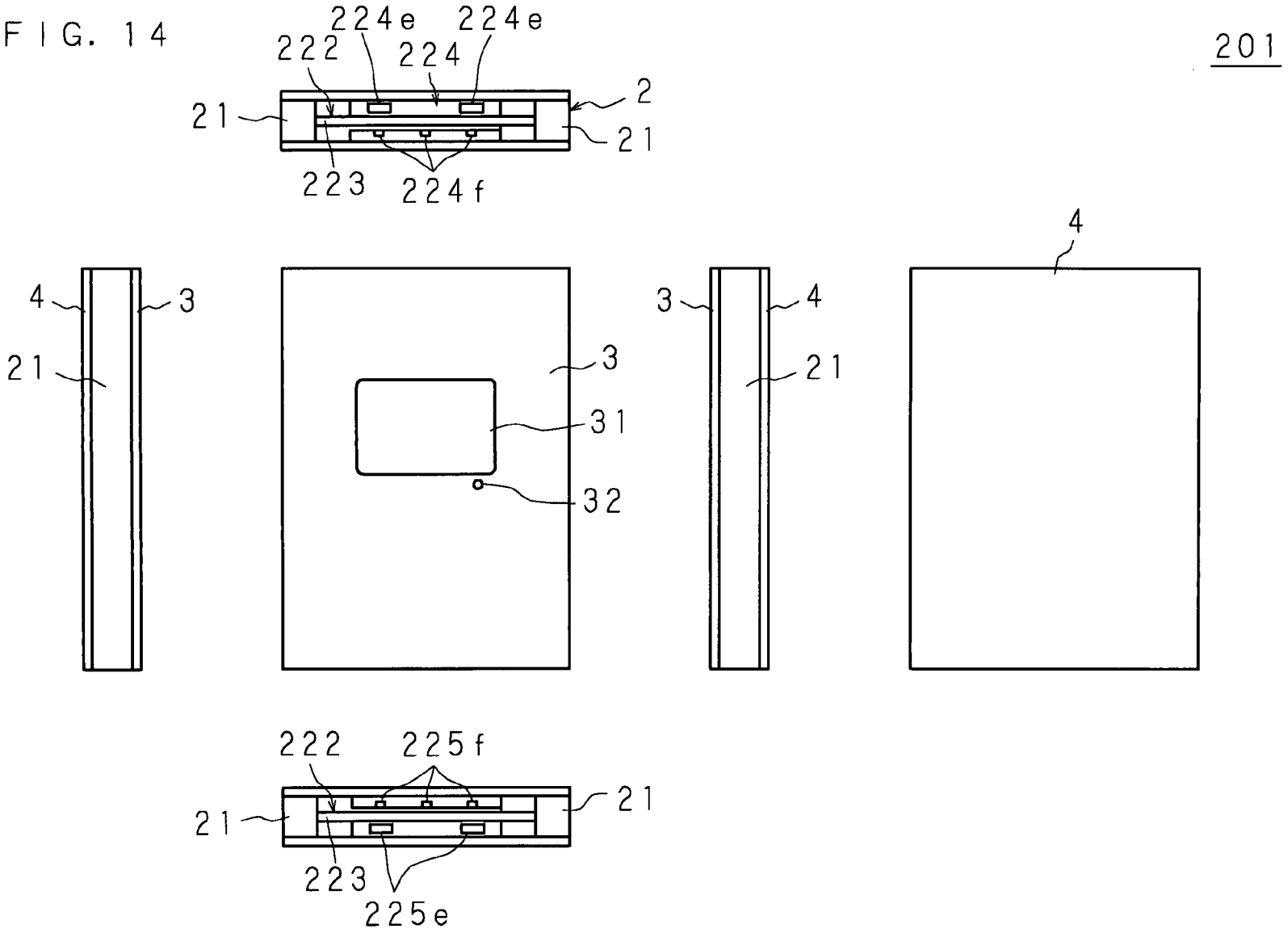
FIG. 14 is a six-side view diagram of an architecture wall assembly according to Modification 2.
Figure 15:
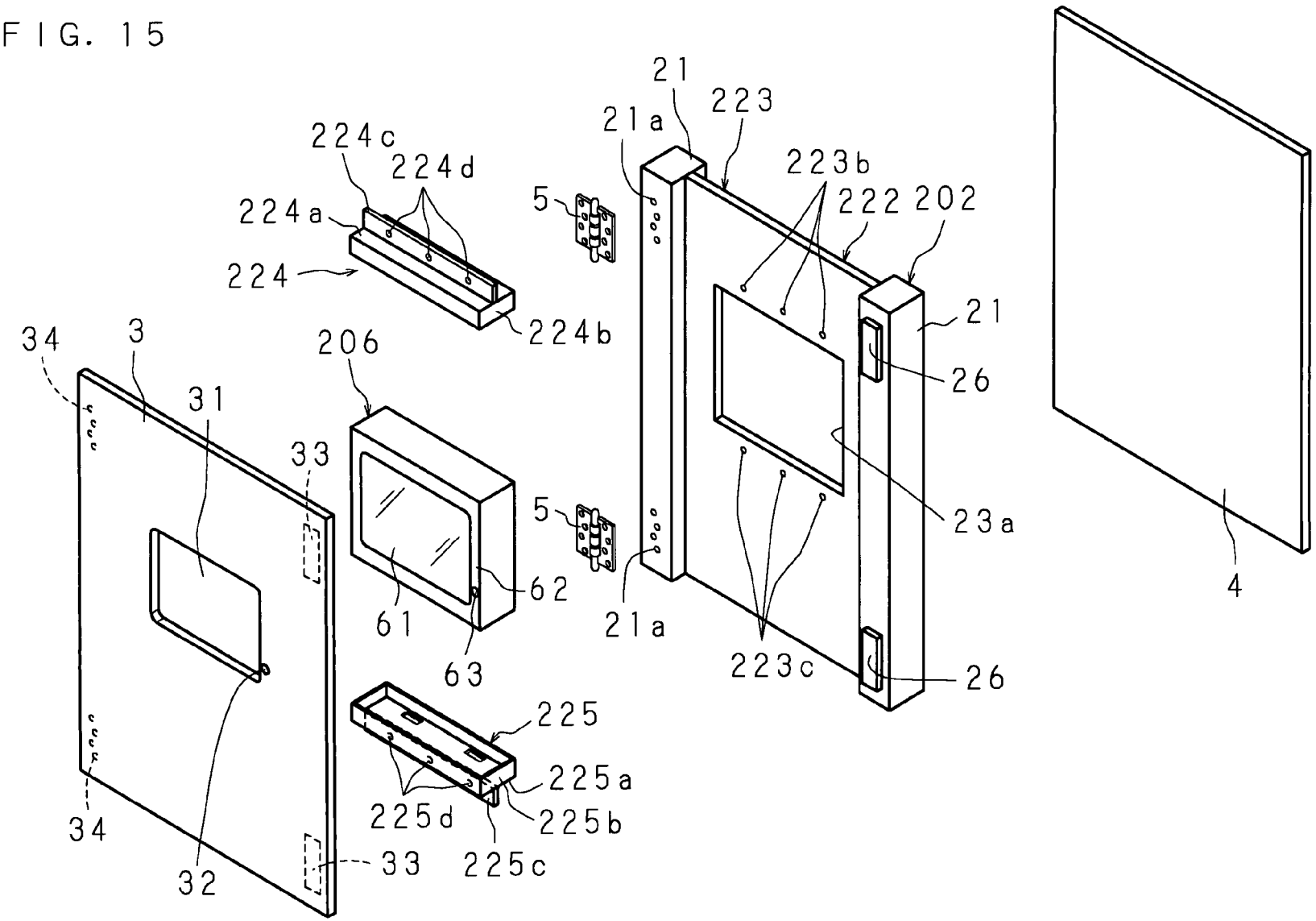
FIG. 15 is an exploded perspective view schematically showing an architecture wall assembly according to Modification 2.

FIG. 13 is a perspective view schematically showing an architecture wall assembly 201 according to Modification 2 in a state that a front base board 3 is opened. FIG. 14 is a six-side view diagram of the architecture wall assembly 201 according to Modification 2. FIG. 15 is an exploded perspective view schematically showing the architecture wall assembly 201 according to Modification 2. The architecture wall assembly 201 according to Modification 2 is constructed such that an existing display device 206 for indoor installation can be held inside the wall.

In the holding member 222 of the wall base structure 202 according to Modification 2 has a plate member 223 the horizontal side portions of which are connected to the columnar members 21 and which extends to the upper and lower ends of the columnar members 21. Further, a rectangular opening 23*a* into which a display device 206 is to be fitted is provided in an approximately center part in the horizontal direction and in an appropriate part in the up and down directions. In each of the upper side portion and the lower side portion of the opening 23*a*, three screw holes 223*b* and 223*c* are aligned in a horizontal direction. Then, clamping members 224 and 225 are screwed from the front side to the upper side portion and the lower side portion by screws 224*f* and 225*f*.

Figure 16:
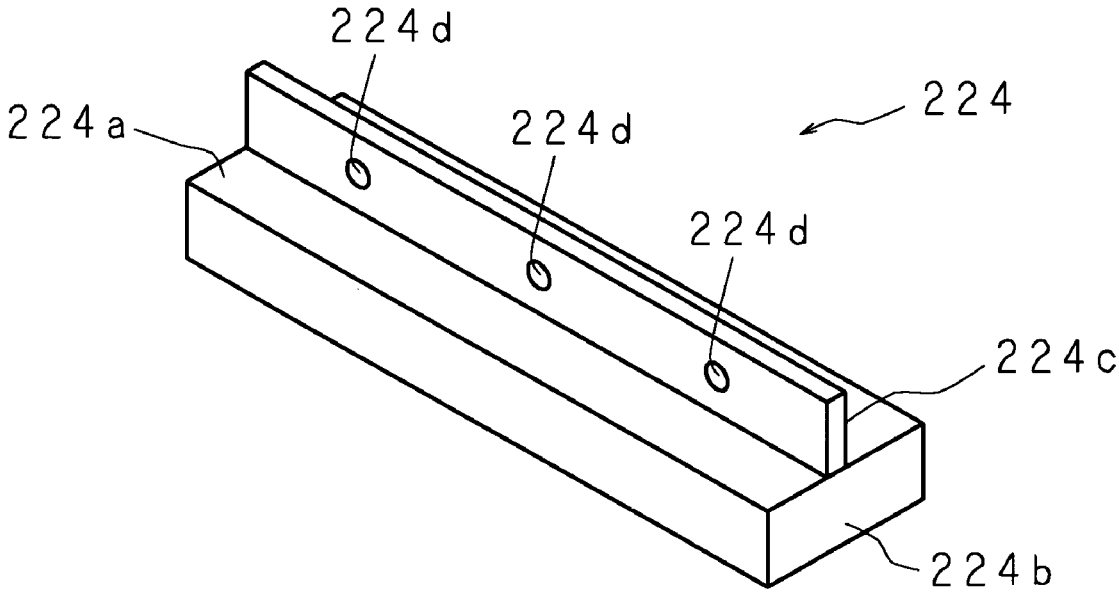
FIG. 16 is a perspective view schematically showing a clamping member according to Modification 2.
Figure 17:
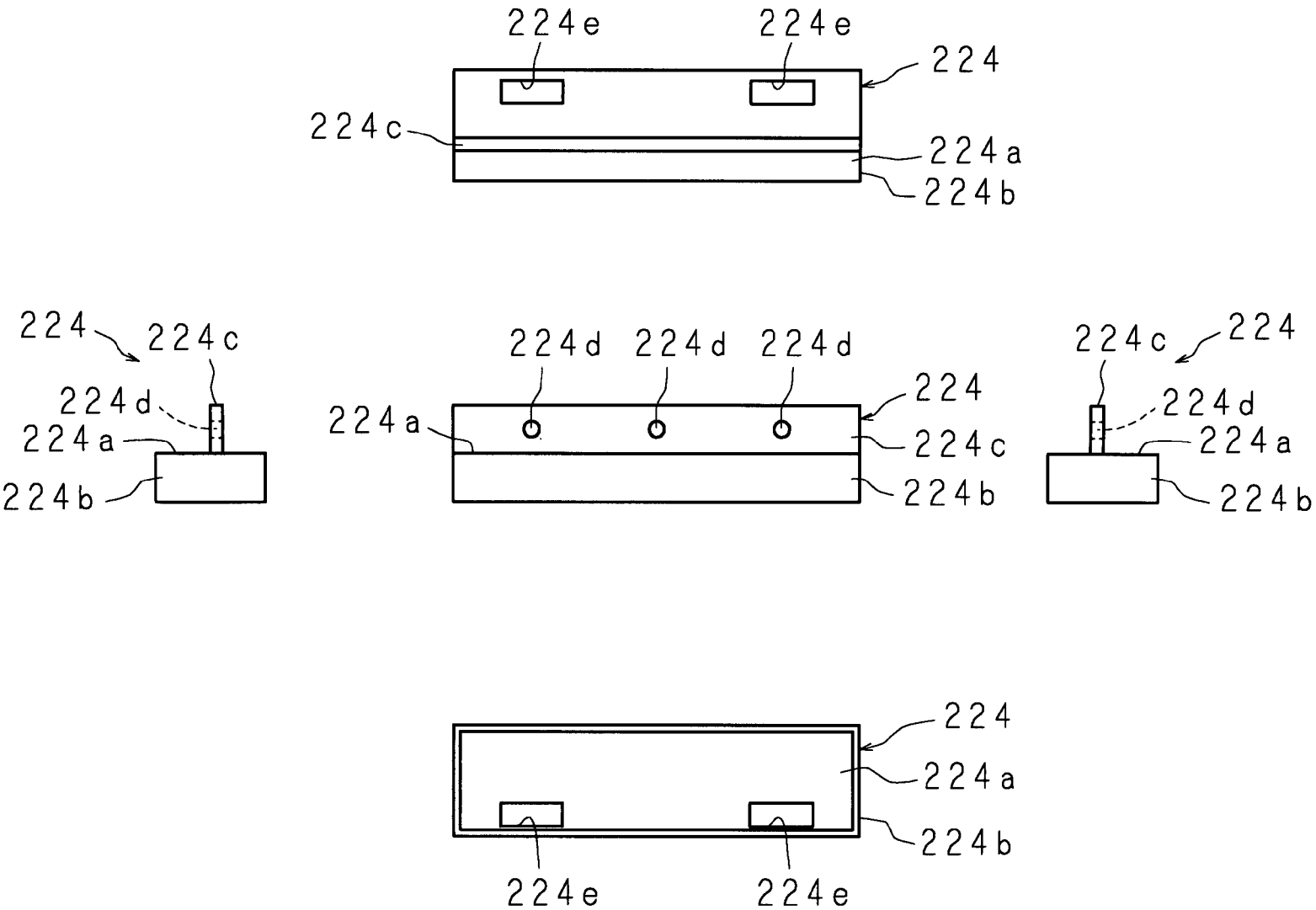
FIG. 17 is a six-side view diagram of a clamping member according to Modification 2.

FIG. 16 is a perspective view schematically showing a clamping member 224 according to Modification 2. FIG. 17 is a six-side view diagram of a clamping member 224 according to Modification 2. Here, since the rear view is similar to the front view, the rear view is omitted. The clamping member 224 includes: a transversely extending rectangular plate 224*a* having a sufficient size for covering the upper part of the display device 206; and a side wall plate 224*b* provided downward from the periphery of the transversely extending rectangular plate 224*a*. Thus, the clamping member 224 have the shape of a shallow dish that covers the upper part of the display device 206. The horizontal dimension of the transversely extending rectangular plate 224*a* is approximately the same as those of the opening 23*a* and the display device 206. On the outer side of the transversely extending rectangular plate 224*a*, a mounted piece 224*c* is formed in an approximately perpendicular direction. The mounted piece 224*c* is located approximately in the center part in the forward and backward directions of the transversely extending rectangular plate 224*a*, and extends to the horizontal ends. Further, in the mounted piece 224*c*, three screw holes 224*d* are formed in alignment with each other in a horizontal direction. The mounted piece 224*c* is screwed from the front face side onto the plate member 223. Further, on the rear side of the transversely extending rectangular plate 224*a*, a ventilation hole 224*e* is formed for air cooling of the display device 206. The configuration of the clamping member 225 is similar to that of the clamping member 224. That is, the clamping member 225 has a transversely extending rectangular plate 225*a*, a side wall plate 225*b*, a mounted piece 225*c*, screw holes 225*d*, and a ventilation hole 225*e*, and is screwed from the front face side onto the plate member 223.

In the architecture wall assembly 201 according to Modification 2, the display device 206 can be held by the holding member 222 in the inside of the wall regardless of the shape of the display device 206. Here, the shielding member 71 may manually be wound up and down.

(Modification 3)

Figure 18:
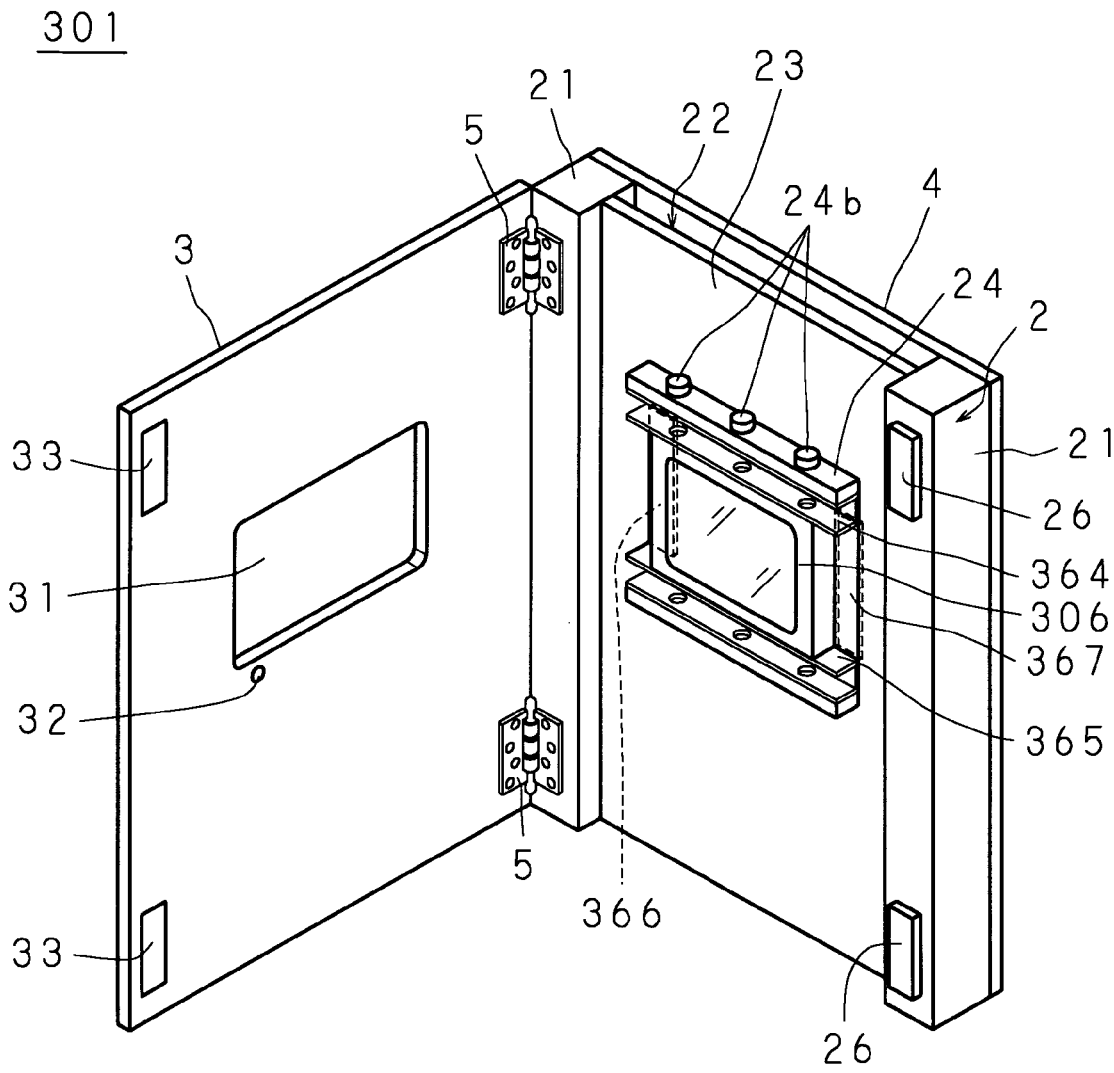
FIG. 18 is a perspective view schematically showing an architecture wall assembly according to Modification 3 in a state that a front base board is opened.
Figure 19:
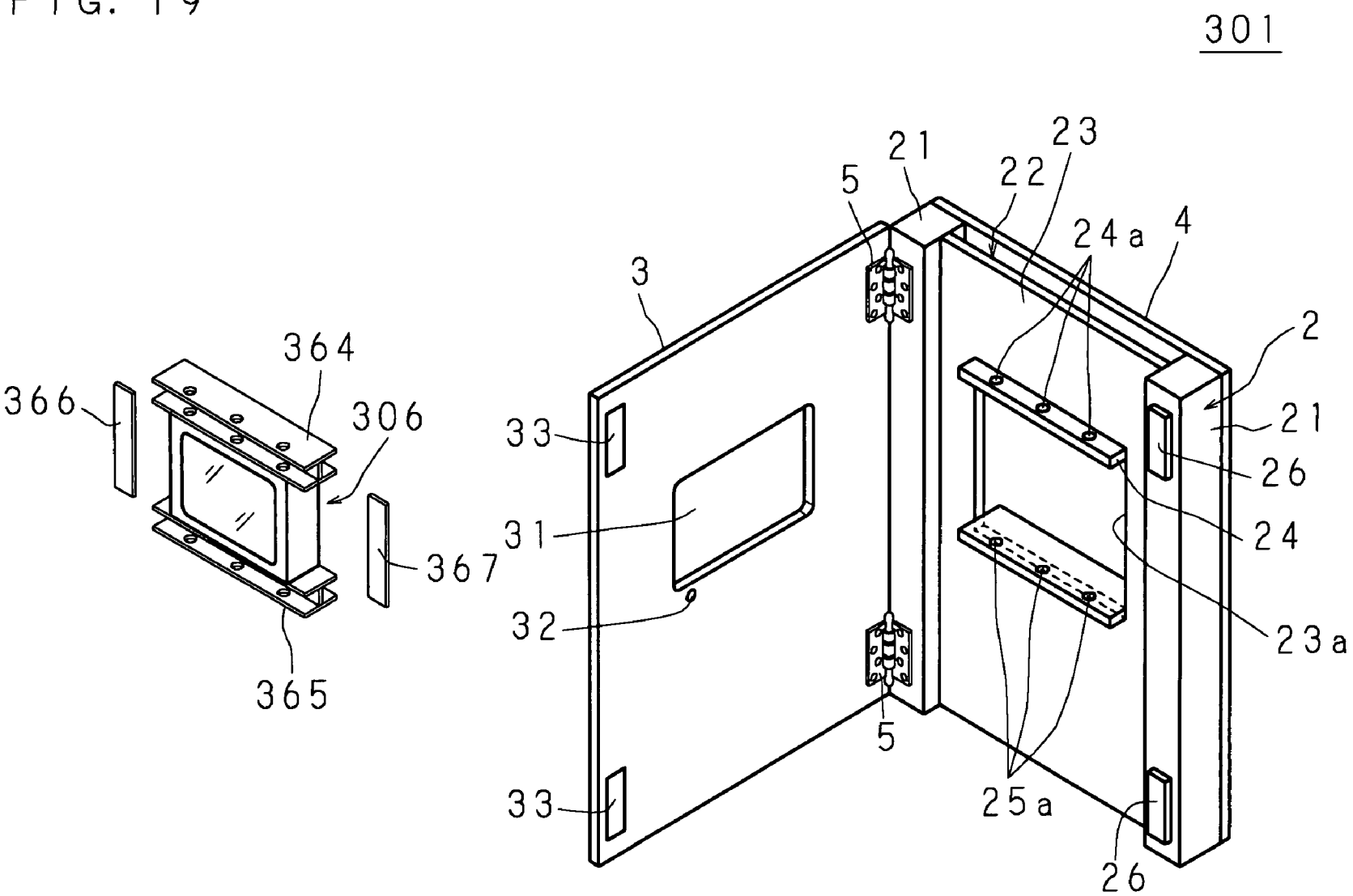
FIG. 19 is a perspective view schematically showing an architecture wall assembly according to Modification 3 in a state that a display device is removed.

FIG. 18 is a perspective view schematically showing an architecture wall assembly 301 according to Modification 3 in a state that a front base board 3 is opened. FIG. 19 is a perspective view schematically showing the architecture wall assembly 301 according to Modification 3 in a state that a display device 306 is removed. The architecture wall assembly 301 according to Modification 3 can hold inside the wall a display device 306 having a size smaller than the opening 23*a*.

The architecture wall assembly 301 according to Modification 3 has spacer members 364 and 365 such as H-beams for adjusting the distance between the display device 306 and the clamping members 24 and 25. The spacer member 364 has: a fastening plate to be fastened to the clamping member 24; a fastening plate to be fastened to the upper face part of the display device 306; and a connection plate for linking the individual fastening plates. The spacer member 365 has a similar configuration and has: a fastening plate to be fastened to the clamping member 25; a fastening plate to be fastened to the lower face part of the display device 306; and a connection plate for linking the individual fastening plates.

Further, the architecture wall assembly 301 according to Modification 3 has blocking plates 366 and 367 for blocking gaps generated on the two sides of the opening 23*a* in the horizontal direction. The blocking plates 366 and 367 are fixed to the plate member 23 in a state of blocking the gaps in the opening 23*a*.

In the architecture wall assembly 301 according to Modification 3, a display device 306 having a size smaller than the opening 23*a* can be held inside the wall. Further, when the spacer members 364 and 365 are removed, a display device 306 having approximately the same size as the opening 23*a* can be held inside the wall. Here, other spacer members may be prepared so that a display device 306 having a diverse size may be held inside the wall.

(Modification 4)

Figure 20:
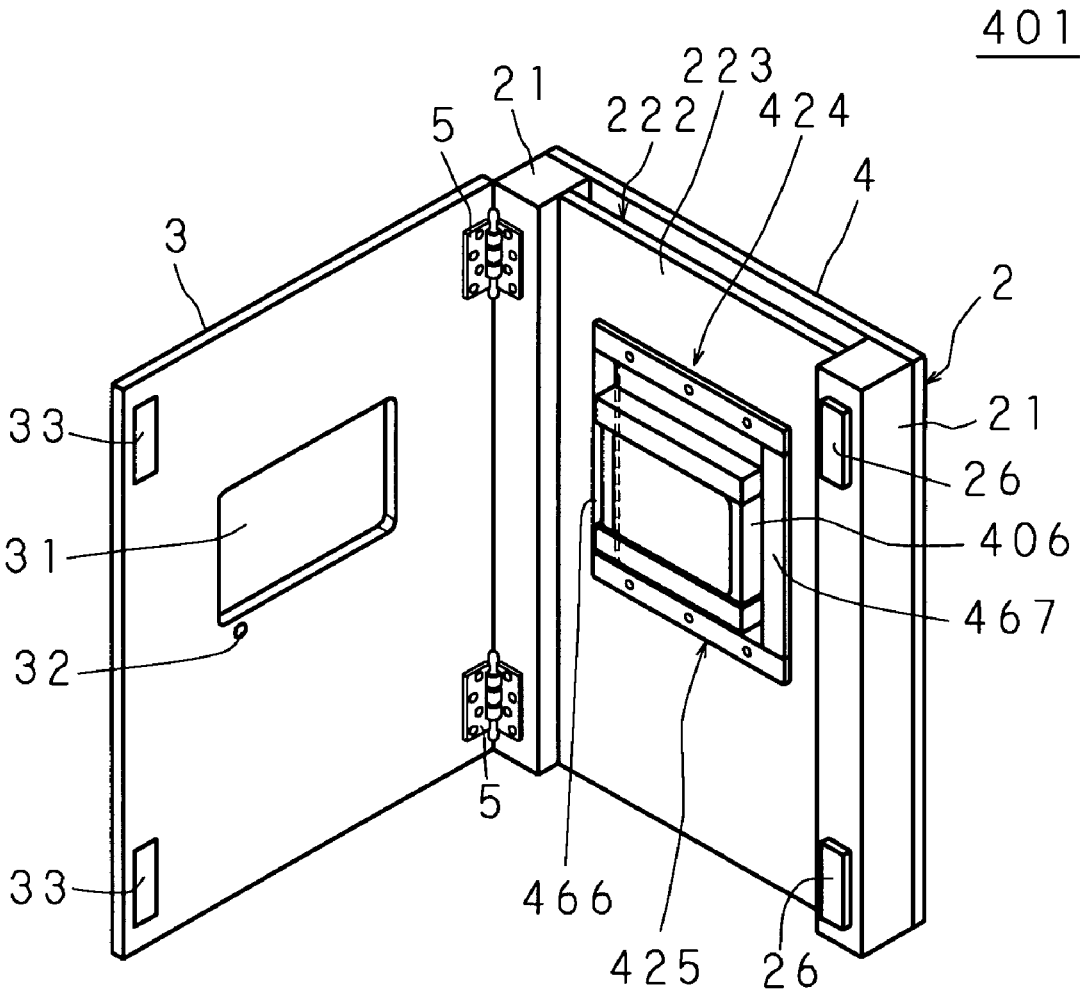
FIG. 20 is a perspective view schematically showing an architecture wall assembly according to Modification 4 in a state that a front base board is opened.
Figure 21:
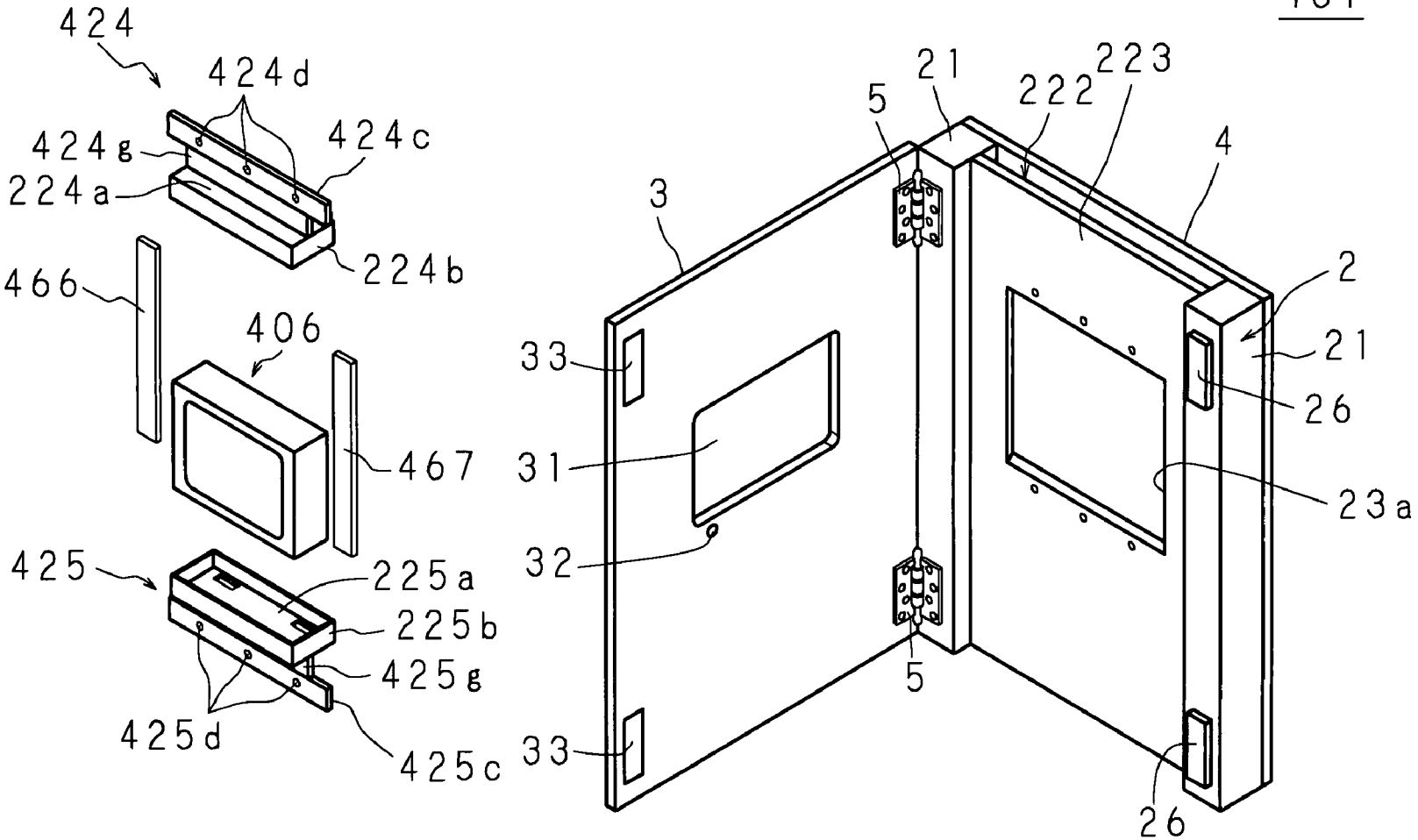
FIG. 21 is a perspective view schematically showing an architecture wall assembly according to Modification 4 in a state that a display device is removed.

FIG. 20 is a perspective view schematically showing an architecture wall assembly 401 according to Modification 4 in a state that a front base board 3 is opened. FIG. 21 is a perspective view schematically showing the architecture wall assembly 401 according to Modification 4 in a state that a display device 406 is removed. The architecture wall assembly 401 according to Modification 4 can hold inside the wall a display device 406 having a size smaller than the opening 23*a*. Similarly to Modification 2, the architecture wall assembly 401 according to Modification 4 has: a plate member 223 that constitutes a holding member 222; and clamping members 424 and 425.

The clamping member 424 includes: a transversely extending rectangular plate 224*a* having a sufficient size for covering the upper part of the display device 406; and a side wall plate 224*b* provided downward from the periphery of the transversely extending rectangular plate 224*a*. Thus, the clamping member 224 has the shape of a shallow dish that covers the upper part of the display device 406. The horizontal dimension of the transversely extending rectangular plate 224*a* is smaller than the opening 23*a*, and is approximately the same as the display device 406. On the outer side of the transversely extending rectangular plate 224*a*, a plate member that is located approximately in the center part in the forward and backward directions of the transversely extending rectangular plate 224*a* and that extends to the horizontal ends is provided in an approximately perpendicular direction. Then, a mounted piece 424*c* is formed at the upper end of the plate member 424*g*. In the mounted piece 424*c*, three screw holes 424*d* are formed in alignment with each other in a horizontal direction. The mounted piece 424*c* is screwed from the front-face side onto the plate member 223. Further, on the rear side of the transversely extending rectangular plate 224*a*, a ventilation hole is formed for air cooling of the display device 406. The configuration of the clamping member 425 is similar to that of the clamping member 424. That is, the clamping member 425 has a transversely extending rectangular plate 225*a*, a side wall plate 225*b*, a plate member 425*g*, a mounted piece 425*c*, and screw holes 425*d*, and is screwed from the front face side onto the plate member 223.

Further, the architecture wall assembly 401 according to Modification 4 has blocking plates 466 and 467 for blocking gaps generated on the two sides of the opening 23*a* in the horizontal direction. The blocking plates 466 and 467 are fixed to the plate member 223 in a state of blocking the gaps in the opening 23*a*.

In the architecture wall assembly 401 according to Modification 4, an existing display device 406 having a size smaller than the opening 23*a* can be held inside the wall. Here, other clamping members 424 and 425 may be prepared so that a display device 406 having a diverse size may be held inside the wall.

(Modification 5)

Figure 22:
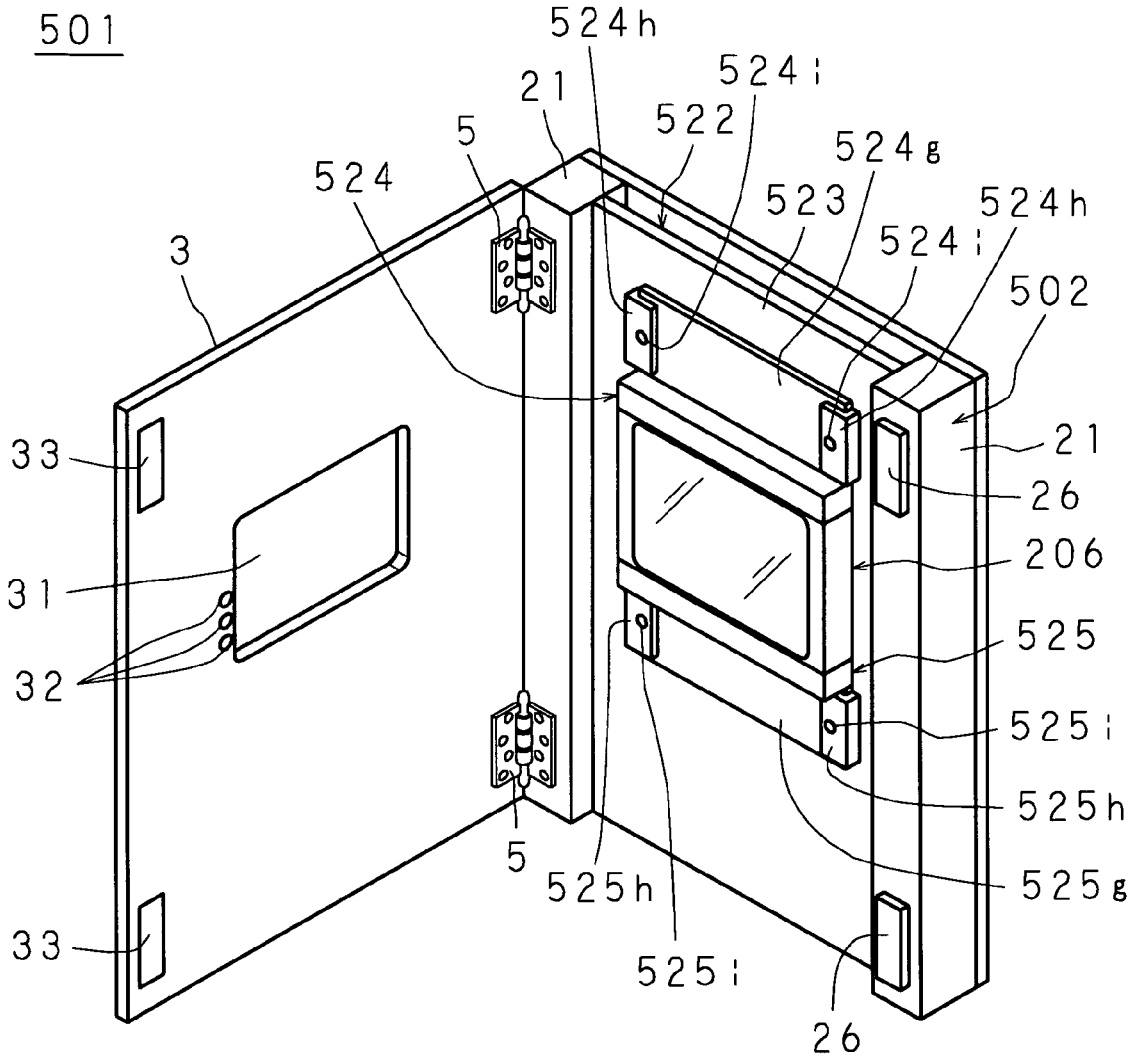
FIG. 22 is a perspective view schematically showing an architecture wall assembly according to Modification 5 in a state that a front base board is opened.
Figure 23:
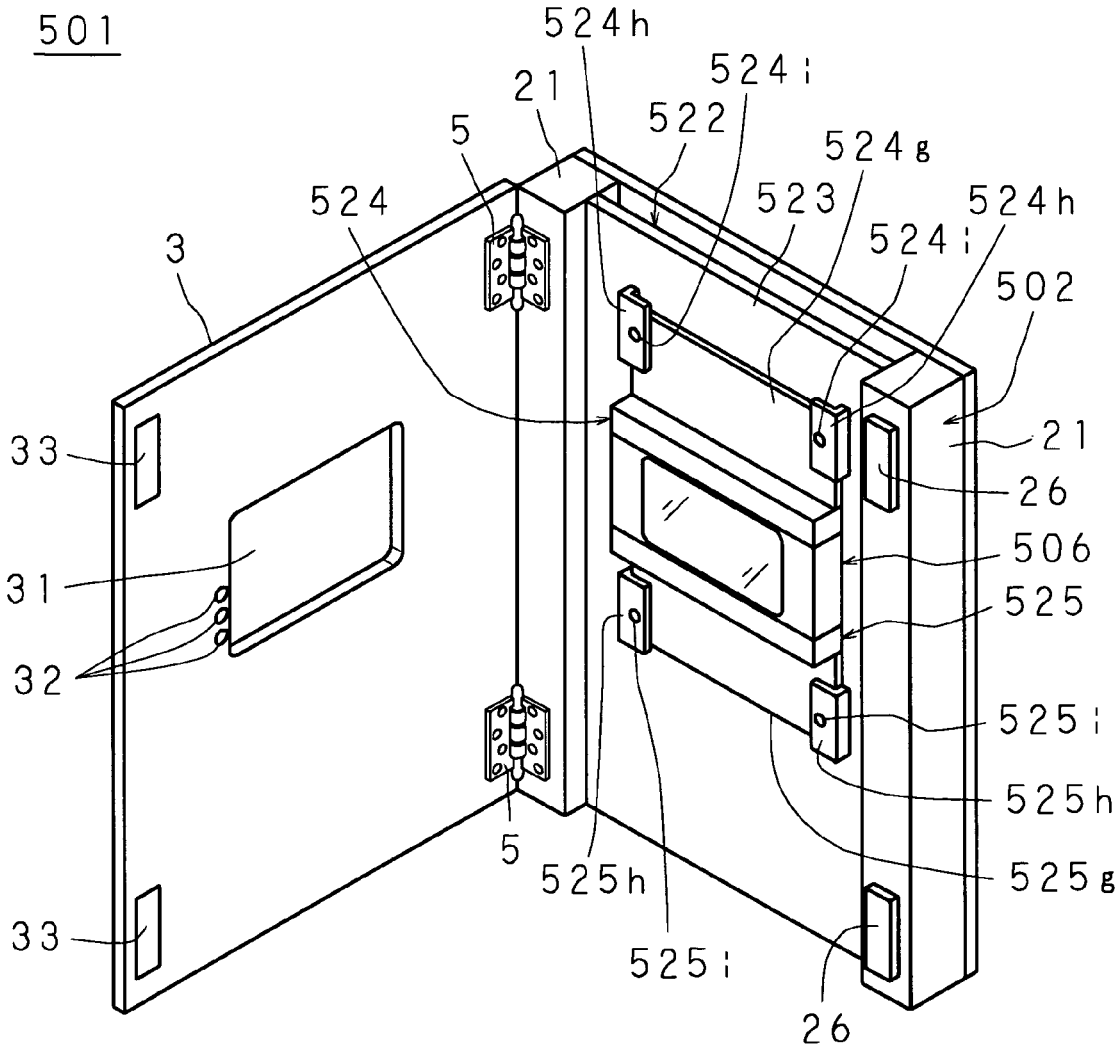
FIG. 23 is a perspective view-schematically showing an architecture wall assembly according to Modification 5 in a state that a front base board is opened.

FIGS. 22 and 23 are perspective views schematically showing an architecture wall assembly 501 according to Modification 5 in a state that a front base board 3 is opened. Similarly to Modification 2, the architecture wall assembly 501 according to Modification 5 has: a plate member 523 that constitutes a holding member 522 of a wall base structure 502; and clamping members 524 and 525. Similarly to Modification 2, the clamping member 524 has a transversely extending rectangular plate and a side wall plate so as to have the shape of a shallow dish that covers the upper part of the display device 506. On the outer side of the transversely extending rectangular plate, a mounted piece 524*g* is formed in an approximately perpendicular direction.

As shown in FIGS. 22 and 23, the plate member 523 has hook-shaped clamping pieces 524*h* for clamping the horizontal side portions of the mounted pieces 524*g* in such a manner that the clamping member 524 can move in up and down directions. In appropriate portions of the clamping pieces 524*h*, lock screws 524*i* or the like are provided for fixing the mounted piece 524*g* at an appropriate position. The configuration of the clamping member 525 is similar to that of the clamping member 524, and hence has a transversely extending rectangular plate and a side wall plate so as to have the shape of a shallow dish for covering the lower part of the display device 506. On the outer side of the transversely extending rectangular plate, a mounted piece 525*g* is formed in an approximately perpendicular direction. Further, the plate member 523 has: hook-shaped clamping pieces 525*h* for clamping the horizontal side portions of the mounted piece 525*g*; lock screws 525*i*; and the like.

According to Modification 5, when the vertical positions of the clamping members 524 and 525 are changed, the display device 206 or 506 can be held inside the wall regardless of the size of the display device.

(Modification 6)

Figure 24:
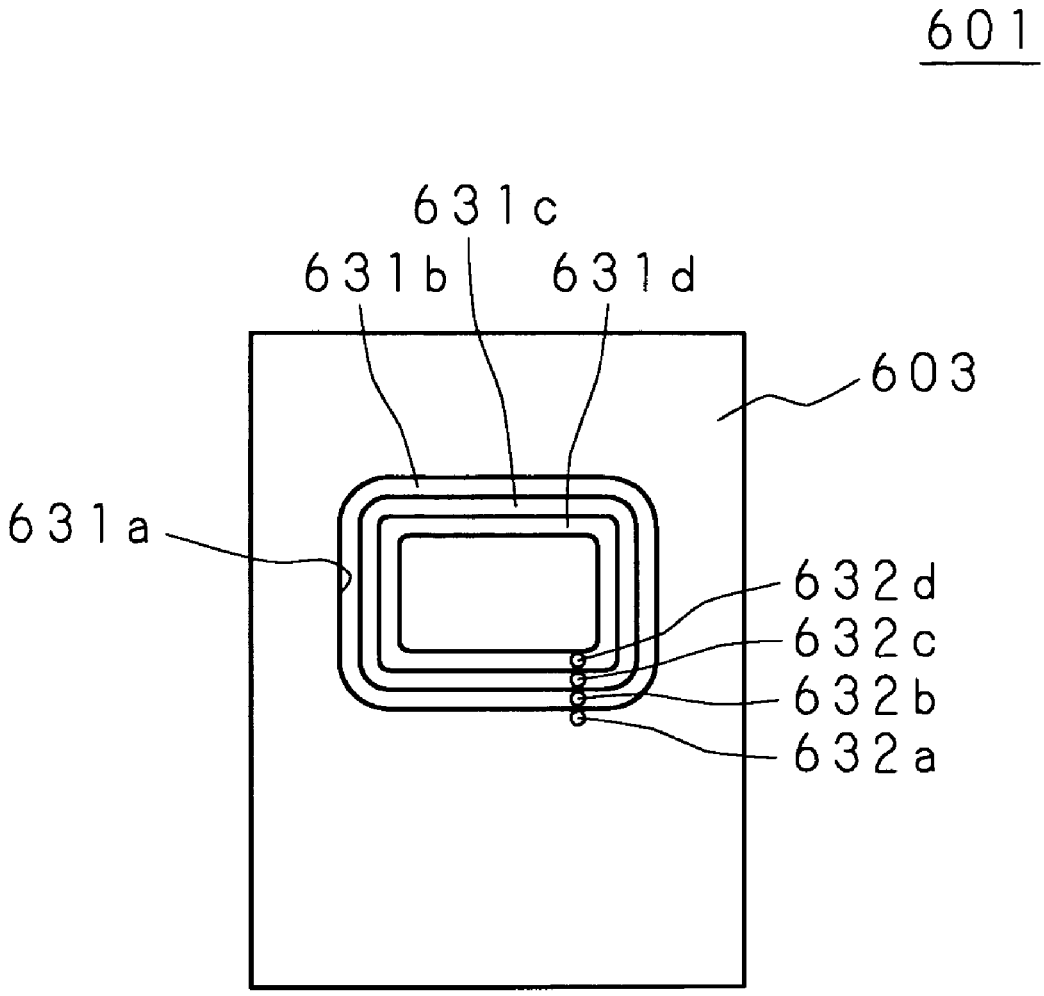
FIG. 24 is a front view schematically showing an architecture wall assembly according to Modification 6.

FIG. 24 is a front view schematically showing an architecture wall assembly 601 according to Modification 6. The architecture wall assembly 601 according to Modification 6 is constructed such that the area of a window 631*a* can be changed.

Into the window 631*a* of a front base board 603 according to Modification 6, a frame material 631*b* for changing the area of the window 631*a* is fitted. Further, into the inner side of the frame material 631*b*, frame materials 631*c* and 631*d* having smaller sizes are fitted sequentially. These frame materials 631*b*, 631*c*, and 631*d* and the window 631*a* are fixed with adhesives or the like. Further, the frame materials 631*b*, 631*c*, and 631*d* have remote control signal passing apertures 632*b*, 632*c*, and 632*d*, respectively, while a remote control signal passing aperture 632*a* is provided also in a lower part of the window 631*a*.

Figure 25A:
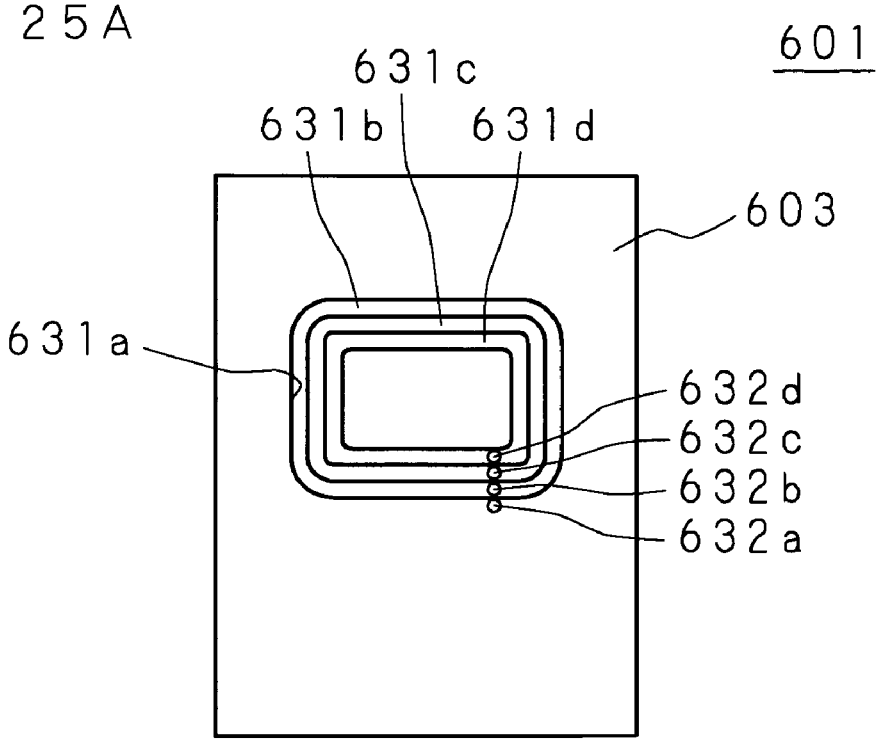
FIGS. 25A and 25B are explanation diagrams schematically showing a method of changing the area of a window according to Modification 6.
Figure 25B:
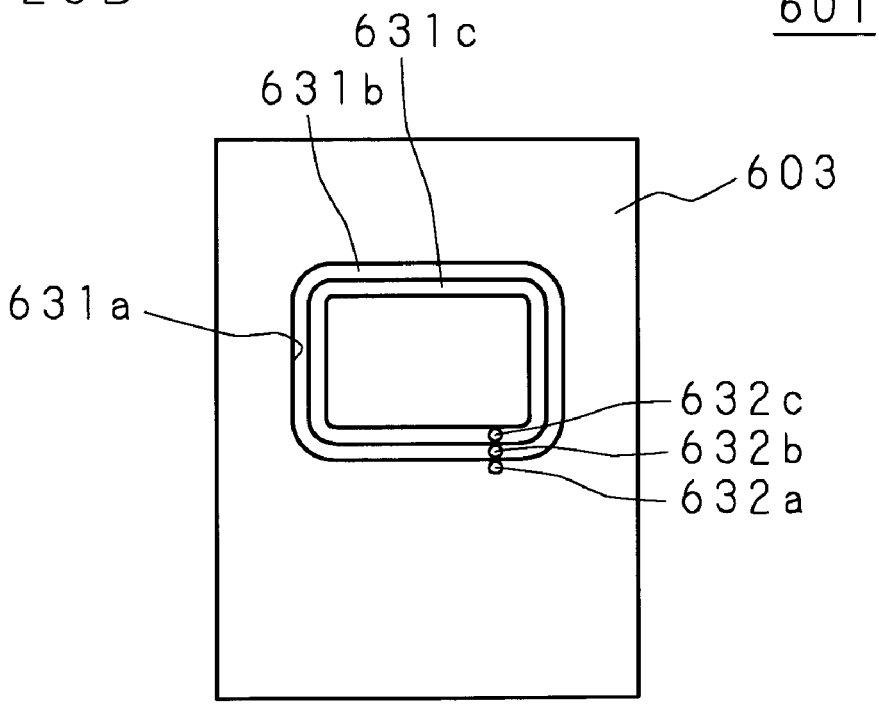

FIGS. 25A and 25B are explanation diagrams schematically showing a method of changing the area of the window 631*a* according to Modification 6. Starting from the state shown in FIG. 25A, when the innermost frame material 631*d* is removed, the size of the window 631*a* is increased as shown in FIG. 25B. On the contrary, when the removed frame material 631*d* is attached, the area of the window 631*a* is reduced.

(Modification 7)

Figure 26:
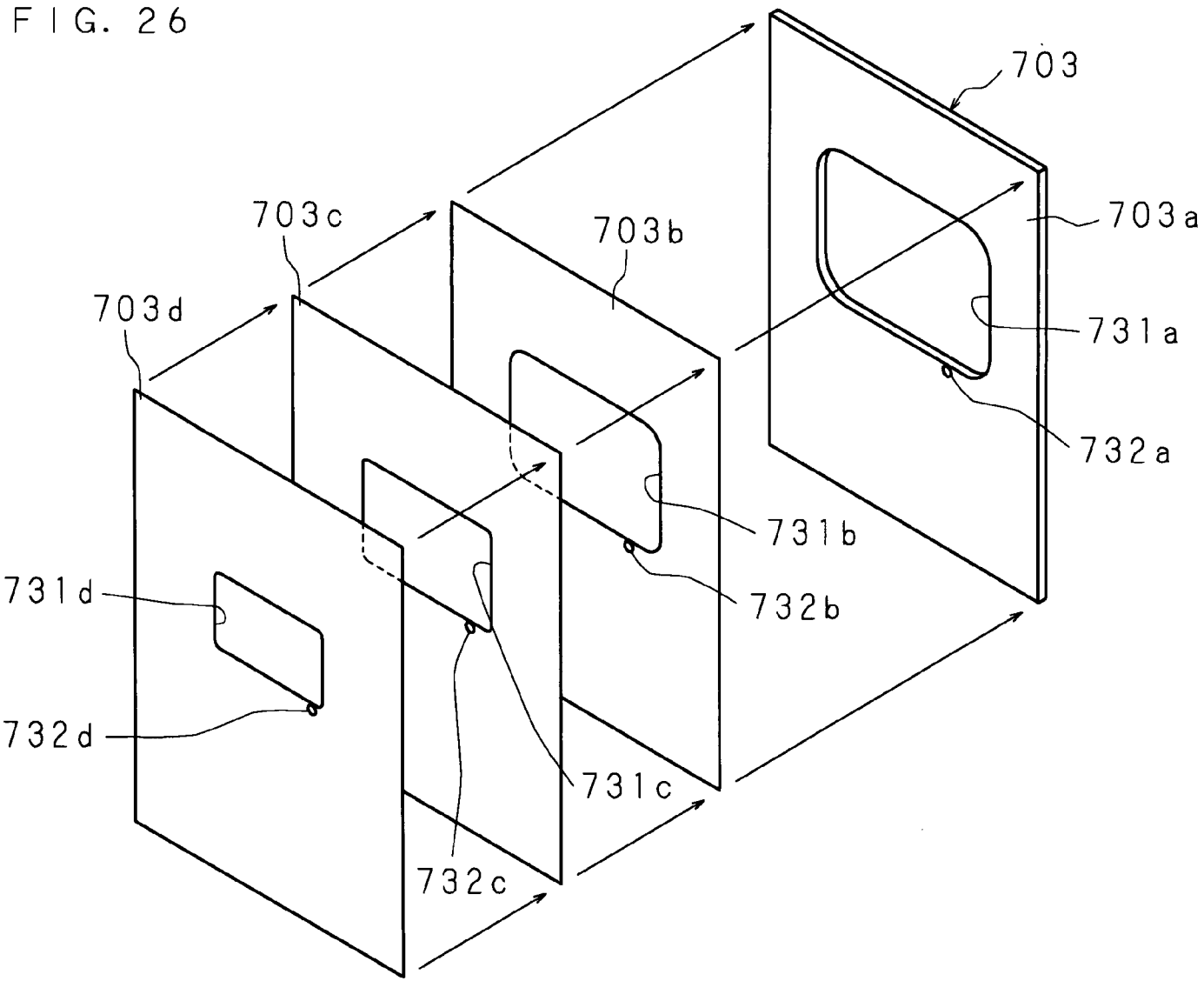
FIG. 26 is an exploded perspective view schematically showing a front base board that constitutes an architecture wall assembly according to Modification 7.

FIG. 26 is an exploded perspective view schematically showing a front base board 703 that constitutes an architecture wall assembly 701 according to Modification 7. On the front side of the front base board 703 a plurality of material plates 703*a*, 703*b*, 703*c*, and 703*d* are stacked in forward and backward directions. These material plates 703*a*, 703*b*, 703*c*, and 703*d* have windows 731*a*, 731*b*, 731*c*, and 731*d*, and stacked in such order that the area of the window of a material plate at the front layer side of the front base board 703 is smaller than the window of a material plate at the deeper layer side thereof. Further, the material plates 703*a*, 703*b*, 703*c*, and 703*d* have remote operation signal passing apertures 732*a*, 732*b*, 732*c*, and 732*d* in lower parts of the windows 731*a*, 731*b*, 731*c*, and 731*d*.

Figure 27A:
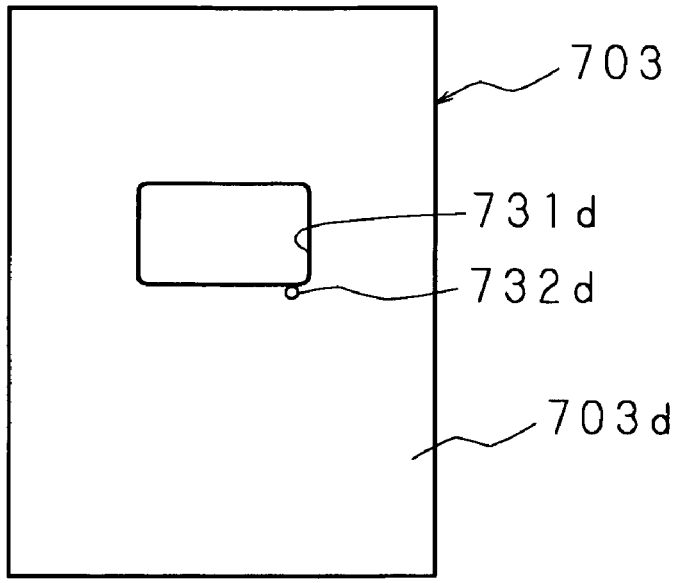
FIGS. 27A and 27B are explanation diagrams schematically showing a method of changing the area of a window according to Modification 7.
Figure 27A:
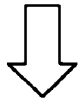
Figure 27B:
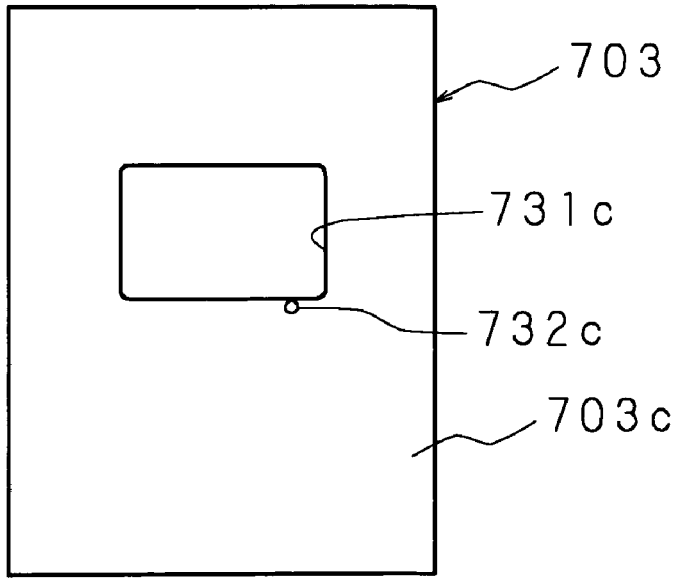

FIGS. 27A and 27B are explanation diagrams schematically showing a method of changing the area of the window 703*d* according to Modification 7. Starting from the state shown in FIG. 27A, when the material plate 703*d* at the most front layer side is removed, the size of the window 731*d* is increased as shown in FIG. 27B. On the contrary, when the removed material plate 703*d* is attached, the area of the window 731*c* is reduced.

(Modification 8)

Figure 28:
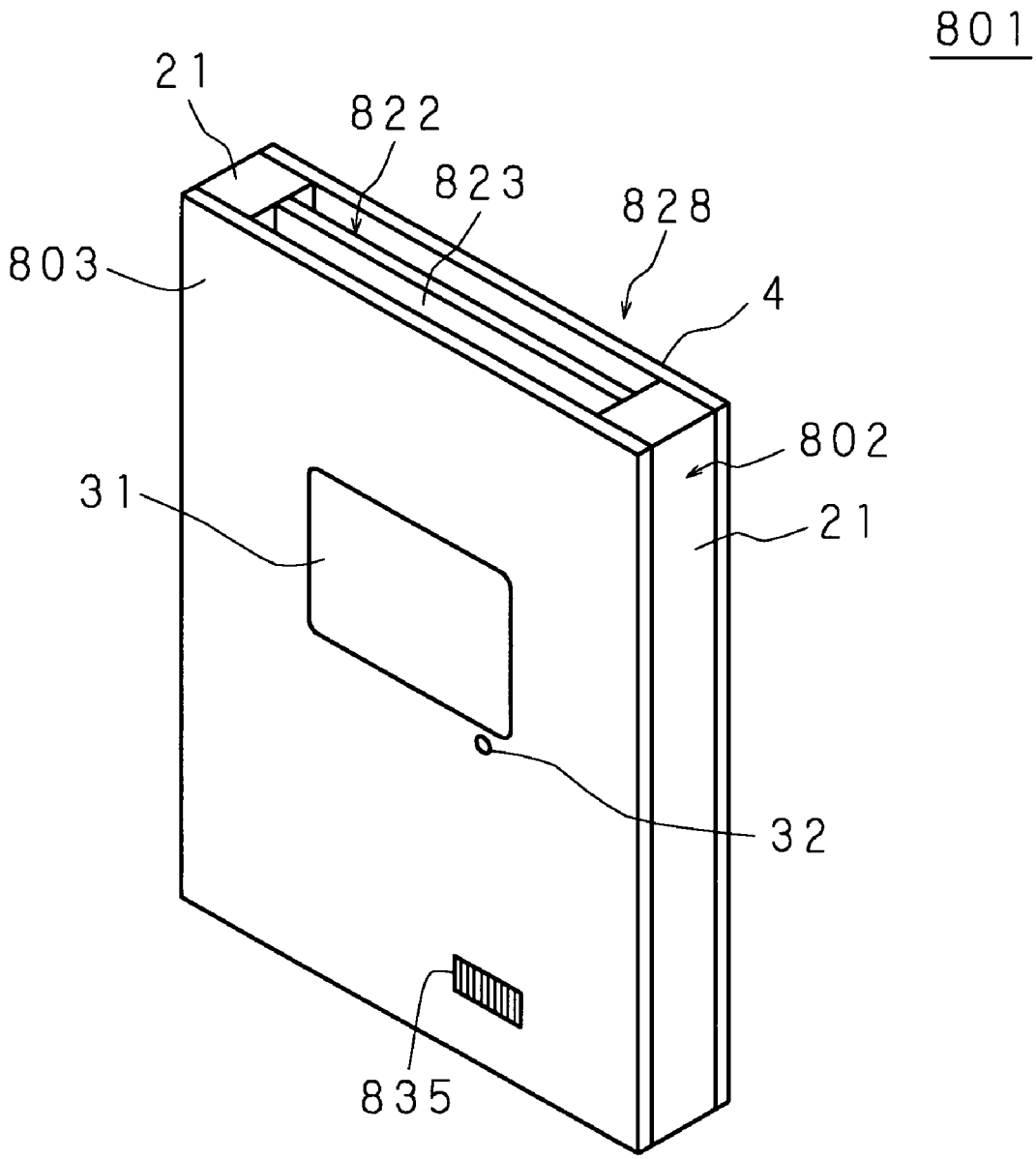
FIG. 28 is a perspective view schematically showing an architecture wall assembly according to Modification 8.
Figure 29:
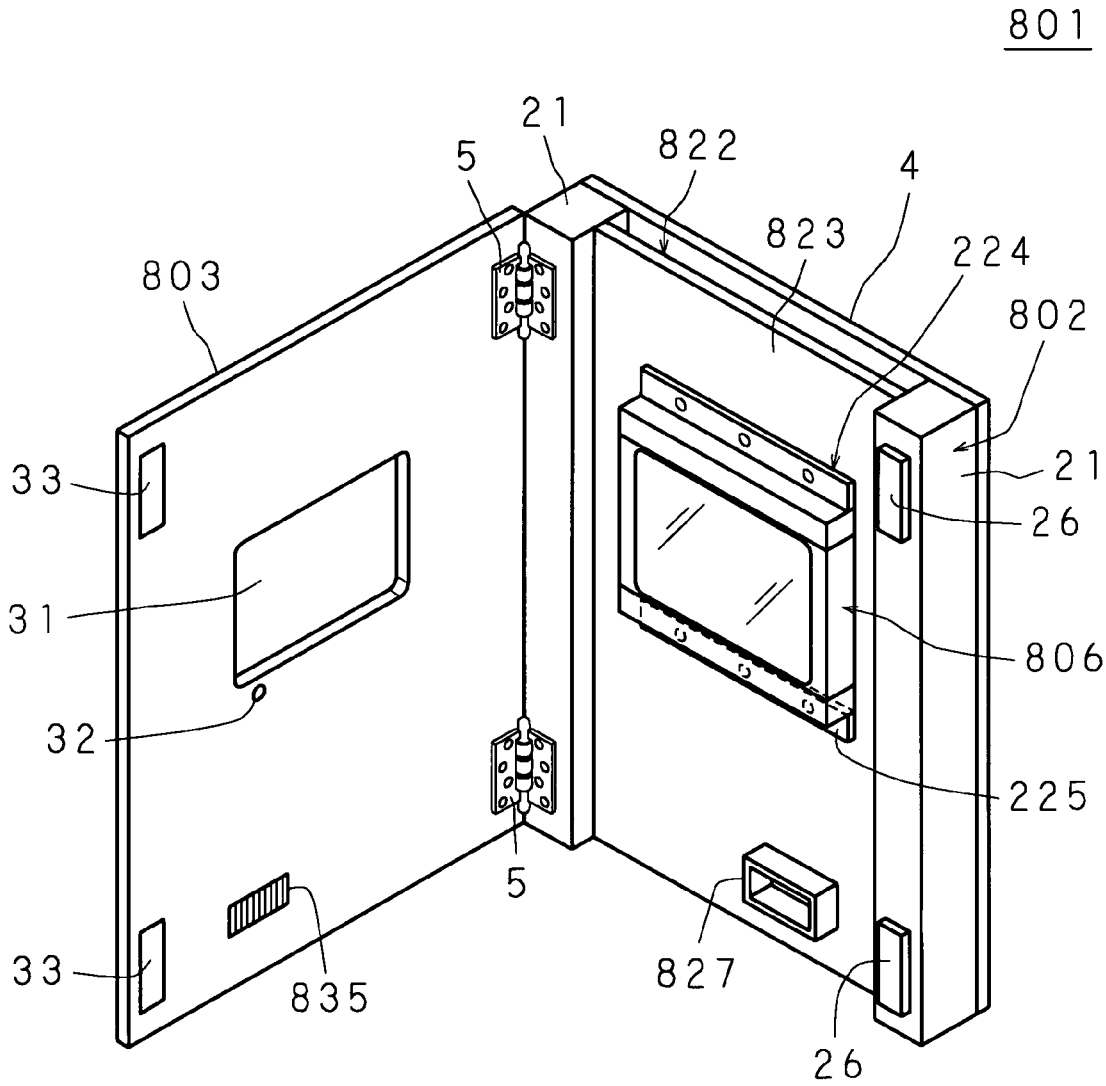
FIG. 29 is a perspective view of an architecture wall assembly according to Modification 8 in a state that a front base board is opened.
Figure 30:
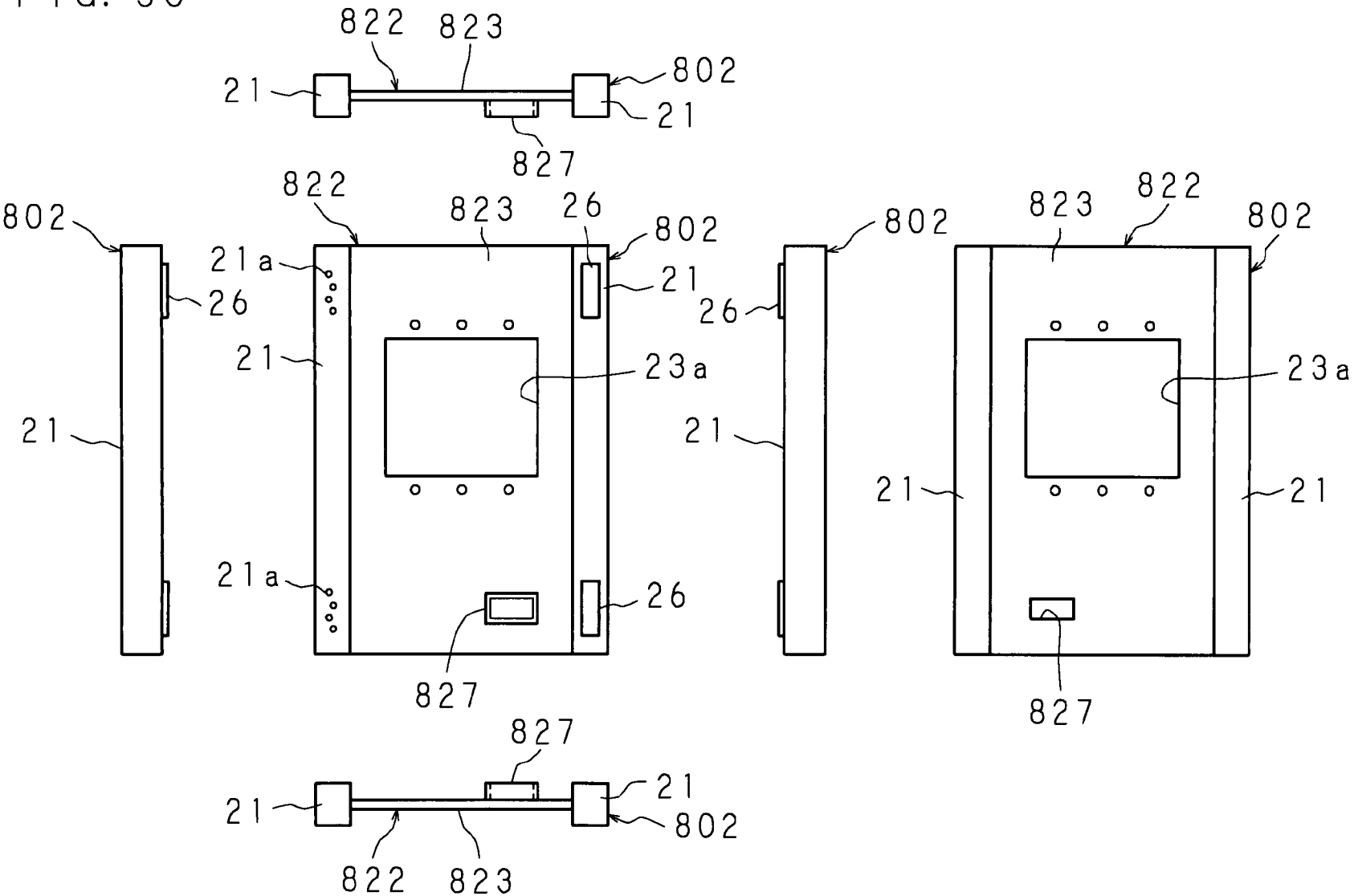
FIG. 30 is a six-side view diagram of a wall base structure according to Modification 8.

FIG. 28 is a perspective view schematically showing an architecture wall assembly 801 according to Modification 8. FIG. 29 is a perspective view of the architecture wall assembly 801 according to Modification 8 in a state that a front base board 803 is opened. FIG. 30 is a six-side view diagram of a wall base structure 802 according to Modification 8. The architecture wall assembly 801 according to Modification 8 has a similar configuration to the architecture wall assembly 201 according to Modification 2, and has a wall base structure 802, a front base board 803, and a rear base board 4. The wall base structure 802 has columnar members 21 and a holding member 822. A plate member 823 that constitutes the holding member 822 has an opening 23*a*, clamping members 224 and 225, and the like.

The front base board 803 according to Modification 8 further has an air inlet 835 in a lower part of one horizontal end. In the plate member 823 that constitutes the wall base structure 802, a rectangular-pipe shaped air inlet pipe 827 for leading to the rear face side of the plate member 823 the air obtained through the air inlet 835 is provided in a part opposing the air inlet 835.

A space formed by being surrounded by the holding member 822, the rear base board 4, and the columnar members 21 which are separated from each other forms an air passage 829 (see FIG. 31) for passing air upward from a lower part of the display device 806. Further, an opening formed by being surrounded by the plate member 823, the rear base board 4, and the upper end parts of the columnar members 21 forms an air outlet 828 for exhausting the air having been passed through the air passage 829.

Figure 31:
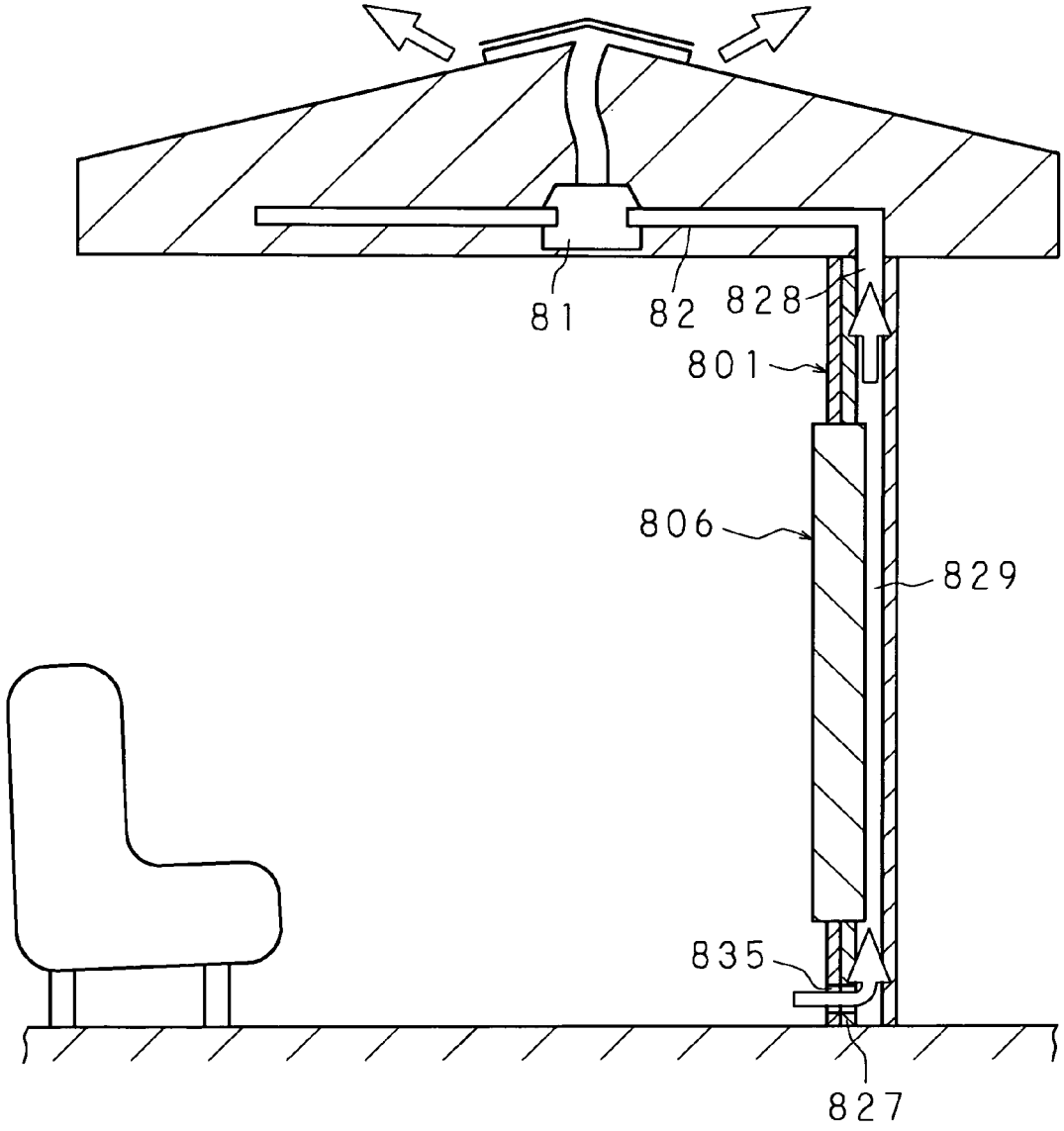
FIG. 31 is a schematic sectional view of an architecture that employs an architecture wall assembly according to Modification 8.

FIG. 31 is a schematic sectional view of an architecture employing the architecture wall assembly 801 according to Modification 8. The architecture according to Modification 8 has: a ventilator 81 for ventilating the room; and a duct 82 for connecting the ventilator 81 and the air outlet 828 of the architecture wall assembly 801.

According to Modification 8, as shown in FIG. 31, when the ventilator 81 is driven, air is obtained through the air inlet 835 and the air inlet pipe 827 into the air passage 829, and then rises upward from a lower part through the air passage 829 in the inside of the wall. Then, the air flows through the rear face side of the display device 806 so as to perform air cooling of the display device 806. The air having flown through the rear face side of the display device 806 is exhausted from the air outlet 828. The air released from the air outlet 828 is discharged through the ventilator 81 to the outside. As such, in cooperation with a ventilation system, air cooling of the display device 806 is achieved effectively.

Second Embodiment

A wall assembly according to the second embodiment may be one forming a part of the wall of a residence, or alternatively one used as a partition for partitioning a space.

Figure 32:
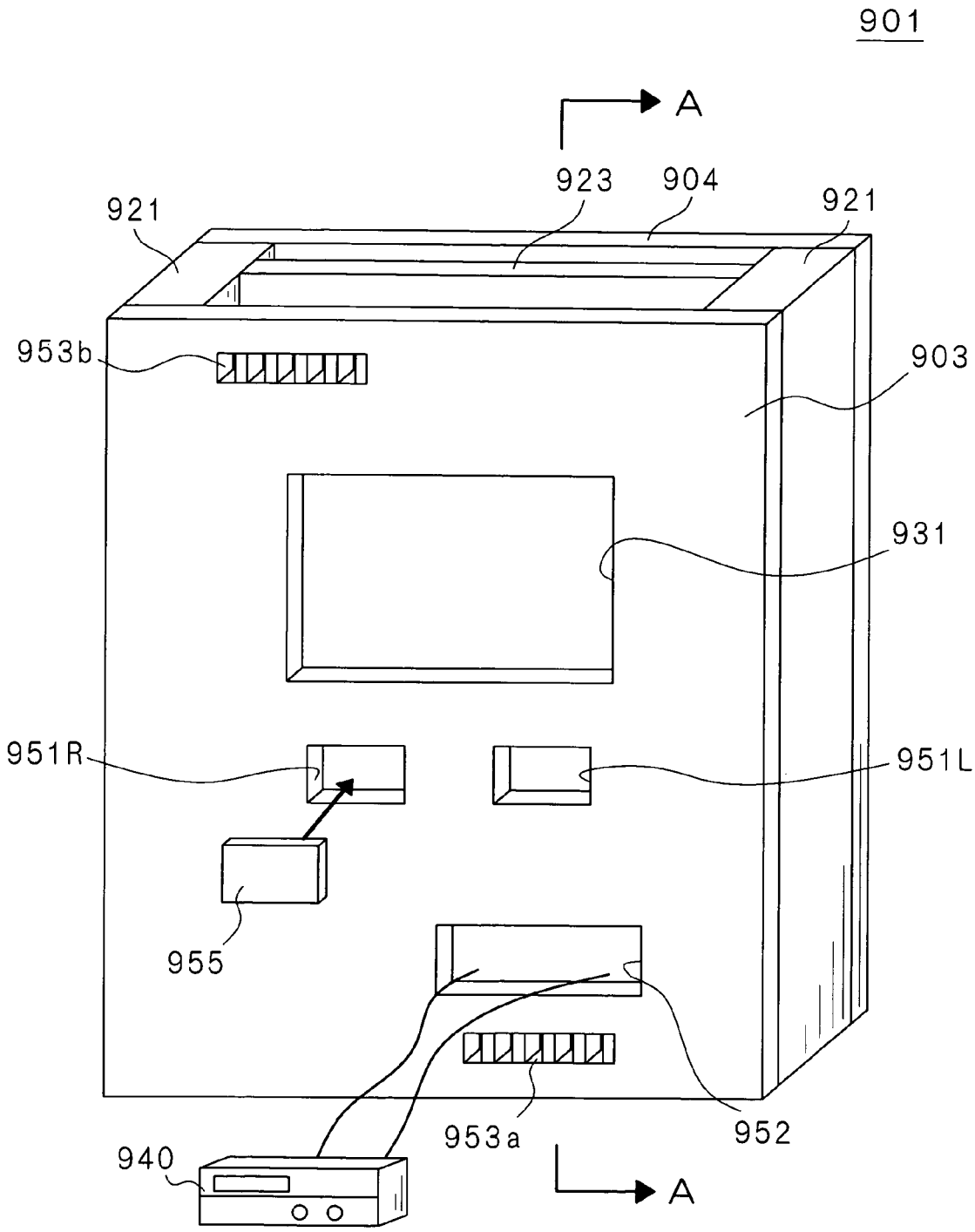
FIG. 32 is an external appearance perspective view of a wall assembly according to a second embodiment.
Figure 33:
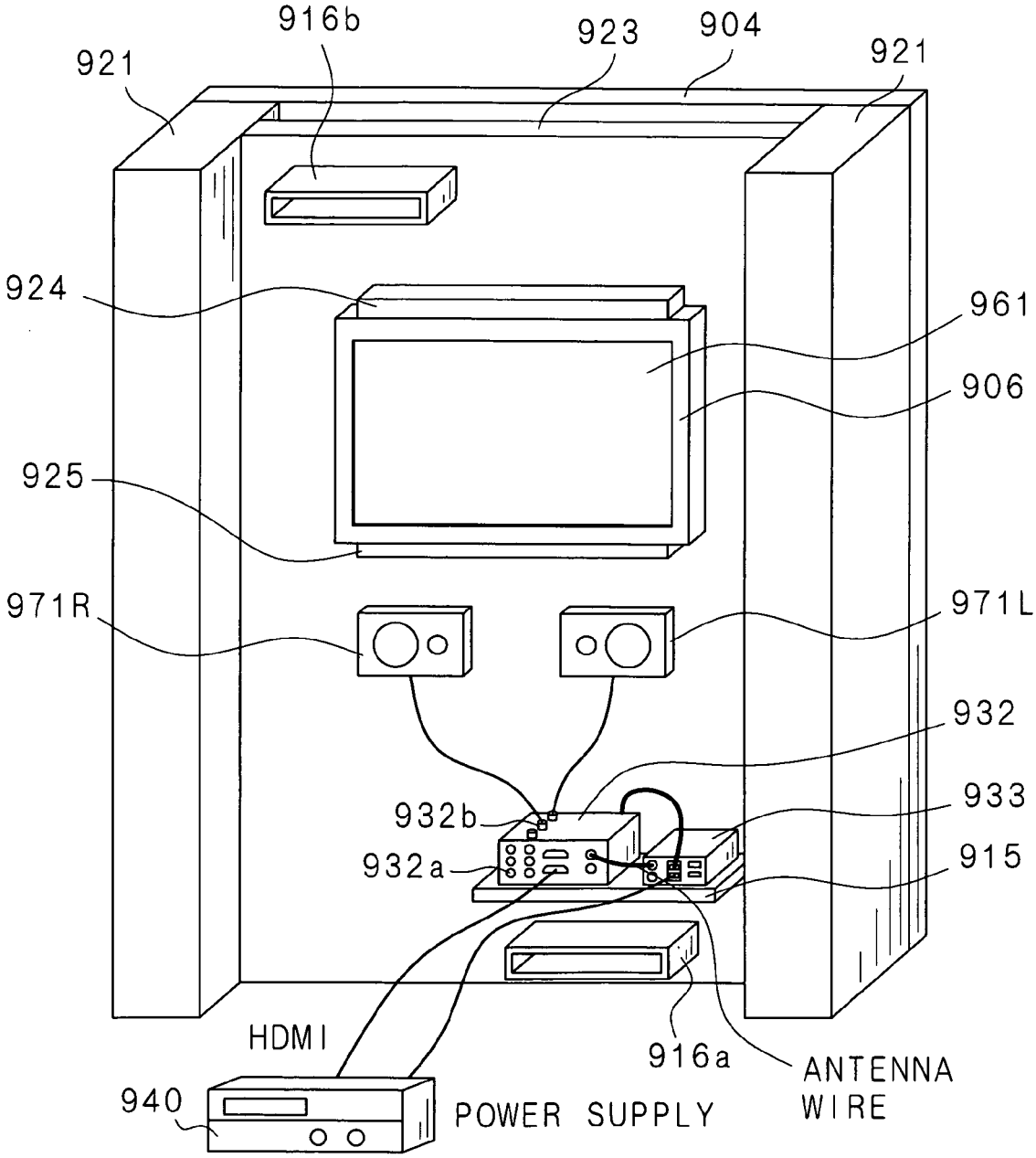
FIG. 33 is a diagram showing a wall assembly in a state that a front face plate of FIG. 32 is removed.
Figure 34:
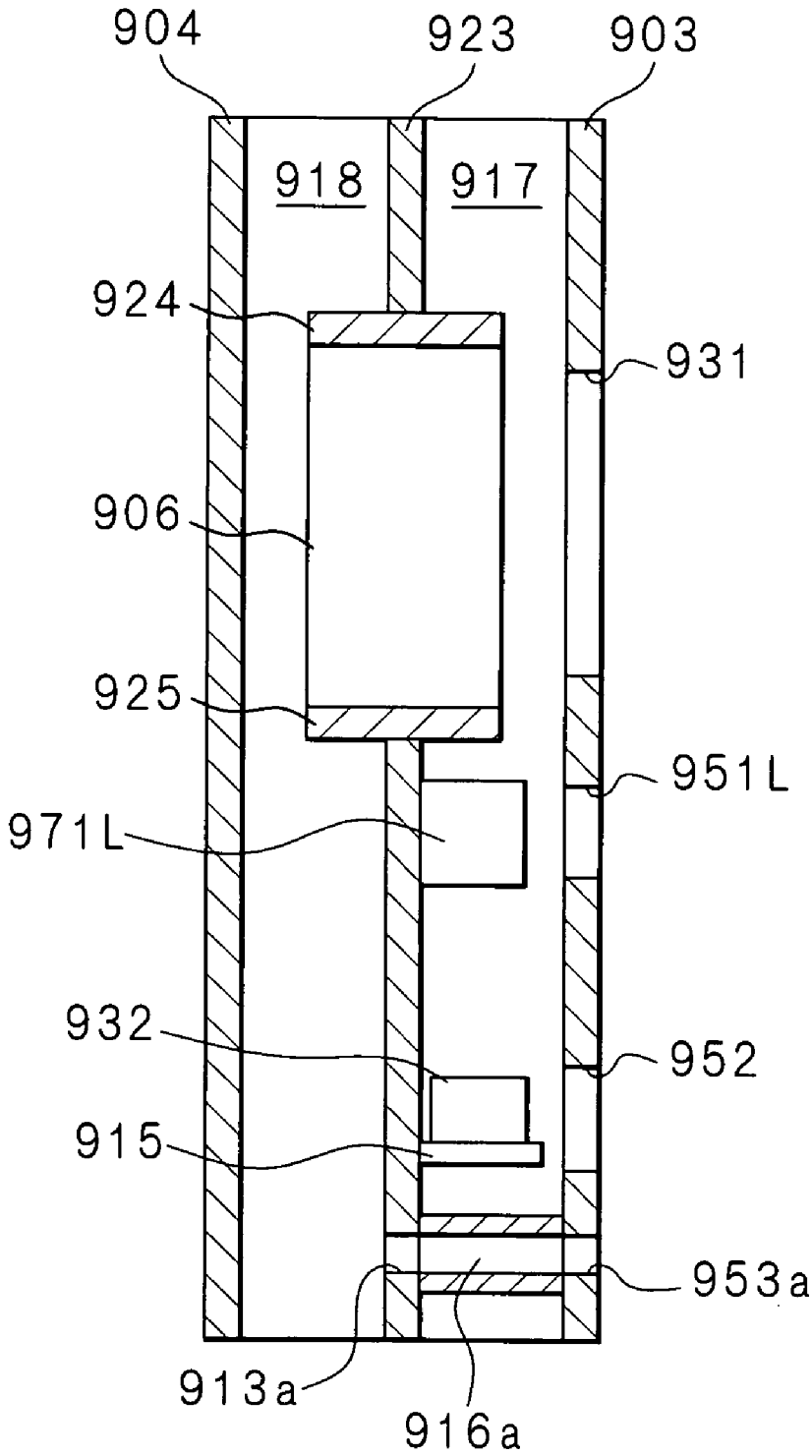
FIG. 34 is a sectional view taken along line A-A in FIG. 32.

FIG. 32 is an external appearance perspective view of a wall assembly 901 according to the second embodiment. FIG. 33 is a diagram showing the wall assembly 901 in a state that a front face plate (a front base board) of FIG. 32 is removed. FIG. 34 is a sectional view taken along line A-A in FIG. 32.

The wall assembly 901 comprises: a pair of columnar members 921 and 921; a front face plate 903 and a rear face plate (a rear base board) 904 having the same shape and the size same with each other; and a middle plate (a plate member: a holding part) 923. Each member is formed from a material appropriately selected from wood, gypsum, steel, and the like depending on the installation site and the strength of the wall assembly 901.

The columnar members 921 and 921 have a rectangle column shape and are arranged in parallel to each other. Between the pair of parallel columnar members 921 and 921, the middle plate 923 is provided in such a manner that the longitudinal direction of the rectangular middle plate 923 agrees with the longitudinal direction of the columnar members 921 and 921. As described later, the middle plate 923 holds a television set 906, speakers 971R and 971L, a relay box 932, and a power box 933.

The front face plate 903 and rear face plate 904 have the same shape and the same size with each other. The rear face plate 904 is attached onto the columnar members 921 and 921 in such a manner that the pair of parallel columnar members 921 and 921 are located on the two side edges along the longitudinal direction. Here, the columnar members 921 and 921, the rear face plate 904, and the middle plate 923 may be fixed by fastening pieces and by welding, or alternatively may be fixed by fastening pieces in a separable manner.

The front face plate 903 is provided at the opposite side to the rear face plate 904 of the columnar members 921 and 921. At that time, the columnar members 921 and 921 are located on the two side edges along the longitudinal direction of the front face plate 903. That is, the front face plate 903 and the rear face plate 904 are placed opposite to each other in parallel in such a manner that the columnar members 921 and 921 and the middle plate 923 are located in between. Then, as shown in FIG. 34, a space 917 and a space 918 are formed respectively between the front face plate 903 and the middle plate 923 and between the rear face plate 904 and the middle plate 923.

Here, the front face plate 903 is fixed to the columnar members 921 and 921, for example, by magnets, and can be attached to and detached from the columnar members 921 and 921. Thus, at the time of wiring work of the television set 906, the speakers 971R and 971L, and the like, when the front face plate 903 is removed, the work is performed easily.

In the middle plate 923, an opening (not shown) having a rectangular shape is formed in a part above the center. Further, fixing plates (clamping members) 924 and 925 are provided perpendicularly to the middle plate 923 in the upper part and the lower part of the opening. Here, the fixing plates 924 and 925 protrude to both of the space 917 and the space 918. Then, the fixing plates 924 and 925 clamp the television set 906 from up and down directions so as to fix it. At that time, the television set 906 is fixed in such a manner that the display screen 961 is oriented to the front face plate 903 side. The fixing plates 924 and 925 may have a hole for releasing the heat of the television set 906.

Further, in the middle plate 923 the speakers 971R and 971L are held symmetrically in a lower part of the television set 906. Here, similarly to the television set 906, the speakers 971R and 971L may be fixed to the opening formed in the middle plate 923. Further, when having a light weight, the speakers 971R and 971L may be hung onto the middle plate 923 by a fixing piece.

In the surface on the front face plate 903 side of the middle plate 923, a placing board 915 onto which the relay box 932 and the power box 933 are placed is provided perpendicularly in a lower part of the speaker 971L. The relay box 932 has: a plurality of input terminals 932*a* into which signals are inputted; and a plurality of output terminals 932*b* for outputting the signals inputted through the input terminals 932*a*. The input terminals 932*a* and the output terminals 932*b* are: terminals for a sound signal and a video signal; a terminal for a television antenna; terminals for inputting and outputting data communication signals; an HDMI (High-Definition Multimedia Interface) terminal; and the like. Then, the relay box 932 connects to an external device 940 the television set 906 and the speakers 971R and 971L provided in the middle plate 923. The external device 940 is a DVD (Digital Versatile Disk) reproduction device, a personal computer, or the like.

For example, the sound signal output terminal of a DVD reproduction device is connected to the input terminal 932*a* for sound signal. Further, the speakers 971R and 971L are connected to the output terminals 932*b* for sound signal. Furthermore, the video signal output terminal of the DVD reproduction device is connected to the input terminal 932*a* for video signal. Further, the television set 906 is connected to the output terminal 932*b* for video signal. As a result, the external device 940 is connected to the television set 906 and the speakers 971R and 971L provided in the wall assembly 901, so that the video signal and the sound signal outputted from the DVD reproduction device can be outputted to the television set 906 and the speakers 971R and 971L.

Here, in FIG. 33, wiring of the television set 906 and the speakers 971R and 971L to the relay box 932 is arranged at the front face plate 903 side of the middle plate 923. However, the wiring may be arranged at the rear face plate 904 side.

The power box 933 is connected to a home electric socket and supplies power to the television set 906, the relay box 932, the external device 940, and the like connected to the power box 933. When the power box 933 is provided in the wall assembly 901, wiring of the television set 906 is completed inside the wall assembly 901. Further, even when an AV device other than the television set 906 is extendedly provided in the wall assembly 901, additional power supply wiring is unnecessary.

Furthermore, the power box 933 is connected to an external television antenna, and hence can provide a television antenna is signal to the relay box 932, the external device 940, and the like connected to the power box 933. Furthermore, the power box 933 is connected to a LAN (Local Area Network) linked to the Internet in the outside, and permits LAN connection to the relay box 932, the external device 940, and the like connected to the power box 933.

Further, in the surface on the front face plate 903 side of the middle plate 923, an air intake part 916*a* having a rectangle tube shape is provided in a lower part of the placing board 915. The air intake part 916*a* provided at right angles to the middle plate 923 has a height permitting contact to the front face plate 903. At a position in the middle plate 923 where the air intake part 916*a* is provided, an opening 913*a* is formed. Further, at a position in the front face plate 903 where the air intake part 916*a* contacts, a later-described air inlet 953*a* is formed. As a result, the space 918 is in fluid communication with the outside through the air inlet 953*a*, the air intake part 916*a*, and the opening 913*a*.

Further, in the surface on the front face plate 903 side of the middle plate 923, an air exhaust part 916*b* having the same configuration as the air intake part 916*a* is provided above the television set 906. At a position in the middle plate 923 where the air exhaust part 916*b* is provided, an opening (not shown) is formed. Further, at a position in the front face plate 903 where the air exhaust part 916*b* contacts, a later-described air outlet 953*b* is formed. As a result, the space 918 is in fluid communication with the outside through the air outlet 953*b*, the air exhaust part 916*b*, and the opening of the middle plate 923.

In the front face plate 903, a display window (window) 931 through which the display screen can be recognized visually from the front is formed at a position overlapping with the display screen 961 of the television set 906. The display window 931 may have the same shape and size as the display screen, or alternatively may be larger than the display screen 961. Here, a glass plate may be fitted into the display window 931 for avoiding the entering of dust. Further, in the front face plate 903, sound windows 951R and 951L are formed at positions overlapping with the speakers 971R and 971L. The sound outputted from the speakers 971R and 971L are outputted from the sound windows 951R and 951L to the outside, and hence not enclosed inside the wall assembly.

Further, in the front face plate 903, a connection window (an opening) 952 is formed at a position overlapping with the relay box 932 and the power box 933. At the time when an external device 940 is to be connected to the relay box 932 and the power box 933, connection work can be performed through the connection window 952 without the necessity of removing the front face plate 903.

Here, the sound windows 951R and 951L and the connection window 952 can be shielded by covers 955. In FIG. 32, only the cover for the sound window 951R is shown. When the individual windows are shielded by the covers 955, this avoids the entering of dust through the windows at the time of non-use.

Further, at positions of the front face plate 903 where the air intake part 916*a* and the air exhaust part 916*b* contact, the air inlet 953*a* and the air outlet 953*b* are formed. Louvers for improving the ventilation are provided in the air inlet 953*a* and the air outlet 953*b*. When the wall assembly 901 is used as a wall of a residence, the wall assembly 901 is installed between the ceiling and the floor of the residence. Thus, the space 917 and the space 918 are sealed by the ceiling and the floor. This causes the necessity of releasing the heat generated by the television set 906 to the outside of the wall assembly 901. Thus, the air intake part 916*a*, the air exhaust part 916*b*, the air inlet 953*a*, and the air outlet 953*b* are provided so as to form an air passage. By virtue of this, the heat in the wall assembly 901 can be released to the outside.

Figure 35:
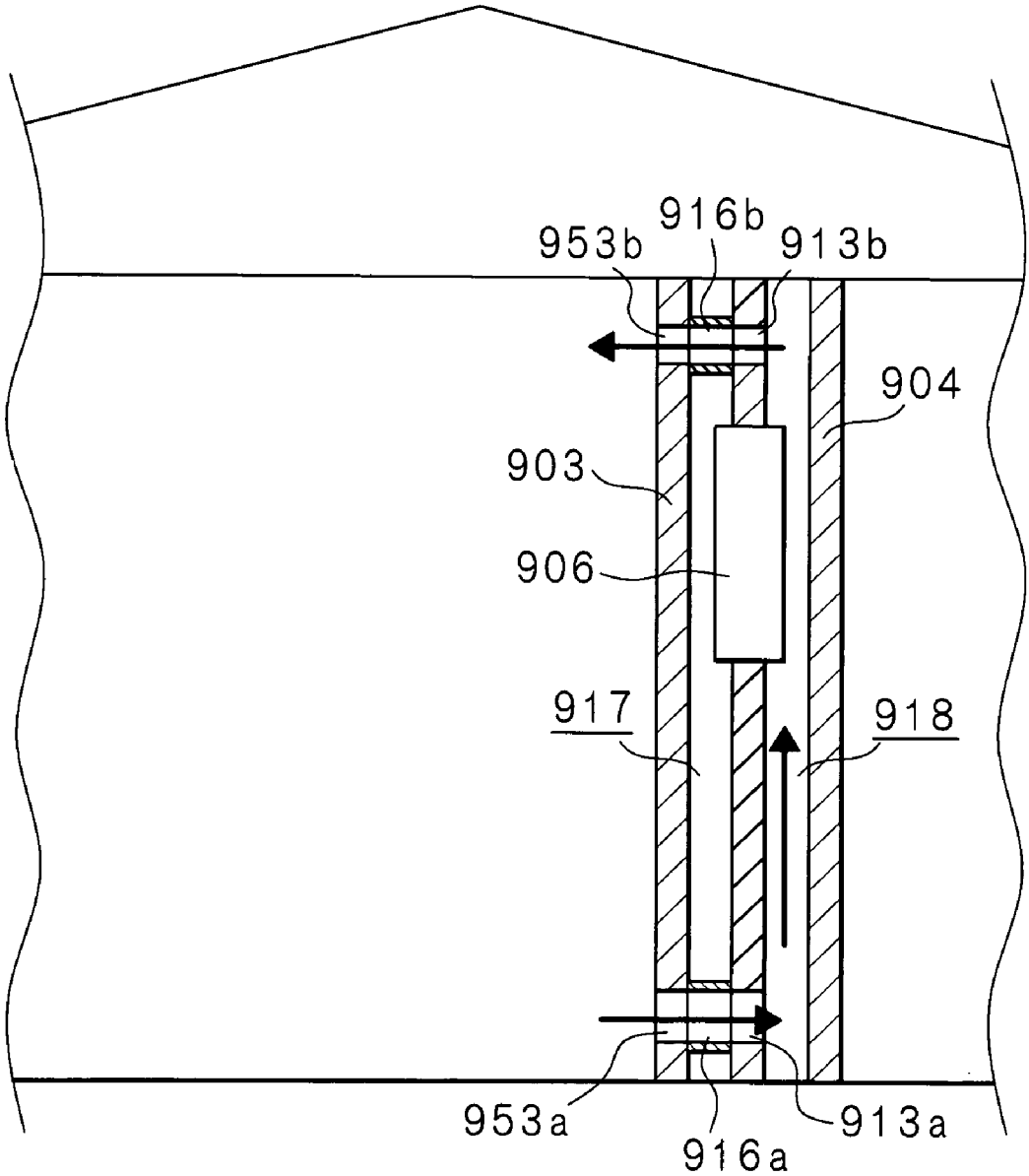
FIG. 35 is a diagram for describing air circulation in a wall assembly.

FIG. 35 is a diagram for describing air circulation in the wall assembly 901. As shown in FIG. 35, air flows from the outside into the space 918 via the air inlet 953*a*, the air intake part 916*a*, and the opening 913*a*. Since the temperature in the space 918 is high owing to the heat from the television set 906, the air in the space 918 flows to the outside of the wall assembly 901 via an opening 913*b* formed at the position of the air exhaust part 916*b* in the middle plate 923 as well as via the air exhaust part 916*b* and the air outlet 953*b*. Thus, the heat in the wall assembly 901 is released.

Here, the air having flowed from the outside into the space 918 may be exhausted through another path. For example, when the wall assembly 901 is used as a partition, the upper part of the wall assembly 901 may be opened so that the air having flowed into the space 918 may be released through the above-mentioned open portion for the purpose of heat releasing.

Next, wiring of the individual devices is described below for the wall assembly 901 having the above-mentioned configuration. In a case that the television set 906 and the speakers 971R and 971L are attached in advance to the middle plate 923 of the wall assembly 901, when the wiring work is to be performed for the television set 906 and the speakers 971R and 971L, the wiring work becomes possible when the front face plate 903 is opened. A home power supply is connected to the power box 933, while an antenna wire is connected to the relay box 932. At that time, each wiring may be connected from the rear face plate 904 side of the wall assembly 901, or alternatively may be connected through the connection window 952 of the front face plate 903. This selection may be performed appropriately depending on the installation site of the wall assembly 901. Then, the relay box 932 is connected to the power box 933, while the antenna wire and the power supply of the television set 906 are connected to the relay box 932.

Further, the voice output terminal of the television set 906 is connected to the relay box 932, while the speakers 971R and 971L are connected to the relay box 932. As a result, television sound can be outputted from the speakers 971R and 971L.

After the completion of wiring work, when the front face plate 903 is closed, the television set 906 and the speakers 971R and 971L are installed inside the wall so that the television set 906 can be recognized visually through the display window 931. This avoids the necessity of ensuring an indoor space for installing the television set 906 and the like. Further, the individual wiring is accommodated inside the front face plate 903. This avoids that the cables are scattered in the room and that the esthetic appearance of the room is degraded by the cables. Further, when an external device 940 such as a DVD reproduction device is to be connected, the external device 940 is connected to the relay box 932 via the connection window 952. Thus, without the necessity of removing the front face plate 903, the external device 940 can be connected to the television set 906 and the speakers 971R and 971L via the relay box 932.

Here, the second embodiment has been described for the case that the television set 906 and the speakers 971R and 971L are provided in advance in the middle plate 923. However, the television set 906 and the like may be mounted after the installation of the wall assembly 901. Further, the front face plate 903 may be fixed to one columnar member 921 via hinges and fixed to the other columnar member 921 via magnets so as to be attached to and detached from the columnar members 921 and 921 like in the opening and closing of a door.

Figure 36:
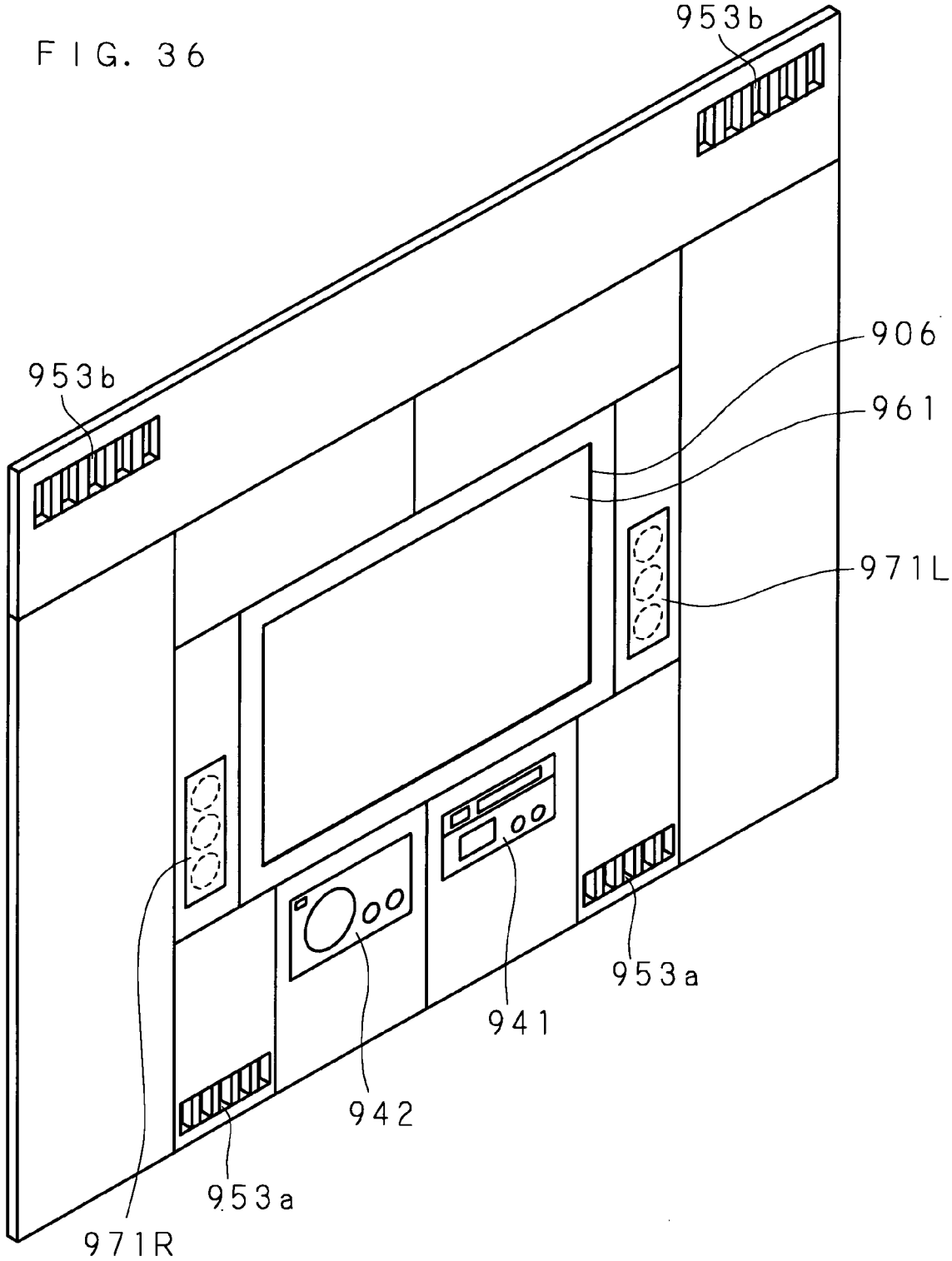
FIG. 36 is a diagram showing a modification of a wall assembly provided with a plurality of AV devices.

The middle plate 923 that holds the television set 906, the speakers 971R and 971L, the relay box 932, and the power box 933, as well as the structure of holding in the inside of the front face plate 903 may be changed appropriately. FIG. 36 is a diagram showing a modification of a wall assembly provided with a plurality of AV devices. As shown in the figure, a configuration may be adopted that the position of the display screen 961 of the television set 906 may agree with that of the front face plate 903. Further, as shown in FIG. 36, and AV devices other than the television set 906 and the speakers 971R and 971L, for example, a video recorder 941 and an amplifier 942, may be provided in an integrated manner.

Third Embodiment

Figure 37:
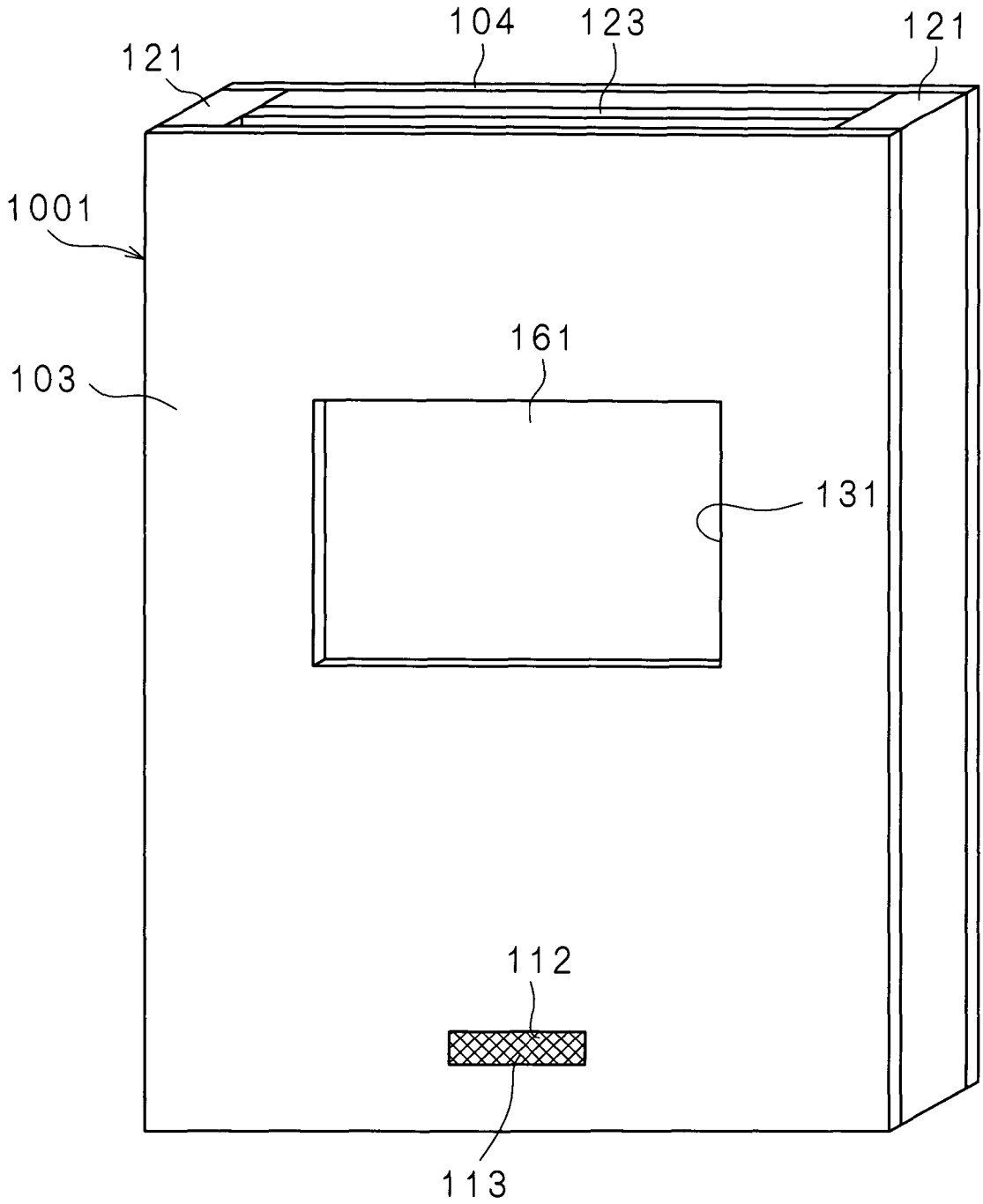
FIG. 37 is a front perspective view showing a configuration of a wall assembly with display screen according to a third embodiment.
Figure 38:
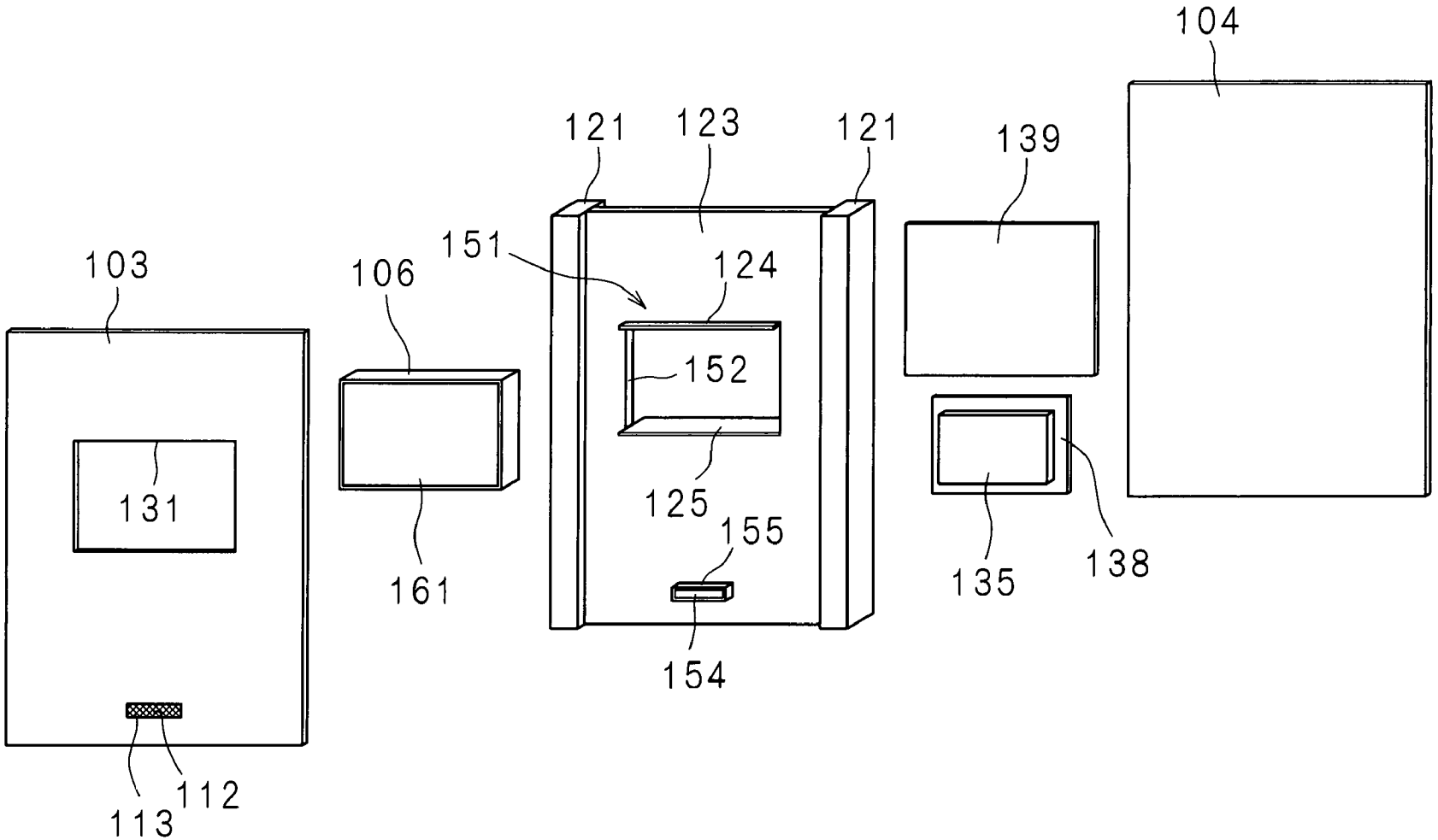
FIG. 38 is an exploded perspective view showing a configuration of a wall assembly with display screen.
Figure 39:
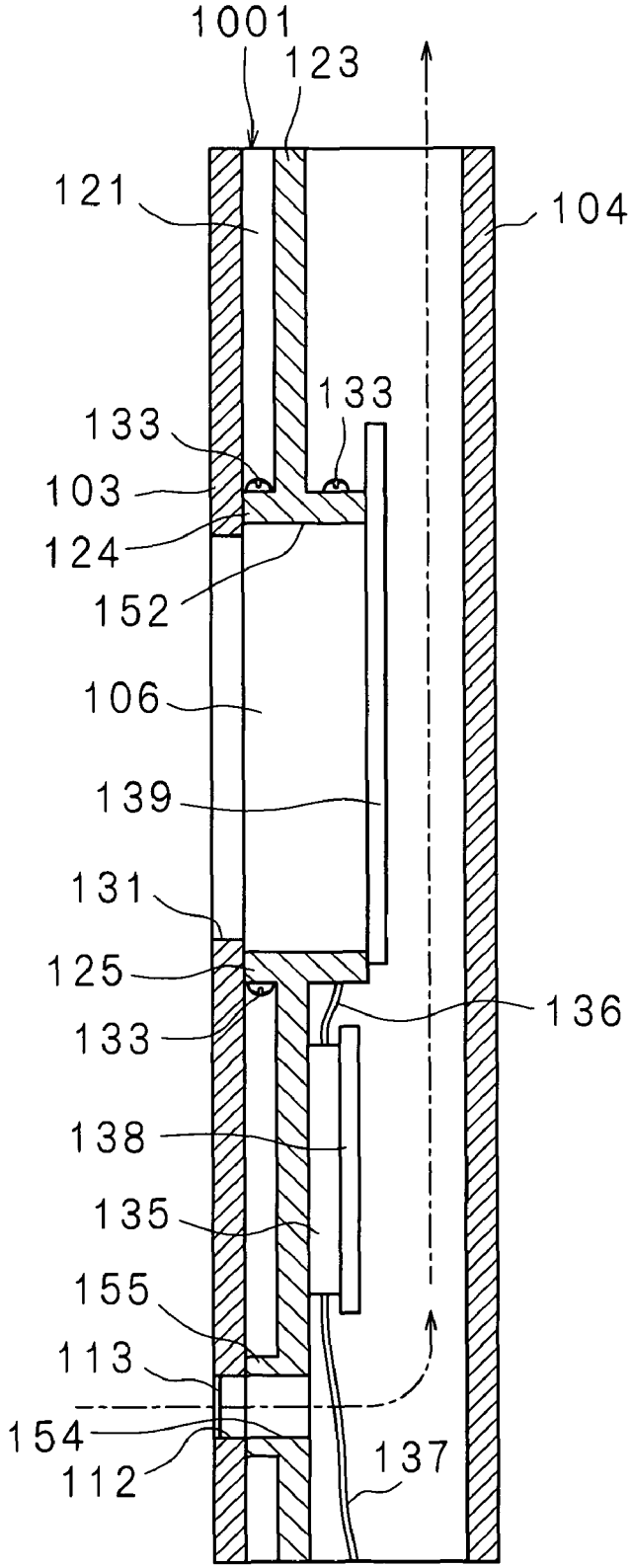
FIG. 39 is a sectional side view showing a configuration of a wall assembly with display screen.
Figure 40:
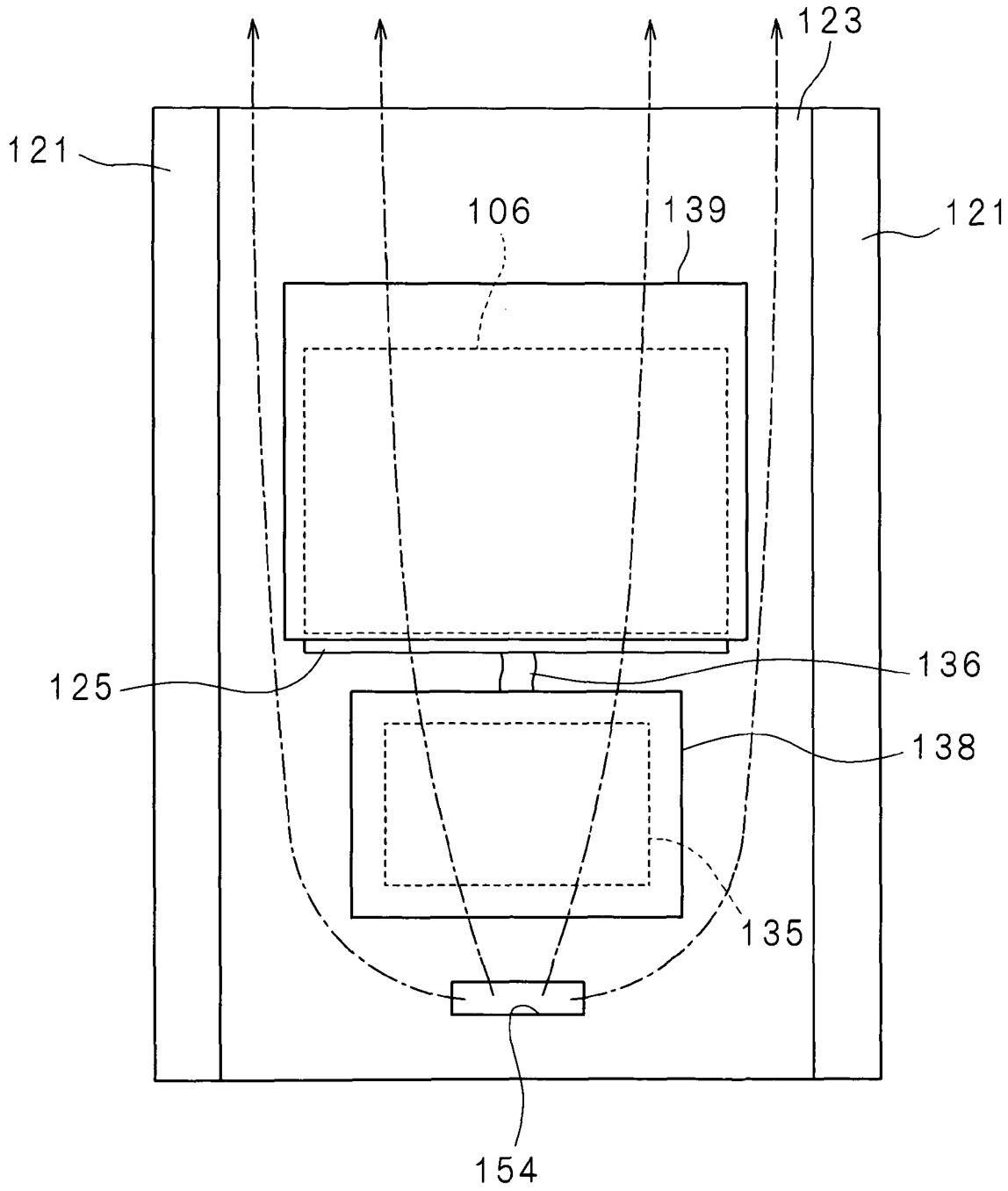
FIG. 40 is a rear view showing a configuration of a wall assembly with display screen.

FIG. 37 is a front perspective view showing a configuration of a wall assembly with display screen according to the third embodiment. Further, FIGS. 38, 39, and 40 are an exploded perspective view, a sectional side view, and a rear view showing a configuration of the wall assembly with display screen. In the figure, numeral 1001 indicates a wall assembly with display screen, which is used in construction of an architecture such as a residence. That is, when combined with other wall assemblys, the wall assembly with display screen manufactured in a factory or the like can form a wall of an architecture. Further, for example, the wall assembly with display screen 1001 may be a portable wall assembly that can be used as a partition for dividing a room.

The wall assembly with display screen 1001 has a flat approximately cubic shape. Then, a display screen 161 for displaying an image is provided on one wall surface. Here, in the following description, the side of the wall assembly with display screen 1001 where the display screen 161 is provided is referred to as the front face side, while the opposite side is referred to as the rear face side. The wall assembly with display screen 1001 has: two wall plates consisting of a front wall plate (a front base board) 103 and a rear wall plate (a rear base board) 104; two fixing members (columnar members) 121 for fixing these two wall plates approximately in parallel to each other in a manner separated by a predetermined gap; and a holding member (a plate member) 123 for holding a display panel 106. The front wall plate 103 and the rear wall plate 104 are manufactured from a raw material such as wood, gypsum, synthetic resin, and metal. The raw material may be selected appropriately depending on the installation environment or the like of the wall assembly with display screen. Further, the fixing members 121 and the holding member 123 are manufactured from a raw material such as wood and metal and, preferably, manufactured from a raw material having high strength.

The front wall plate 103 is a board having approximately a rectangular shape. Then, an opening 131 having approximately a rectangular shape is formed at an appropriate position. The opening 131 is used for exposing to the outside the display screen 161 of the display panel 106 provided in the wall assembly with display screen 1001. A glass plate or a transparent synthetic resin plate may be fitted in. As a result, a display screen formed by the display panel 106 is provided in the front wall plate 103. Further, in the front wall plate 103, a ventilation opening 112 is formed in a lower part of the opening 131 (in a lower part in up and down directions when the wall assembly with display screen 1001 is installed, or alternatively in a lower part in the up and down directions of an image displayed on the display screen 161). The ventilation opening 112 establishes fluid communication between the inside and the outside of the wall assembly with display screen 1001. Thus, air in the inside of the wall assembly with display screen 1001 and air in the outside can be exchanged through the ventilation opening 112. In order to maintain the esthetic appearance of the wall surface of the wall assembly with display screen 1001, a cover 113 of mesh shape or the like having air permeability is attached to the ventilation opening 112. Further, the rear wall plate 104 is a board having approximately a rectangular shape of approximately the same size as the front wall plate 103.

The fixing members 121 have the shape of a column of approximately cubic shape. Their length is set approximately equal to the length in the up and down directions of the front wall plate 103 and the rear wall plate 104. The two fixing members 121 have approximately the same shape with each other, and are linked approximately in parallel to each other by the holding member 123 which is a board having approximately a rectangular shape. The linkage of the fixing members 121 to the holding member 123 may be performed by welding, screw clamping, or the like when both members are metal made. When both members are wooden made, bonding, nailing, screw clamping, or the like may be employed. Further, the fixing members 121 and the holding member 123 need not be fixed in an indivisible manner. For example, grooves may be formed in the two fixing members 121, and then the holding member 123 may be fitted into them.

The front wall plate 103 and the rear wall plate 104 are fixed respectively onto the front faces and the rear faces of the two fixing members 121 linked by the holding member 123. The fixing of the front wall plate 103 and the rear wall plate 104 to the fixing members 121 may be performed by bonding, welding, nailing, screw clamping, or the like. Further, one or both of the front wall plate 103 and the rear wall plate 104 may be fixed to the fixing members 121 in a manner permitting attachment and detachment. When the front wall plate 103 and the rear wall plate 104 are fixed to the fixing members 121, the front wall plate 103 and the rear wall plate 104 are fixed to each other approximately in parallel in a manner separated by a gap equal to the thickness of the fixing members 121, so that the wall assembly with display screen 1001 is constructed.

The display panel 106 which is an image display device has approximately a cubic shape. Its one surface is the display screen 161. Here, when the liquid crystal technology is employed, the display panel 106 is a device (component) constructed by accommodating a liquid crystal panel and a back light into a case composed of metal, synthetic resin, or the like. Alternatively, when the organic EL technology is employed, the display panel 106 is an organic EL panel. Further, the display panel 106 may employ another display technology. However, in the present embodiment, the display panel 106 is assumed to be a panel unit constructed by accommodating a liquid crystal panel and a back light into a metal case.

The holding member 123 is a board having approximately a rectangular shape. Then, a holding part 151 for holding the display panel 106 is provided at a position corresponding to the opening 131 of the front wall plate 103 (that is, a position opposing the opening 131 in a case that the front wall plate 103 is fixed to the fixing members 121 linked by the holding member 123). The holding part 151 has: an opening 152 having approximately a rectangular shape for accommodating the display panel 106; and holding plate sections (clamping members) 124 and 125 respectively provided on the two upper and lower sides of the opening 152. In the opening 152 of the holding part 151, the shape and the size of the inner periphery are approximately the same as those of the outer periphery of the display panel 106. Thus, when the display panel 106 is accommodated into the opening 152, the inner periphery face of the opening 152 abuts against the four side faces (the four surfaces perpendicular to the display screen 161) of (the case of) the display panel 106.

Further, the holding plate sections 124 and 125 of the holding part 151 are plate-shaped parts provided in a state of protruding respectively to the front face side and the rear face side of the holding member 123 in such a manner that the area of the inner surface on the upper and lower sides of the opening 152 is expanded. The holding plate sections 124 and 125 increase the contact area between the display panel 106 accommodated in the opening 152 and the holding member 123, and hence increases the holding force of the holding member 123 for the display panel 106. The protrusion amount to the front face side of the holding plate sections 124 and 125 is adjust such that the protruding end abuts against the rear face of the front wall plate 103 when the front wall plate 103 is fixed to the fixing members 121. The width measured from the front face side end to the rear face side end of the holding plate sections 124 and 125 is approximately the same as the depth of the display panel 106.

A plurality of through holes (not shown) are formed in the holding plate sections 124 and 125. Further, a plurality of screw holes (not shown) are formed in the case of the display panel 106. Then, after the display panel 106 is accommodated into the opening 152, screws 133 (see FIG. 39) are screwed through the through holes of the holding plate sections 124 and 125 into the screw holes of the display panel 106, so that the display panel 106 is fixed in an immobile manner.

Here, the size of the opening 131 of the front wall plate 103 is slightly smaller than the display screen 161 of the display panel 106. Thus, when the display panel 106 is fixed to the holding plate sections 124 and 125 with the screws 133, the edge portion of the display screen 161 abuts against the edge portion on the rear face side of the opening 131 of the front wall plate 103. Here, when a transparent glass plate, a synthetic resin plate, or the like is inserted into the opening 131 of the front wall plate 103, the size of the opening 131 may be larger than the display screen 161, so that the display screen 161 may abut against the glass plate or the synthetic resin plate. Alternatively, when a transparent glass plate, a synthetic resin plate, or the like is not inserted into the opening 131 of the front wall plate 103, the size of the opening 131 of the front wall plate 103 may be approximately the same as the opening 152 of the holding member 123, so that the front face side edge section of the display panel 106 may be fitted into the opening 131. However, in this case, preferably, the display panel 106 does not protrude to the front direction beyond the opening 131 of the front wall plate 103.

Further, in the rear face of the holding member 123, a circuit board 135 on which a circuit for processing display on the display panel 106 is mounted is arranged in a lower part of the holding part 151 (in the side face of the display panel 106 held by the holding member 123). That is, in the rear face of the holding member 123, the circuit board 135 is arranged in alignment with the display panel 106 in the direction (four directions) along the wall surface of the front wall plate 103. The circuit board 135 is fixed to the holding member 123 by screw clamping or the like, and then connected to the display panel 106 through a cable 136 (see FIG. 39) such as a flexible cable. Further, the circuit board 135 is connected to the power supply, the antenna, or the like through a cable 137.

Further, in the circuit board 135, a heat sink 138 is attached onto the rear face side defined so when the circuit board 135 is fixed to the holding member 123. The heat sink 138 is a board having approximately a rectangular shape larger than the circuit board 135, and is manufactured from a raw material such as a metal having a high thermal conduction efficiency. Since the heat sink 138 is larger than the circuit board 135, the heat sink 138 is attached onto the circuit board 135 in a manner extending outward from all sides of the circuit board 135. The heat sink 138 is attached to the circuit board 135 by screw clamping or bonding.

Similarly, a heat sink 139 is attached to the rear face of the display panel 106 (the opposite face to the display screen 161). The heat sink 139 is a board having approximately a rectangular shape larger than the rear face of the display panel 106, and is manufactured from a raw material such as a metal having a high thermal conduction efficiency. Since the heat sink 139 is larger than the rear face of the display panel 106, the heat sink 139 is attached onto the rear face of the display panel 106 in a manner extending outward from all sides of the rear face of the display panel 106. The heat sink 139 is attached to the rear face of the display panel 106 by screw clamping or bonding.

In a case that the heat sink 139 is attached to the rear face of the display panel 106 held by the holding member 123 and that the heat sink 138 is attached onto the circuit board 135 fixed to the holding member 123, a predetermined gap is provided between the heat sinks 138 and 139 and the rear wall plate 104 such that the heat sinks 138 and 139 do not contact with the rear wall plate 104. Here, the heat sinks 138 and 139 are attached in order to perform efficient heat radiation of the circuit board 135 and the display panel 106, and hence are not indispensable. Thus, a configuration is also employable that the wall assembly with display screen 1001 does not have the heat sinks 138 and 139.

Further, in the holding member 123, a ventilation opening 154 is formed at a position corresponding to the ventilation opening 112 of the front wall plate 103. The ventilation opening 154 of the holding member 123 has approximately the same shape as the ventilation opening 112 of the front wall plate 103. On the front face side of the holding member 123, a cylindrical duct part 155 is protruded such as to surround the ventilation opening 154. The duct part 155 is constructed such that its protruding end abuts against the rear face of the front wall plate 103 when the front wall plate 103 is fixed to the fixing members 121.

The duct part 155 forms an air passage from the ventilation opening 112 of the front wall plate 103 to the ventilation opening 154 of the holding member 123, so that air flows from the front face side of the front wall plate 103 to the gap between the holding member 123 and the rear wall plate 104. The air having flowed through the ventilation opening 112, the duct part 155, and the ventilation opening 154 into the gap between the holding member 123 and the rear wall plate 104 goes up along the rear wall plate 104, then flows through the surroundings of the display panel 106 and the heat sink 139 and the surroundings of the circuit board 135 and the heat sink 139 and the like, and then is released from an open portion in the upper part of the wall assembly with display screen 1001 (that is, the open portion serves as a ventilation opening).

Here, in FIGS. 39 and 40, air flow is indicated by arrows of dashed dotted line. By virtue of this air flow, the air inside the wall assembly with display screen 1001 warmed by the heat generated by the display panel 106 and the circuit board 135 in association with the operation of the display panel 106 is exchanged with the outside air, so that the heat sinks 138 and 139 are cooled down.

Here, the above-mentioned air flow is a flow generated automatically owing to the convection of air warmed by the heat of the display panel 106 and the circuit board 135. However, in contrast, a fan or the like may be provided inside the wall assembly with display screen 1001 so that forced air intake or exhaust may be performed. This improves the cooling efficiency. Further, when the wall assembly with display screen 1001 is installed as a part of the wall of an architecture, the open portion of the upper part of the wall assembly with display screen 1001 may be led to an air circulation passage for a ventilating fan or the like of the room, so that exhaustion may be achieved efficiently.

In the wall assembly with display screen 1001 having the above-mentioned configuration, the display panel 106 is held inside the wall assembly with display screen 1001, and the holding member 123 holds the display panel 106 and the circuit board 135 in the front wall plate 103 in an immobile manner. By virtue of this, the display panel 106 is incorporated into the wall assembly with display screen 1001 in an embedded and integrated manner. No housing is necessary for accommodating the display panel 106, the circuit board 135, and the like in the form of a display device. In other words, the front wall plate 103, the rear wall plate 104, and the like are used as the housing of a display device. Thus, the display panel 106, the circuit board 135, the cable 137, and the like which are necessary for the display function of can be arranged arbitrarily in the inside of the wall assembly with display screen 1001. This permits easy thickness reduction in the wall assembly with display screen 1001. Thus, for example, even when a satisfactory wall thickness cannot be ensured in an architecture or alternatively a thin wall assembly is required in the case of an indoor partition or the like, a wall assembly having a display function, that is, the wall assembly with display screen 1001 of the third embodiment, is applicable. Further, in this configuration, merely the display screen 161 is exposed through the opening 131 formed in the wall surface of the wall assembly with display screen 1001. This avoids degradation in the esthetic appearance of the room and occupation of a part of the space of the room.

Further, the front wall plate 103 and the rear wall plate 104 are fixed by the fixing members 121 in a manner separated from each other by a predetermined gap, while the holding member 123 for holding the display panel 106 is fixed between the front wall plate 103 and the rear wall plate 104, so that the wall assembly with display screen 1001 is constructed. Thus, even when priority is imparted to design property or the like so that the front wall plate 103 and the rear wall plate 104 are manufactured from a raw material having a low strength, the holding member 123 can be manufactured from a raw material having a high strength so that the display panel 106 can be held reliably.

Further, a gap is provided between the display panel 106 and the rear wall plate 104, and then outside air is caused to flow into the gap between the display panel 106 and the rear wall plate 104 via the ventilation opening 112 of the front wall plate 103 and via the duct part 155 and the ventilation opening 154 of the holding member 123. Thus, air in the surroundings of the display panel 106, the circuit board 135, and the like in the wall assembly with display screen 1001 can be exchanged with the outside air, so that the heat generated by the display panel 106, the circuit board 135, and the like can be released to the outside. Further, when the heat sink 139 is attached to the display panel 106 while the heat sink 138 is attached to the circuit board 135, the heat is diffused efficiently. Furthermore, a larger space is ensured inside the wall assembly with display screen 1001 than inside the display panel 106. Thus, the heat sink 139 can be fabricated in a size larger than the rear face of the display panel 106. This improves the heat radiation efficiency further, without the necessity of increase in the thickness of the wall assembly with display screen 1001.

Further, in place of a configuration that the circuit board 135 on which a circuit for processing display on the display panel 106 is mounted is provided in the rear face of the display panel 106, the circuit board 135 is arranged in alignment with the display panel 106 in a direction along the wall surface of the front wall plate 103. This permits further thickness reduction in the wall assembly with display screen 1001.

Figure 41:
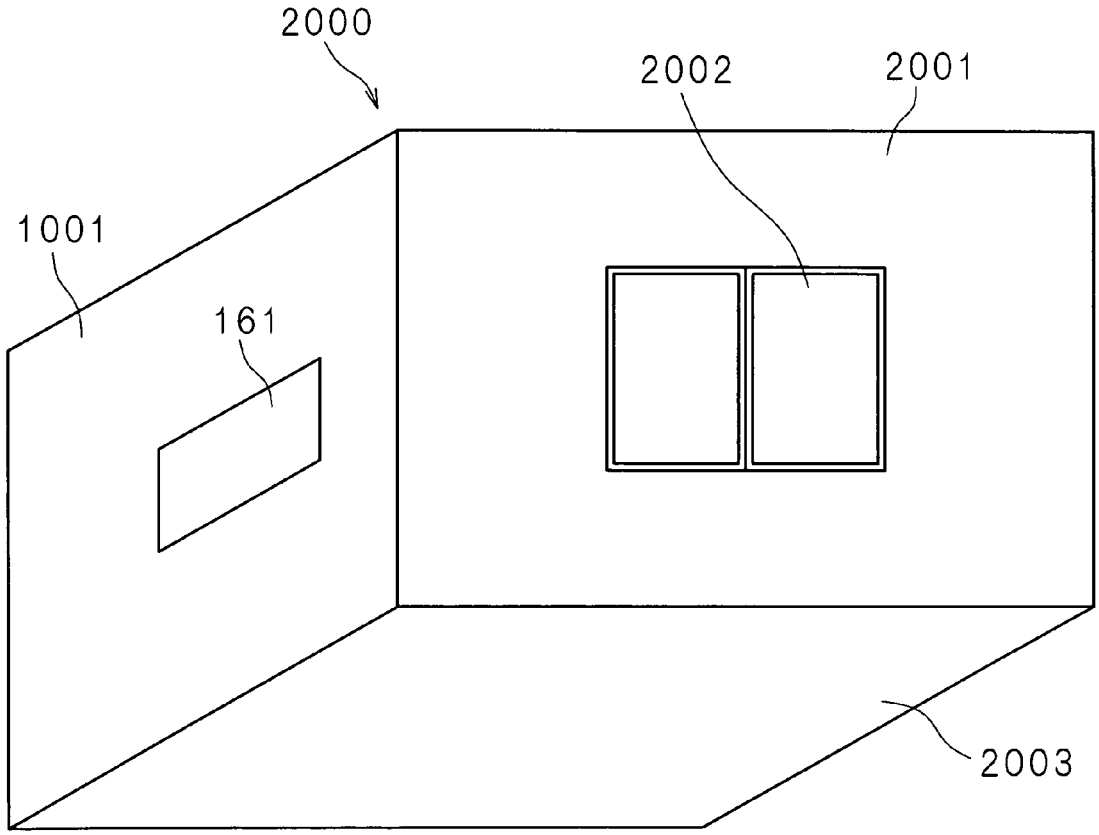
FIG. 41 is a schematic diagram showing an example of an architecture that employs a wall assembly with display screen according to the third embodiment.

FIG. 41 is a schematic diagram showing an example of an architecture 2000 that employs a wall assembly with display screen 1001 according to the third embodiment. The architecture 2000 has a room constructed by being surrounded by: a wall composed of the wall assembly with display screen 1001 shown in FIGS. 37 to 40: other walls 2001 (only one of them is shown) in which a window 2002 and the like is provided; a floor 2003; a ceiling (not shown); and the like. Since the wall assembly with display screen 1001 is employed, in the room of the architecture 2000, merely the display screen 161 is provided in the one wall. Thus, the esthetic appearance of the room is not degraded. Further, without occupation of a part of the space of the room, the device used by a user for watching a video can be installed in the room. Here, FIG. 41 shows an example that the wall assembly with display screen 1001 according to the third embodiment is used as a wall of the architecture 2000. However, the use of the wall assembly with display screen 1001 is not limited to this. For example, the wall assembly with display screen 1001 may also be used as a portable partition for dividing the inside of a room or the like.

Here, the third embodiment has been described for the case that the holding member 123 holds the display panel 106. However, the configuration is not limited to this. That is, the display panel 106 may be fixed directly to the front wall plate 103 or the rear wall plate 104 by screw clamping or the like, so that the front wall plate 103 or the rear wall plate 104 may hold the display panel 106. Further, the shape and the configuration of the wall assembly with display screen 1001 shown in FIGS. 37 to 40 are examples, and the present invention is not limited to these. That is, as shown in the following modification, other shapes and configurations may be employed. Further, the configuration of the architecture 2000 shown in FIG. 41 is an example, and the present invention is not limited to this.

Figure 42A:
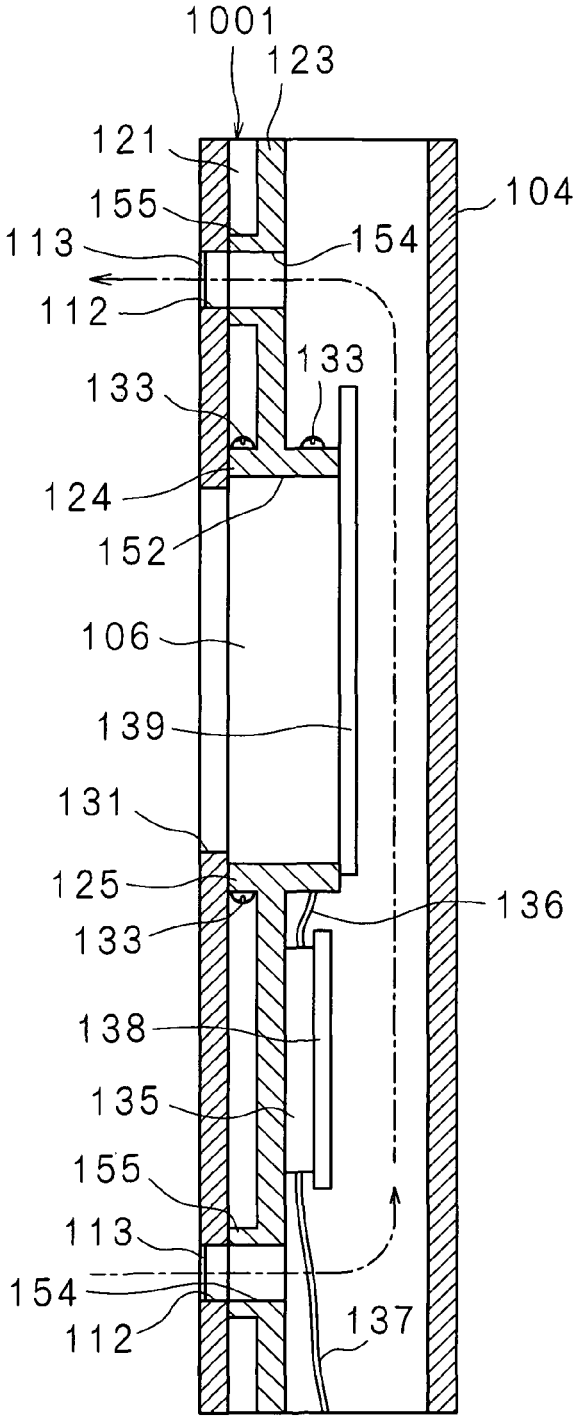
FIGS. 42A and 42B are sectional side views showing a configuration of a wall assembly with display screen according to a modification of the third embodiment.
Figure 42B:
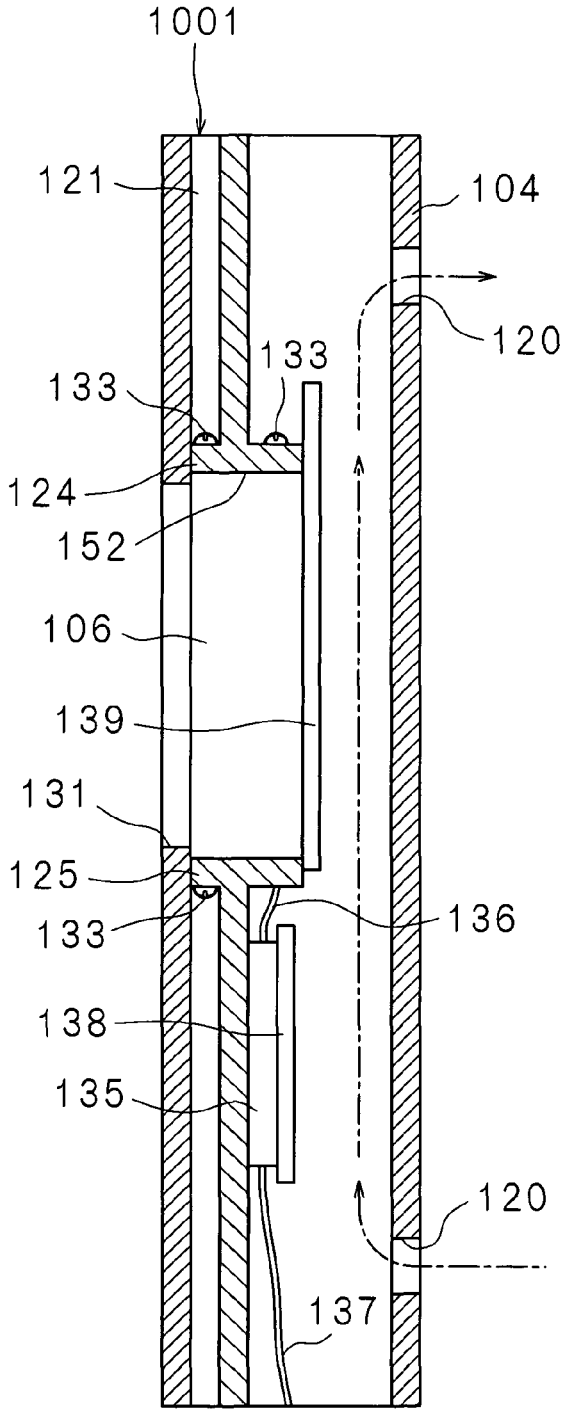

FIGS. 42A and 42B are sectional side views each showing a configuration of a wall assembly with display screen 1001 according to a modification of the third embodiment. These figures show modifications concerning ventilation in the wall assembly with display screen 1001. The wall assembly with display screen 1001 shown in FIGS. 37 to 40 has a configuration that air having flowed through the ventilation opening 112, the duct part 155, and the ventilation opening 154 provided in the lower part of the wall assembly with display screen 1001 is released from the open portion of the upper part of the wall assembly with display screen 1001. However, another configuration may be employed that a ventilation opening 112, a duct part 155, and a ventilation opening 154 is further provided in the upper part of the wall assembly with display screen 1001 (see FIG. 42A). According to this configuration, the air having flowed through the ventilation opening 112, the duct part 155, and the ventilation opening 154 in the lower part of the wall assembly with display screen 1001 can be released from the ventilation opening 112, the duct part 155, and the ventilation opening 154 in the upper part of the wall assembly with display screen 1001.

Further, in place of the configuration that ventilation is performed at the front face side of the wall assembly with display screen 1001, a ventilation opening 120 may be formed in each of the upper part and the lower part of the rear wall plate 104 (see FIG. 42B) so that ventilation may be performed at the rear face side of the wall assembly with display screen 1001. Further, a configuration (not shown) may be employed that no ventilation opening is provided in the front wall plate 103 and the rear wall plate 104 so that air flows through the open portion of the lower part of the wall assembly with display screen 1001 and then is released from the open portion of the upper part of the wall assembly with display screen 1001 (that is, the open portions of the upper and lower sides of the wall assembly with display screen 1001 serve as ventilation openings).

Figure 43A:
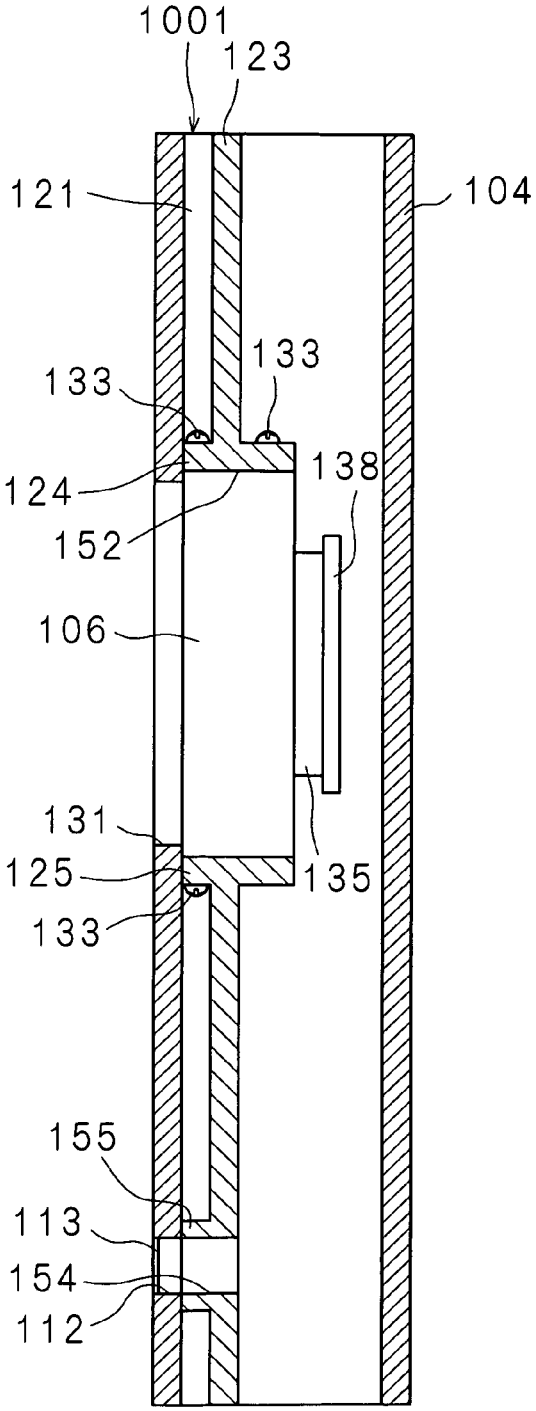
FIGS. 43A and 43B are sectional side views showing a configuration of a wall assembly with display screen according to a modification of the third embodiment.
Figure 43B:
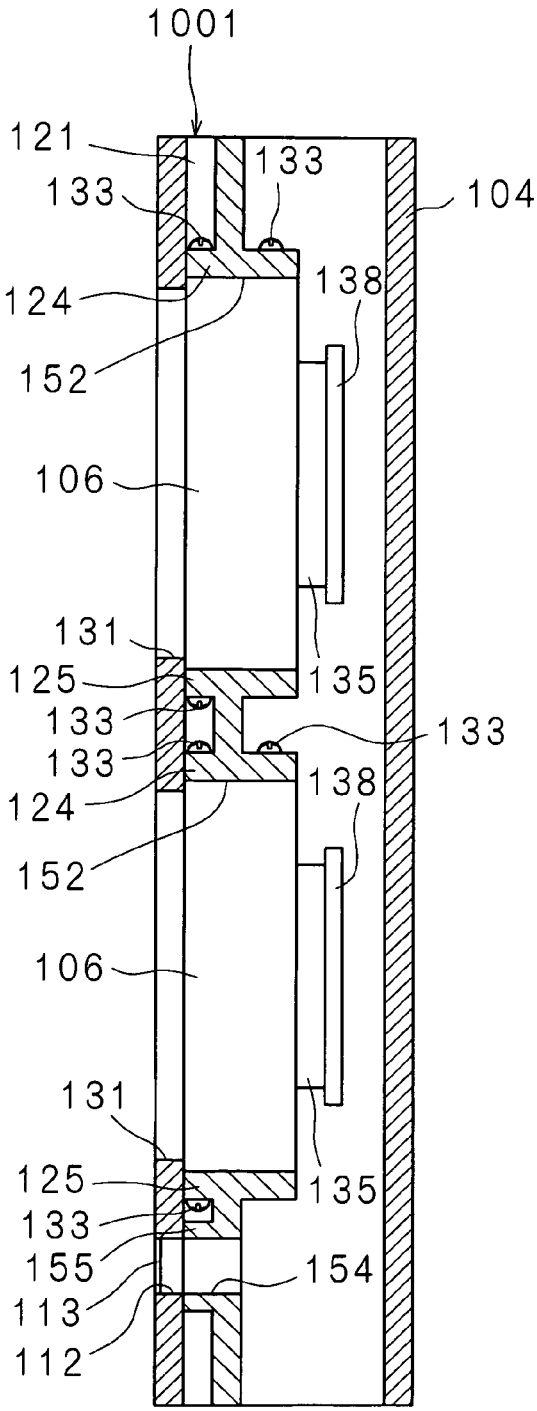

FIGS. 43A and 43B are sectional side views each showing a configuration of a wall assembly with display screen 1001 according to a modification of the third embodiment. This figure shows a modification concerning arrangement of the circuit board 135 of the wall assembly with display screen 1001. The wall assembly with display screen 1001 shown in FIGS. 37 to 40 has a configuration that the circuit board 135 is arranged in alignment with the display panel 106 in a direction along the wall surface of the front wall plate 103. However, the present invention is not limited to this. For example, the circuit board 135 may be fixed to the rear face of the display panel 106 (see FIG. 43A). This could cause an increase in the thickness of the wall assembly with display screen 1001. However, utilizing the space in the side face part of the display panel 106, other devices such as another display panel 106 may further be held inside the wall assembly with display screen 1001 (see FIG. 43B).

As this invention may be embodied in several forms without departing from the spirit of essential characteristics thereof, the present embodiment is therefore illustrative and not restrictive, since the scope of the invention is defined by the appended claims rather than by the description preceding them, and all changes that falling within metes and bounds of the claims, or equivalence of such metes and bounds thereof are therefore intended to be embraced by the claims.

What is claimed is:

1. A wall assembly comprising:

at least two columnar members;

a holding member bridged between said columnar members so as to hold an AV device; and a front cover plate for covering front sides of said columnar members; and a rear cover plate for covering rear sides of said columnar members;

a first gap between said front cover plate and said holding member and a second gap between said rear cover plate and said holding member;

wherein at least one of said front cover plate and said rear cover plate is attached to the holding member in a manner permitting opening and closing or attachment and detachment;

wherein said holding member has a plate member whose horizontal side portions are connected to said columnar members, a rectangular opening which is formed in the plate member and into which the AV device is to be fitted, and clamping members provided in an upper side portion and a lower side portion of said opening and configured to clamp the AV device from up and down directions.

2. The wall assembly according to claim 1, wherein said clamping members have a flat-plate shape formed in an integrated manner in a direction normal to said cover plate respectively from an upper side portion and a lower side portion of said opening approximately perpendicularly to said plate member, and have screw hole holes provided on one face side of said plate member and used for fastening the AV device.

3. The wall assembly according to claim 1, further comprising a spacer member for adjusting a distance between the individual clamping members in up and down directions.

4. The wall assembly according to claim 1, wherein said plate member has clamping pieces for clamping said clamping members in a manner movable in up and down directions.

5. The wall assembly according to claim 1, wherein said clamping members have a shallow-dish shaped part and a mounted piece on an outer side of a bottom face of said shallow-dish shaped part, and the mounted piece is screwed from one face side onto said plate member.

* * * * *